US011217178B2

(12) United States Patent
Oh et al.

(10) Patent No.: US 11,217,178 B2
(45) Date of Patent: Jan. 4, 2022

(54) DISPLAY DEVICE

(71) Applicant: LG DISPLAY CO., LTD., Seoul (KR)

(72) Inventors: Dae Seok Oh, Paju-si (KR); Yong Won Jo, Paju-si (KR); Myung Jong Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/890,521

(22) Filed: Jun. 2, 2020

(65) Prior Publication Data

US 2020/0388228 A1 Dec. 10, 2020

(30) Foreign Application Priority Data

Jun. 5, 2019 (KR) ..... 10-2019-0067021

(51) Int. Cl.

| | |
|---|---|
| ***G09G 3/3266*** | (2016.01) |
| ***G09G 3/3233*** | (2016.01) |
| ***G09G 5/14*** | (2006.01) |
| ***G09G 5/373*** | (2006.01) |

(52) U.S. Cl.

CPC ..... *G09G 3/3266* (2013.01); *G09G 3/3233* (2013.01); *G09G 5/14* (2013.01); *G09G 5/373* (2013.01); *G09G 2300/026* (2013.01); *G09G 2300/0809* (2013.01); *G09G 2310/0221* (2013.01); *G09G 2330/022* (2013.01); *G09G 2330/023* (2013.01); *G09G 2380/02* (2013.01)

(58) Field of Classification Search

None

See application file for complete search history.

(56) References Cited

U.S. PATENT DOCUMENTS

| | | | | |
|---|---|---|---|---|
| 9,830,855 | B1 | 11/2017 | Li | |
| 9,871,082 | B2 * | 1/2018 | Jeon | H01L 27/323 |
| 2002/0196243 | A1 | 12/2002 | Morita | |
| 2013/0278624 | A1 | 10/2013 | Abe | |
| 2014/0320465 | A1 | 10/2014 | Oh et al. | |
| 2015/0022561 | A1 * | 1/2015 | Ikeda | G09F 9/301 345/690 |
| 2016/0118012 | A1 * | 4/2016 | Chang | G09G 3/2022 345/212 |
| 2018/0102096 | A1 | 4/2018 | Lee et al. | |
| 2018/0293939 | A1 | 10/2018 | Kim et al. | |
| 2018/0342192 | A1 | 11/2018 | Lee et al. | |
| 2019/0033919 | A1 | 1/2019 | Hirakata et al. | |

FOREIGN PATENT DOCUMENTS

| | | | |
|---|---|---|---|
| CN | 109584806 | A | 4/2019 |
| EP | 3098805 | A1 | 11/2016 |
| KR | 10-2014-0129622 | A | 11/2014 |
| KR | 10-2018-0130071 | A | 12/2018 |

* cited by examiner

*Primary Examiner* — Christopher J Kohlman

(74) *Attorney, Agent, or Firm* — Birch, Stewart, Kolasch & Birch, LLP

(57) ABSTRACT

Disclosed herein is a display which activates a maximum screen which is an entirety of a screen of a flexible display panel to display an image thereon in an unfolded state of the flexible display panel and activates a part of the screen in a folded state of the flexible display panel so that the activated screen that is smaller than the maximum screen displays the image and a deactivated screen displays black.

14 Claims, 37 Drawing Sheets

(a)

(b)

DISPLAY DEVICE

CROSS-REFERENCE TO RELATED APPLICATIONS

This application claims priority to and the benefit of Korean Patent Application No. 10-2019-0067021, filed Jun. 5, 2019 in the Republic of Korea, the disclosure of which is incorporated herein by reference in its entirety into the present application.

BACKGROUND

Field

The present disclosure relates to a display device in which a screen is capable of being folded using a flexible display panel.

Discussion of the Related Art

Electroluminescent display devices are roughly classified into inorganic light emitting display devices and organic light emitting display devices according to materials of light emitting layers. Active matrix type organic light emitting display devices include organic light emitting diodes (hereinafter referred to as "OLEDs"), which emit light by themselves and have fast response speeds and advantages in which light emission efficiencies, brightness, and viewing angles are high. In the organic light emitting display devices, the OLEDs are formed in pixels. Since the organic light emitting display devices have fast response speeds and are excellent in light emission efficiency, brightness, and viewing angle as well as capable of exhibiting a black gray scale in a full black color, the organic light emitting display devices are excellent in contrast ratio and color reproducibility.

The organic light emitting display devices do not require backlight units and can be implemented on a plastic substrate, a thin glass substrate, or a metal substrate, which is made of a flexible material. Therefore, flexible displays can be implemented as the organic light emitting display devices.

A screen size of the flexible display can be varied by winding, folding, and/or bending a flexible display panel. The flexible display can be implemented as a rollable display, a bendable display, a foldable display, a slidable display, or the like. The flexible display devices can be applied not only to mobile devices such as smartphones and tablet personal computers (PCs), but also to televisions (TVs), vehicle displays, and wearable devices, where application fields of the flexible display device are expanding.

The screen size of the foldable display can be varied by folding or unfolding a large screen. An information device employing a foldable display can have a limitation in that power consumption can be greater than that of a conventional mobile device due to a large screen. For example, since a foldable phone employs a foldable display of 7 inches or more, a load of a display panel increases 5.7 times as compared to that of the existing smart phone, and thus power consumption increases largely. The increase in power consumption can cause a reduction in battery lifetime. Consequently, the foldable phone requires a battery which is much larger in capacity than that of the existing smart phone.

SUMMARY

The present disclosure is directed to solving or addressing all the above-described problems and other limitations associated with the related art devices.

It should be noted that objects of the present disclosure are not limited to the above-described objects, and other objects of the present disclosure will be apparent to those skilled in the art from the following descriptions.

According to an aspect of the present disclosure, there is provided a display device including a flexible display panel including a screen in which pixels are disposed and in which data lines to which data voltages are applied cross gate lines to which gate signals are applied, and a display panel driver configured to activate a maximum screen which is an entirety of the screen of the flexible display panel and display an image thereon in an unfolded state of the flexible display panel and activate a part of the screen in a folded state of the flexible display panel so that the activated screen that is smaller than the maximum screen displays the image and an deactivated screen displays a black gray scale.

The display panel driver can include a gate driver configured to sequentially supply the gate signals to the gate lines of the screen.

The gate driver can receive a first gate start pulse to supply the gate signals to the gate lines of the activated screen and receive a second gate start pulse to supply the gate signals to the gate lines of the deactivated screen.

A frequency of the second gate start pulse can be lower than that of the first gate start pulse.

According to another aspect of the present disclosure, there is provided a method of driving the foldable display which includes: activating a maximum screen which is an entirety of a screen of the flexible display panel to display an image thereon in an unfolded state of the flexible display panel; activating a part of the screen and displaying an image on the activated screen that is smaller than the maximum screen in a folded state of the flexible display panel; and displaying a black gray scale on a deactivated screen which is set as the remaining screen except for the activated screen in the folded state.

The displaying of the image on the activated screen can include supplying gate signals to gate lines of the activated screen using a first gate driver configured to receive a first gate start pulse and supply the gate signals to the gate lines of the activated screen.

The displaying of the black gray scale on the deactivated screen can supplying gate signals to gate lines of the deactivated screen using a second gate driver configured to receive a second gate start pulse and supply the gate signals to the gate lines of the deactivated screen. include

BRIEF DESCRIPTION OF THE DRAWINGS

The above and other objects, features and advantages of the present disclosure will become more apparent to those of ordinary skill in the art by describing exemplary embodiments thereof in detail with reference to the attached drawings, in which.

DETAILED DESCRIPTION OF THE EMBODIMENTS

Figure 1:
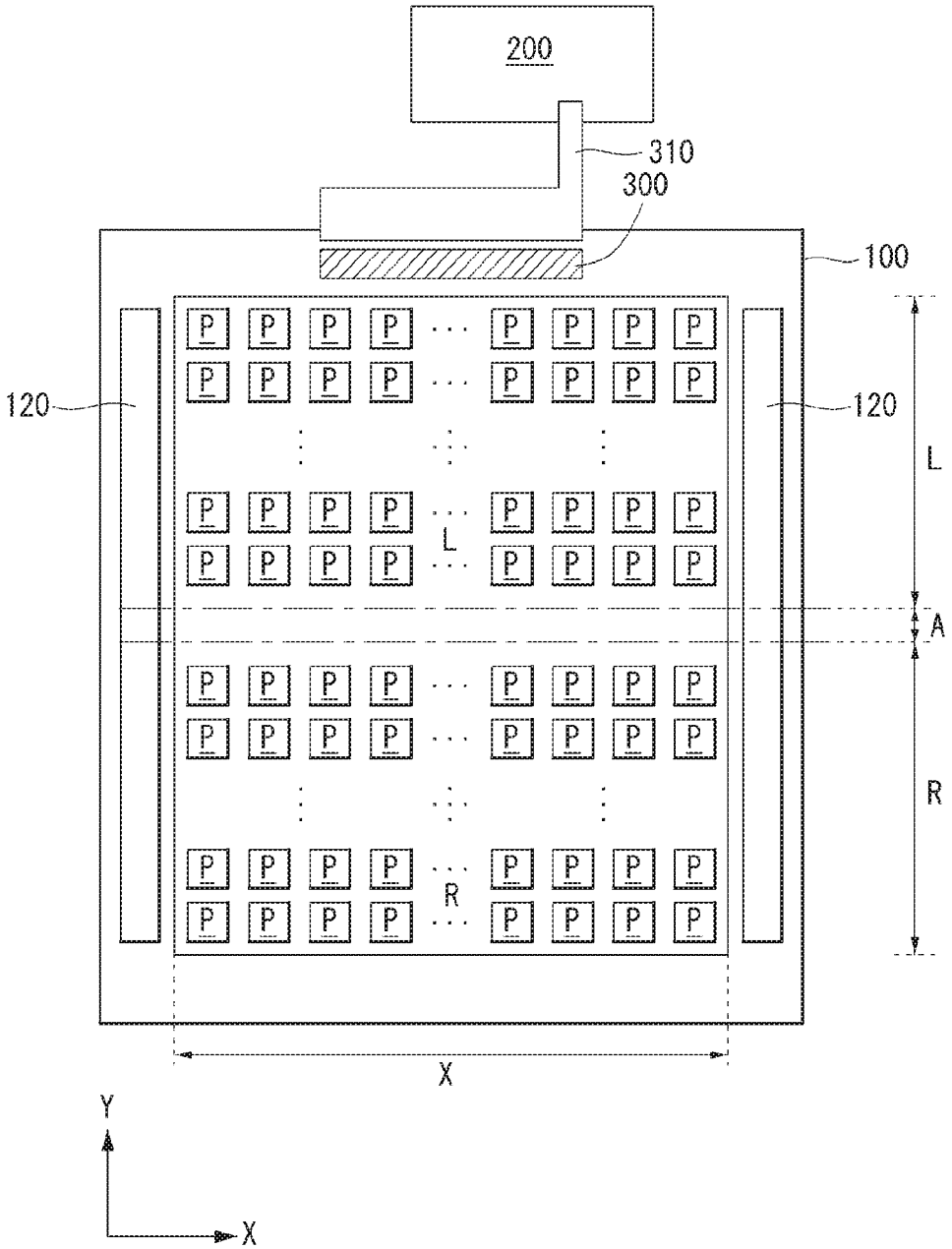
FIG. 1 is a block diagram illustrating a foldable display according to one embodiment of the present disclosure.

Advantages, features, and implementations thereof will be apparent from embodiments which are described in detail below together with the accompanying drawings. The present disclosure may, however, be implemented in many different forms and should not be construed as being limited to the embodiments set forth herein, and the embodiments are provided such that this disclosure will be thorough and complete and will fully convey the scope of the present disclosure to those skilled in the art to which the present disclosure pertains, and the present disclosure is defined by only the scope of the appended claims.

Shapes, sizes, ratios, angles, numbers, and the like disclosed in the drawings for describing the embodiments of the present disclosure are illustrative, and thus the present disclosure is not limited to the illustrated matters. The same reference numerals refer to the same components throughout this disclosure. Further, in the following description of the present disclosure, when a detailed description of a known related art is determined to unnecessarily obscure the gist of the present disclosure, the detailed description thereof will be omitted herein. When the terms "including," "having," "consisting of," and the like mentioned in this disclosure are used, other parts can be added unless the term "only" is used herein. When a component is expressed as a singular number, the plural number is included unless otherwise specified.

In analyzing a component, it is interpreted as including an error range even when there is no explicit description.

In describing a positional relationship, for example, when a positional relationship of two parts is described as being "on," "above," "below, "next to," or the like, unless "immediately" or "directly" is used, one or more other parts can be located between the two parts.

In describing the embodiments, although the terms first, second, and the like are used to describe various components, these components are not substantially limited by these terms and do not define any order. These terms are used only to distinguish one component from another component. Therefore, a first component described below can substantially be a second component within the technical spirit of the present disclosure.

The same reference numerals refer to the same components throughout this disclosure.

Features of various embodiments of the present disclosure can be partially or entirely coupled or combined with each other and can technically be various interlocking and driving, and the embodiments can be independently implemented with respect to each other or implemented together with a correlation.

In a foldable display of the present disclosure, each of a pixel circuit and a gate driver can include a plurality of transistors. The transistors can be implemented as oxide thin film transistors (TFTs) including oxide semiconductors, low temperature poly silicon (LTPS) TFTs including LTPSs, and the like. Each of the transistors can be implemented as a p-channel TFT or an n-channel TFT. In the embodiment, the transistors of a pixel circuit are mainly described as an example implemented as p-channel TFTs, but the present disclosure is not limited thereto.

The transistor is a three-electrode element including a gate, a source, and a drain. The source is an electrode for supplying a carrier to the transistor. In the transistor, the carries begins to flow from the source. The drain is an electrode in which the carrier is discharged from the transistor to the outside. In the transistor, the carrier flows from the source to the drain. In the case of an n-channel transistor, since the carrier is an electron, a source voltage is lower than a drain voltage so as to allow electrons to flow from the source to the drain. In the n-channel transistor, a current flows in a direction from the drain to the source. In the case of a p-channel transistor (a p-type metal oxide semiconductor (PMOS)), since the carrier is a hole, the source voltage is higher than the drain voltage so as to allow holes to flow from the source to the drain. In the p-channel transistor, since the holes flow from the source to the drain, a current flows from the source to the drain. It should be noted that the source and the drain of the transistor are not fixed. For example, the source and the drain can be changed according to an applied voltage. Therefore, the present disclosure is not limited due to the source and the drain of the transistor. In the following description, the source and the drain of the transistor will be referred to as a first electrode and a second electrode, respectively.

A gate signal swings between a gate on voltage and a gate off voltage. The gate on voltage is set to a voltage that is higher than a threshold voltage of the transistor, and the gate off voltage is set to a voltage that is lower than the threshold voltage of the transistor. The transistor is turned on in response to the gate on voltage, whereas the transistor is turned off in response to the gate off voltage. In the case of the n-channel transistor, the gate on voltage can be a gate high voltage (VGH), and the gate off voltage can be a gate low voltage (VGL). In the case of the p-channel transistor, the gate on voltage can be the VGL, and the gate off voltage can be the VGH.

In the following description of embodiments, a screen is a screen which is foldable by a flexible display panel and means a screen of which a resolution and a size are varied in a folded state and an unfolded state. In the folded state in which the flexible display panel is folded, a portion of the screen is activated, whereas the remaining portion thereof is deactivated. The activated screen includes pixels on which an input image is reproduced. The deactivated screen includes pixels which maintain a black gray scale. The activated screen is a display area in examples of FIGS. 16A and 16B. The deactivated screen is a non-display area which displays black in the examples of FIGS. 16A and 16B.

In order to reduce power consumption of a gate driver, when gate lines of the deactivated screen are driven, the gate driver can drive the gate lines at a frequency that is lower than that of the activated screen.

Hereinafter, various embodiments of the present disclosure will be described in detail with reference to the accompanying drawings.

Referring to FIGS. 1 to 6, a foldable display of the present disclosure includes a flexible display panel 100 and display panel drivers (120 and 300).

When the flexible display panel 100 is unfolded, the display panel drivers (120 and 300) activate all screens of the flexible display panel 100 to display an image on a maximum screen. When the flexible display panel 100 is folded, the display panel drivers (120 and 300) activate a part of all the screens to display an image on a screen that is smaller than the maximum screen and display black on a deactivated screen.

Figure 6:
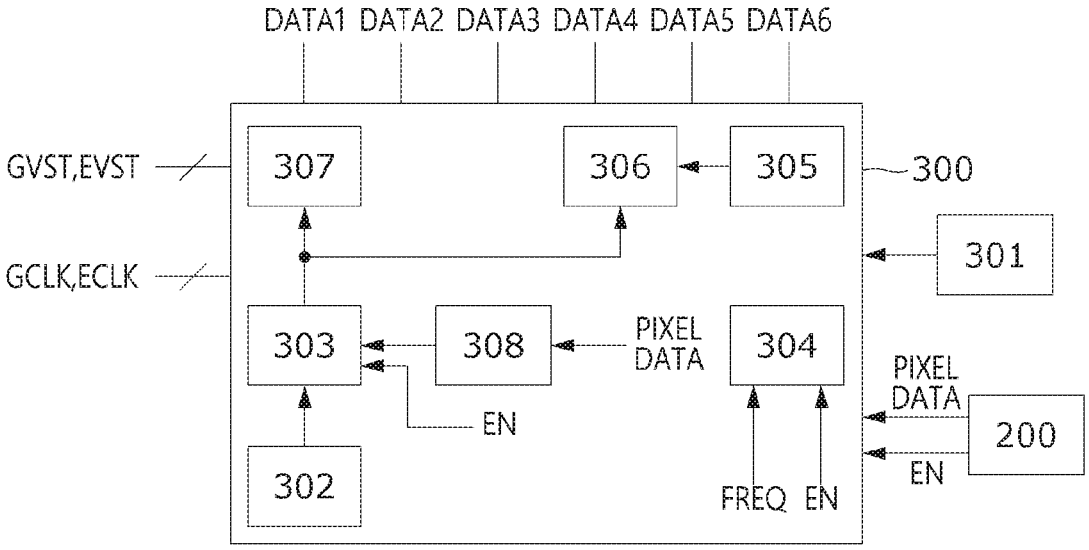
FIG. 6 is a block diagram illustrating a configuration of a drive integrated circuit (IC) according to one or more embodiments of the present disclosure.

As shown in FIGS. 1 and 6, the display panel drivers (120 and 300) include a gate driver 120 for supplying gate signals to gate lines GL1 and GL2 of the flexible display panel 100, a data driver 306 for converting pixel data into a voltage of a data signal and supplying the voltage to data lines through activated data output channels, and a timing controller 303 for activating data output channels of the data driver 306 according to a folding angle of the flexible display panel and controlling an operating timing of the data driver 306 and the gate driver 120. The data driver 306 and the timing controller 303 can be integrated in a drive integrated circuit (IC) 300.

In the flexible display panel 100, a screen which reproduces an input image includes data lines DL1 to DL6, the gate lines GL1 and GL2 crossing the data lines DL1 to DL6, and a pixel array in which pixels P are disposed in the form of a matrix. The screen is at least divided into a first screen L and a second screen R. A folding boundary A is present between the first screen L and the second screen R. The screen of the flexible display panel 100 can include a plurality of folding boundaries A to be folded in various forms.

Figure 2A:
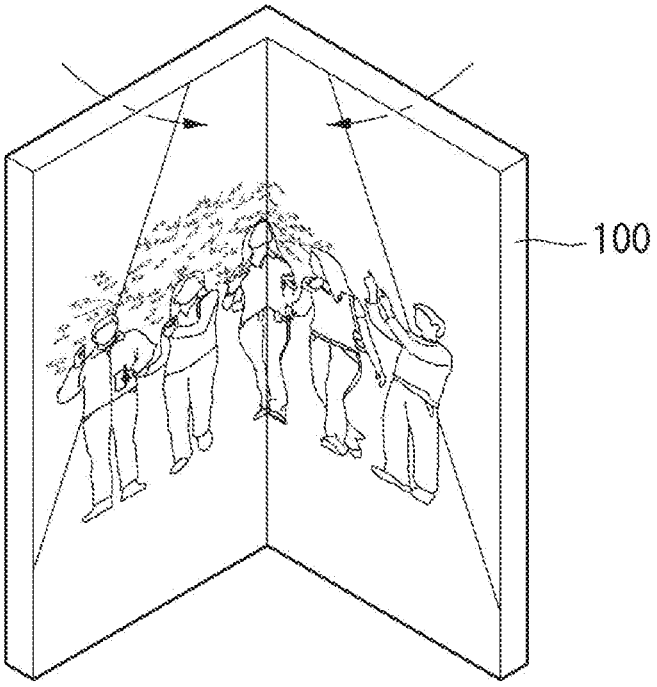
FIGS. 2A and 2B are diagrams illustrating examples in which the foldable display is folded.
Figure 2B:
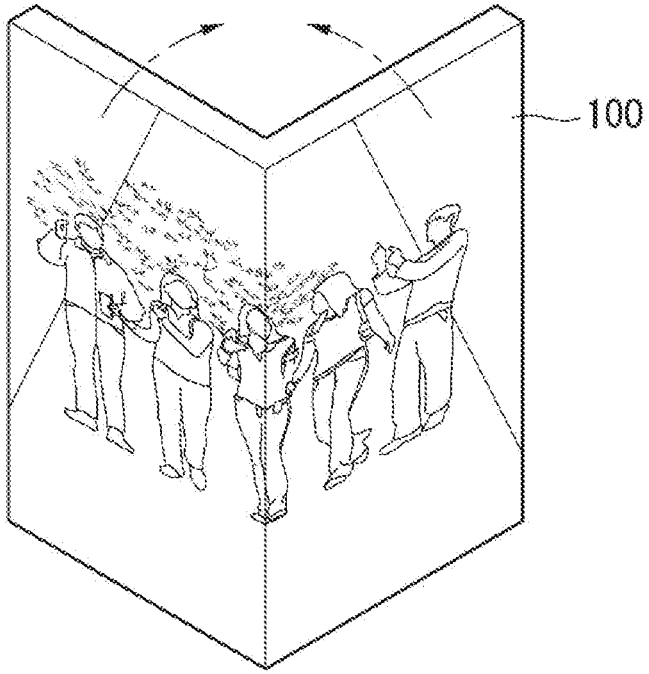

As shown in FIGS. 2A and 2B, the flexible display panel 100 can be folded with respect to the folding boundary A as a boundary. The first screen L, the second screen R, and the folding boundary A are selectively driven according to folded/unfolded states, a folding angle, and the like of the flexible display panel 100, and thus a size and a resolution of an activated screen displaying an image or information can be varied.

The timing controller 303 can determine a folded or unfolded state of the flexible display panel 100 on the basis of an enable signal EN from a host system 200 and further determine a folding angle of the flexible display panel 100. The timing controller 303 can control a size and a resolution of an activated screen in the unfolded state of the flexible display panel 100 as a maximum screen and a maximum resolution thereof. In the unfolded state of the screen, the first screen L is substantially coplanar with the second screen R.

The flexible display panel 100 can be folded in an in-folding method shown in FIG. 2A or an out-folding method shown in FIG. 2B. In the in-folding method, the first screen L is brought into contact with the second screen R inside the folded flexible display panel 100. In the in-folding method, since the first screen L and the second screen R are disposed inside the folded flexible display panel 100, the first screen L and the second screen R are not exposed to the outside.

In the out-folding method, the flexible display panel 100 is folded in the form in which the first screen L and the second screen R are back to back. Thus, when the out-folding type foldable display is folded, the first screen L and the second screen R are exposed to the outside.

When the first screen L and the second screen R are folded with respect to the folding boundary A as a boundary, a resolution of one driven surface can be X*Y or X*(Y+A/2). That is the width of the first screen part L and the second screen part R may correspond to Y+A/2. The first screen L can be an upper half portion or a left half portion of the screen, and the second screen R can be a lower half portion or a right half portion of the screen. Of course, the present invention is not limited to the first screen part L and the second screen part R being half of the entire screen, but the first screen part L and the second screen part R may also have different widths. In other words, the folding boundary may not be a center line, i.e. in the middle, of the entire screen. Also, there may be more than one folding boundary, and thus more screen parts than the first screen part L and the second screen part R.

Figure 3:
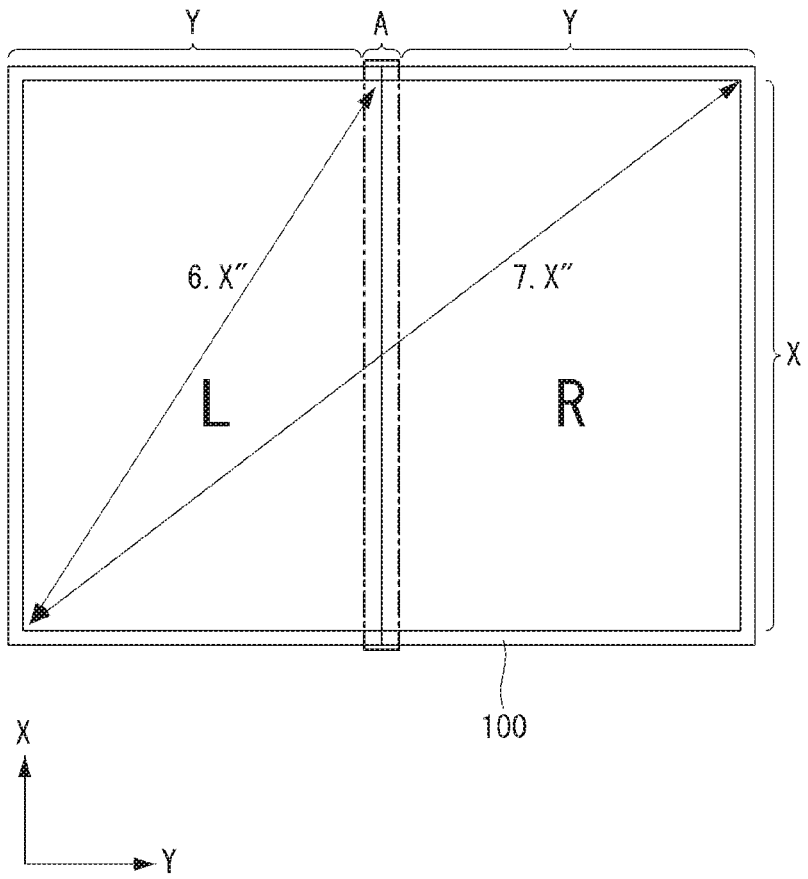
FIG. 3 is a diagram illustrating an example in which a screen size of a flexible display panel is varied according to one or more embodiments of the present disclosure.

In other words, the screen part A adjacent to the folding boundary includes a portion of the screen part L and a portion of the screen part R, respectively adjacent to the folding boundary. An input image or information may also be displayed on pixels P of the screen part A adjacent to the folding boundary. Since the pixels P are disposed in the screen part A adjacent to the folding boundary, in the unfolded state in which the first screen part L and the second screen part R are unfolded, a portion in which an image is discontinued is not present between the first screen part L and the second screen part R. A width of the folding boundary A, that is, a length in a Y-axis, is determined according to a curvature of the folding boundary A. A curvature of the folding boundary A is varied according to a folding angle of the flexible display panel 100. A resolution and a size of the folding boundary A are proportional to a curvature of the folding boundary A. For example, the size of the folding boundary increases when the flexible display panel 100 is folded in half and becomes minimal when the flexible display panel 100 is unfolded as shown in FIG. 3.

In FIG. 1, X is an X-axis resolution of the screens L, A, and R. Further, L+A+R is a Y-axis resolution of the screens L, A, and R.

When the flexible display panel 100 is unfolded and all of the first screen L, the second screen R, and the folding boundary A are driven, the sizes and the resolution of the screens L, A, and R are maximized. When the flexible display panel 100 is folded in half with respect to the folding boundary A and either the first screen L or the second screen R is driven, the size and the resolution of the screen are reduced. For example, when either the first screen L or the second screen R is driven, a size of an activated screen which displays an image can be reduced to 6 inches (6.x") and a resolution of the screen can be 2160*1080. Meanwhile, when all the screens L, A, and R are driven, a size of a screen which displays an image can be increased 7 inches (7.x") and a resolution of the screen can be increased to 2160*2160.

Figure 7A:
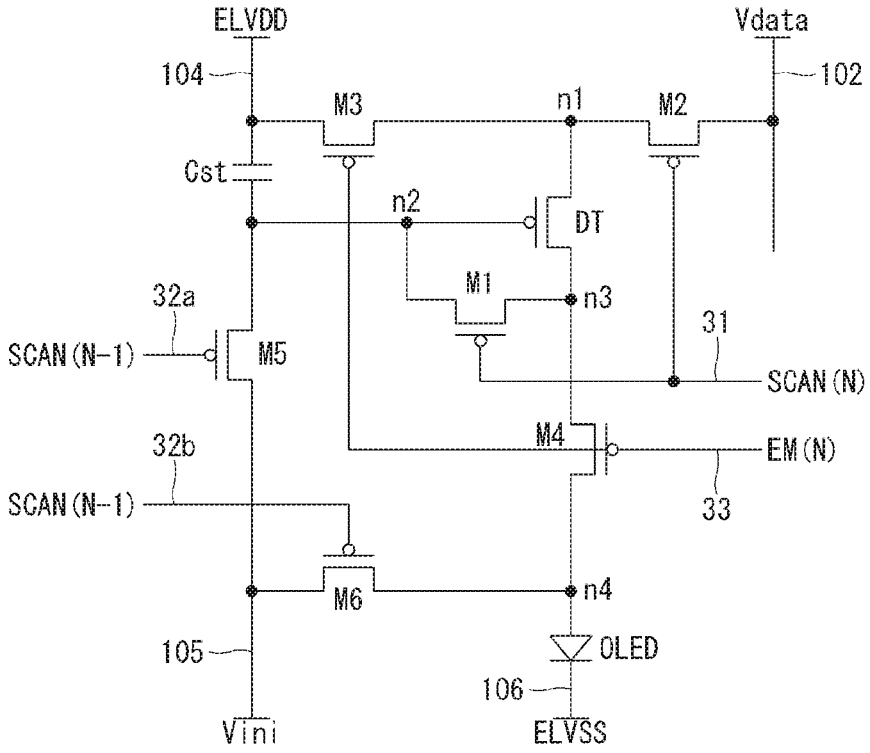
FIG. 7A is a circuit diagram illustrating an example of a pixel circuit according to one or more embodiments of the present disclosure.

In order to implement colors, each of the pixels P includes sub-pixels having different colors. The sub-pixels include red (hereinafter also referred to as an "R sub-pixel"), green (hereinafter also referred to as a "G sub-pixel"), and blue (hereinafter also referred to as a "B sub-pixel"). As a variation, a white sub-pixel can be further included. As shown in FIG. 7A, each of the sub-pixels can be implemented as a pixel circuit including an internal compensation circuit.

Figure 4:
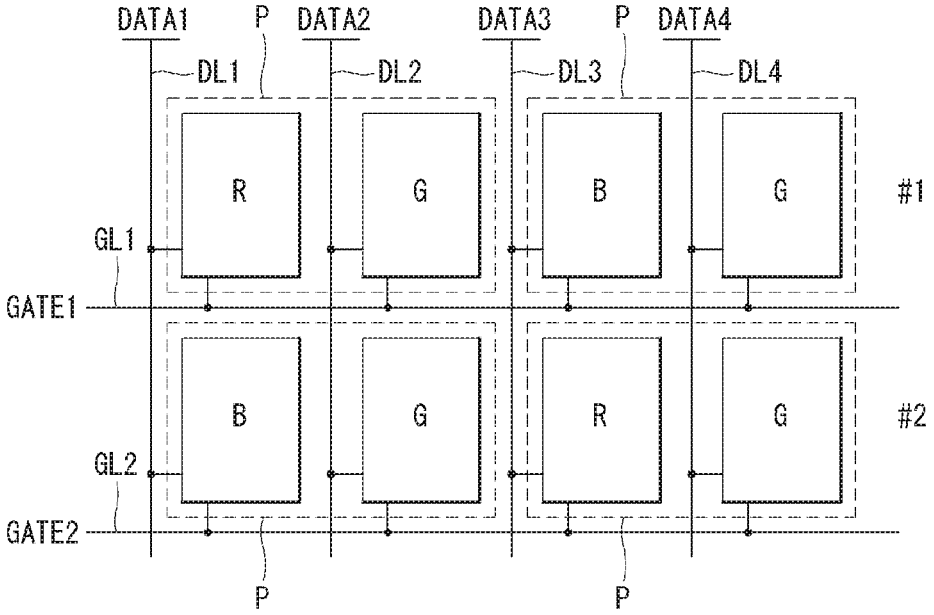
FIG. 4 is a diagram illustrating an example of a pentile pixel arrangement according to one or more embodiments of the present disclosure.

The pixels P can be disposed as real color pixels and PenTile pixels. As shown in FIG. 4, the PenTile pixel can drive two sub-pixels having different colors as one pixel P using a preset PenTile pixel rendering algorithm to implement a resolution that is higher than that of the real color pixel. The PenTile pixel rendering algorithm compensates for a color expression, which is insufficient in each of the pixels P, with a color of light emitted from pixels adjacent thereto.

Figure 5:
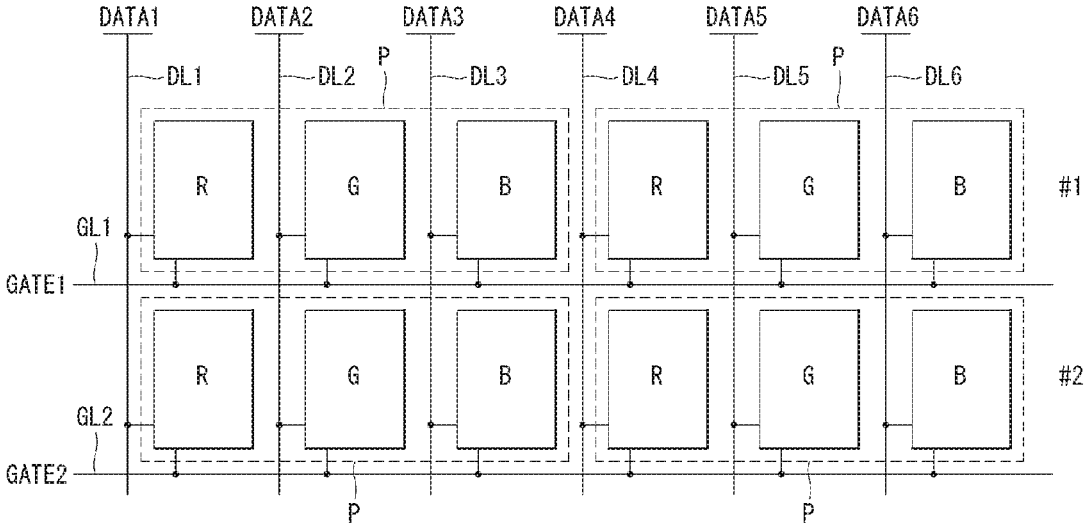
FIG. 5 is a diagram illustrating an example of a real pixel arrangement according to one or more embodiments of the present disclosure.

As shown in FIG. 5, in the case of the real color pixel, one pixel P includes R, G, and B sub-pixels.

In FIGS. 4 and 5, when a resolution of a pixel array is n*m, the pixel array includes n pixel columns and m pixel lines crossing the n pixel columns. The pixel column includes pixels disposed in a Y-axis direction. The pixel line includes pixels disposed in an X-axis direction. One horizontal time 1H is a time obtained by dividing one frame interval by the m pixel lines.

The flexible display panel 100 can be implemented as a plastic organic light emitting diode (OLED) panel. The plastic OLED panel includes a pixel array on an organic thin film bonded to a back plate. A touch sensor array can be formed on the pixel array.

The back plate can be a polyethylene terephthalate (PET) substrate. An organic thin film is formed on the back plate. A pixel array and a touch sensor array can be formed on the organic thin film. In order to prevent the pixel array from being exposed to humidity, the back plate blocks moisture permeation toward the organic thin film. The organic thin film can be a thin polyimide (PI) film substrate. A multilayer buffer film can be formed of an insulating material on the organic thin film. Lines for supplying power or signals applied to the pixel array and the touch sensor array can be formed on the organic thin film.

As shown in FIG. 7A, in the plastic OLED panel, the pixel circuit includes an OLED used as a light emitting element, a drive element for driving the OLED, a plurality of switching elements for switching current paths between the drive element and the OLED, and a capacitor connected to the drive element.

A drive IC 300 drives a pixel array of the screens L, A, and R displaying an image or information. As shown in FIG. 4 or 5, in the pixel array, the data lines DL1 to DL6 cross the gate lines GL1 and GL2. The pixel array includes pixels P disposed in the form of a matrix which is defined by the data lines DL1 to DL6 and the gate lines GL1 and GL2.

The gate driver 120 can be mounted on a substrate of the flexible display panel 100 together with the pixel array. The gate driver 120 can be implemented as a gate in panel (GIP) circuit which is directly formed on the flexible display panel 100.

The gate driver 120 can be disposed on one of a left bezel and a right bezel of the flexible display panel 100 to supply gate signals to the gate lines GL1 and GL2 in a single feeding manner. In this case, one of the two gate drivers 120 in FIG. 1 is not necessary.

The gate driver 120 can be disposed on each of the left bezel and the right bezel of the flexible display panel 100 to supply gate signals to the gate lines GL1 and GL2 in a double feeding manner. In the double feeding manner, the gate signals are simultaneously applied at both ends of one gate line.

Figure 7B:
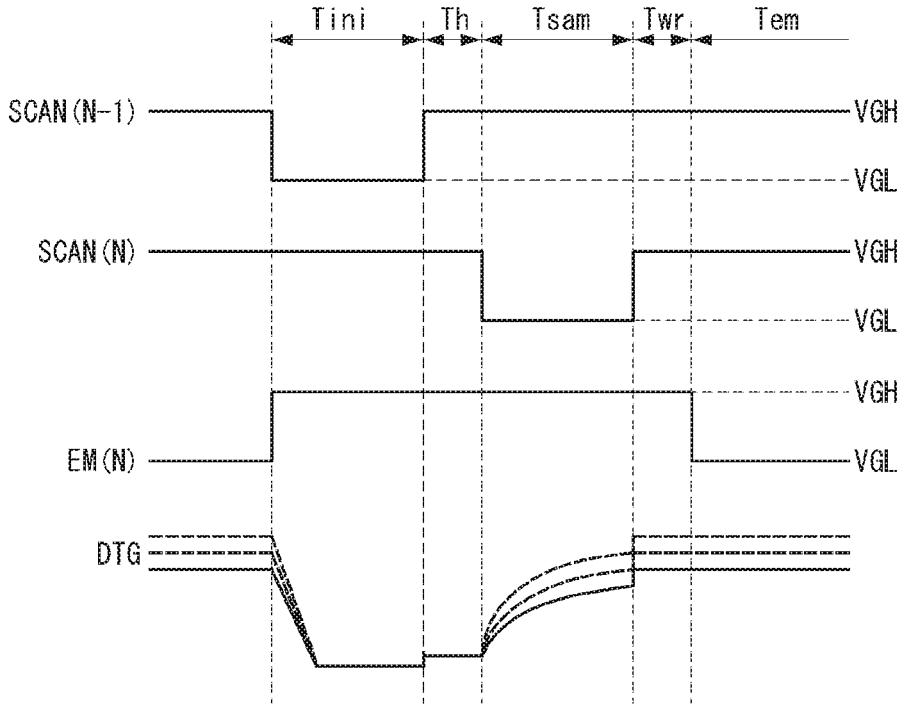
FIG. 7B is a diagram illustrating a method of driving the pixel circuit shown in FIG. 7A.

The gate driver 120 is driven according to a gate timing signal supplied from the drive IC 300 using a shift register to sequentially supply gate signals GATE1 and GATE2 to the gate lines GL1 and GL2. The shift register can sequentially supply the gate signals GATE1 and GATE2 to the gate lines GL1 and GL2 by shifting the gate signals GATE1 and GATE2. The gate signals GATE1 and GATE2 can include scan signals SCAN(N−1) and SCAN(N), a light emission control signal EM(N), and the like which are shown in FIGS. 7A and 7B. Hereinafter, the "light emission control signal" is referred to as an EM signal.

The drive IC 300 is connected to the data lines DL1 to DL6 through data output channels to supply the voltage of the data signal to the data lines DL1 to DL6. The drive IC 300 can output gate timing signals for controlling the gate drivers 120 through the gate timing signal output channels.

The drive IC 300 is connected to the host system 200, a first memory 301, and the flexible display panel 100. As shown in FIG. 6, the drive IC 300 includes a data receiving and calculating part 308, the timing controller 303, and the data driver 306.

The drive IC 300 can further include a gamma compensation voltage generator 305, a power supply 304, a second memory 302, and a level shifter 307.

The drive IC 300 may generate the gate timing signals for driving the gate driver 120 through the timing controller 303 and the level shifter 307. The gate timing signal includes gate timing signals such as a gate start pulse VST and a gate shift clock CLK, and gate voltages such as a gate-on voltage VGL and a gate-off voltage VGH. The gate start pulse VST and the gate shift clock CLK swing between the gate-on voltage VGL and the gate-off voltage VGH. The timing controller 303 generates the gate timing signal of a digital voltage level. The level shifter 307 receives the gate timing signal from the timing controller 308 and converts the voltage level to a voltage swinging between the gate on voltage VGL and the gate off voltage VGH. The gate timing control signal (VST, CLK) output from the level shifter 307 is applied to the gate driver 120 to control the shift operation of the gate driver 120. GVST and GCLK shown in FIG. 6 are gate timing control signals applied to the first shift register 120G shown in FIG. 11. EVST and ECLK illustrated in FIG. 6 are gate timing control signals applied to the second shift register 120E illustrated in FIG. 11.

The data receiving and calculating part 308 includes a receiver RX for receiving pixel data which is input as a digital signal from the host system 200, and a data calculator for processing the pixel data input through the receiver RX to improve image quality. The data calculator can include a data restoration part for decoding and restoring compressed pixel data and an optical compensator for adding a predetermined optical compensation value to the pixel data. The optical compensation value can be set to a value for correcting brightness of the pixel data on the basis of brightness of the screen measured based on a camera image which is captured in a manufacturing process.

The timing controller 303 provides the data driver 306 with pixel data of an input image received from the host system 200. The timing controller 303 generates a gate timing signal for controlling the gate driver 120 and a source timing signal for controlling the data driver 306 to control operation timings of the gate driver 120 and the data driver 306.

The timing controller 303 can generate a frequency detection signal FREQ. The frequency detection signal FREQ indicates a gate driving frequency of the deactivated screen. The frequency detection signal FREQ can indicate a frame frequency of an input image signal. The timing controller 303 can determine a folded state or an unfolded state of the foldable display in response to the enable signal EN and reduce a gate driving frequency of the deactivated screen in the folded state of the foldable display, thereby minimizing power consumption of the gate driver 120.

The timing controller 303 can determine the frame frequency by counting the frame frequency and the timing signal input from the host system 200 in synchronization with the input image signal.

The data driver 306 converts the pixel data (a digital signal) received from the timing controller 303 into a gamma compensation voltage through a digital-to-analog converter (DAC) to provide voltages of data signals DATA1 to DATA6 (hereinafter referred to as "data voltages"). The data voltages output from the data driver 306 are supplied to the data lines DL1 to DL6 of the pixel array through an output buffer (a source amplifier (AMP)) connected to data channels of the drive IC 300.

The gamma compensation voltage generator 305 distributes a gamma reference voltage from the power supply 304 through a voltage divider circuit to generate a gamma compensation voltage for each gradation. The gamma compensation voltage is an analog voltage in which a voltage is set for each gradation of the pixel data. The gamma compensation voltage output from the gamma compensation voltage generator 305 is provided to the data driver 306.

The level shifter 307 converts a low level voltage of the gate timing signal received from the timing controller 303 into the gate-on voltage VGL and converts a high level voltage of the gate timing signal into the gate-off voltage VGH. The level shifter 307 outputs the gate-off voltage VGH and the gate-on voltages VGL through the gate timing signal output channels and supplies the gate timing signal VGH and the gate voltages VGL to the gate driver 120.

The power supply 304 generates power required for driving the pixel array, the gate driver 120, and the drive IC 300 of the flexible display panel 100 using a DC-DC (direct current to direct current) converter. The DC-DC converter can include a charge pump, a regulator, a buck converter, and a boost converter. The power supply 304 can adjust a DC input voltage from the host system 200 to generate DC power such as a gamma reference voltage, the gate-on voltage VGL, the gate-off voltage VGH, a pixel driving voltage ELVDD, a low potential power voltage ELVSS, and an initialization voltage Vini. The gamma reference voltage is supplied to the gamma compensation voltage generator 305. The gate-on voltage VGL and the gate-off voltage VGH are supplied to the level shifter 307 and the gate driver 120. Pixel power, such as the pixel driving voltage ELVDD, the low potential power voltage ELVSS, and the initialization voltage Vini, are commonly supplied to the pixels P.

The gate voltages can be set to VGH=8 V and VGL=−7 V, and the pixel power can be set to ELVDD=4.6 V, ELVSS=−2 to −3 V, and Vini=−3 to −4 V, but the present disclosure is not limited thereto. A data voltage Vdata can be set to Vdata=3 to 6 V, but the present disclosure is not limited thereto.

Vini is set to a DC voltage that is lower than the ELVDD and a threshold voltage of a light emitting element OLED to suppress light emission of the light emitting element OLED. Vini can be continuously applied to an anode of the light emitting element OLED for one frame interval or more in a deactivated pixel. The light emitting element OLED is initialized when Vini is applied to the anode.

When the flexible display panel 100 is folded, the power supply 304 prevents brightness fluctuation of the pixels by varying at least one of ELVSS and Vini according to the frame frequency of the deactivated screen in response to the enable signal EN and the frequency detection signal FREQ. The enable signal EN can be generated from the host system 200. The frequency detection signal FREQ can be generated from the timing controller 303 or generated from a frequency detection circuit in the power supply 304.

In the folded state and the unfolded state of the foldable display, sizes of activated screens are different from each other. The size of the activated screen in the folded state is small, and thus a voltage drop of ELVDD (IR drop) of the flexible display panel 100 is smaller than the voltage drop of ELVDD in the unfolded state. Consequently, brightness of the pixels can be increased when the foldable display is folded. In order to solve the above problem, the power supply 304 can prevent the brightness fluctuation of the pixels by differently setting Vini in the folded state and the unfolded state of the foldable display.

When power is supplied to the drive IC 300, the second memory 302 stores a compensation value, register setting data, and the like which are received from the first memory 301. The compensation value can be applied to various algorithms for improving image quality. The compensation value can include an optical compensation value.

The register setting data defines operations of the data driver 306, the timing controller 303, and the gamma compensation voltage generator 305. The first memory 301 can include a flash memory. The second memory 302 can include a static random access memory (SRAM).

The host system 200 can be implemented as an application processor (AP). The host system 200 can transmit pixel data of an input image to the drive IC 300 through a mobile industry processor interface (MIPI). The host system 200 can be connected to the drive IC 300 through a flexible printed circuit, for example, a flexible printed circuit (FPC) 310.

The host system 200 can output an enable signal EN for controlling driving of the drive IC 300 according to whether the flexible display panel 100 is folded. The enable signal EN can include information on whether the flexible display panel 100 is folded and information indicating a folding angle.

Figure 38:
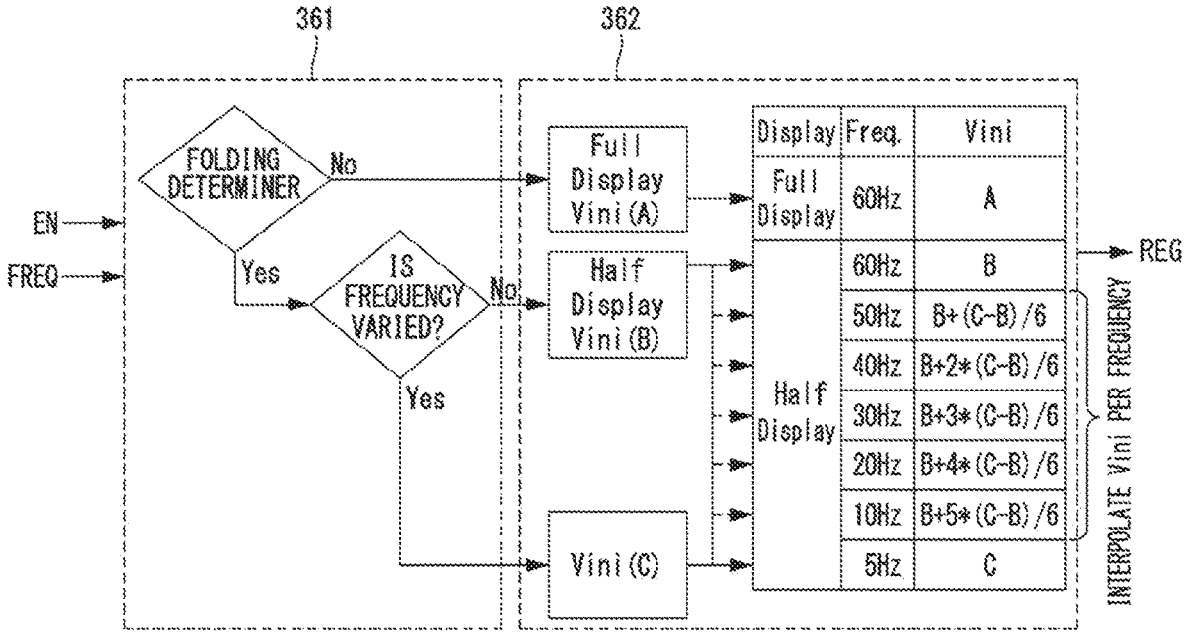
Figure 39:
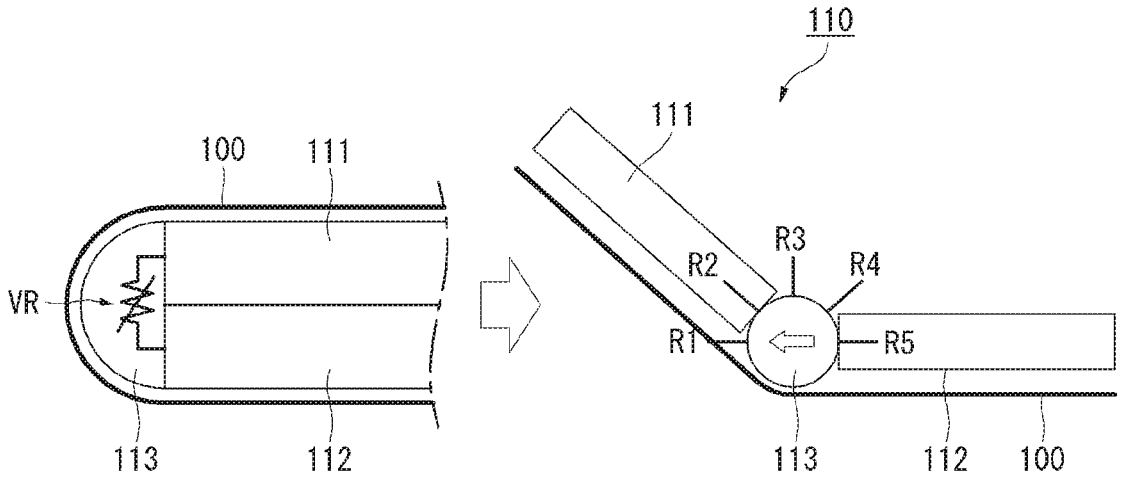
FIGS. 39 and 40 are diagrams illustrating a sensing device for sensing whether a foldable display is folded and sensing a folding angle according to one or more embodiments of the present disclosure.
Figure 39:
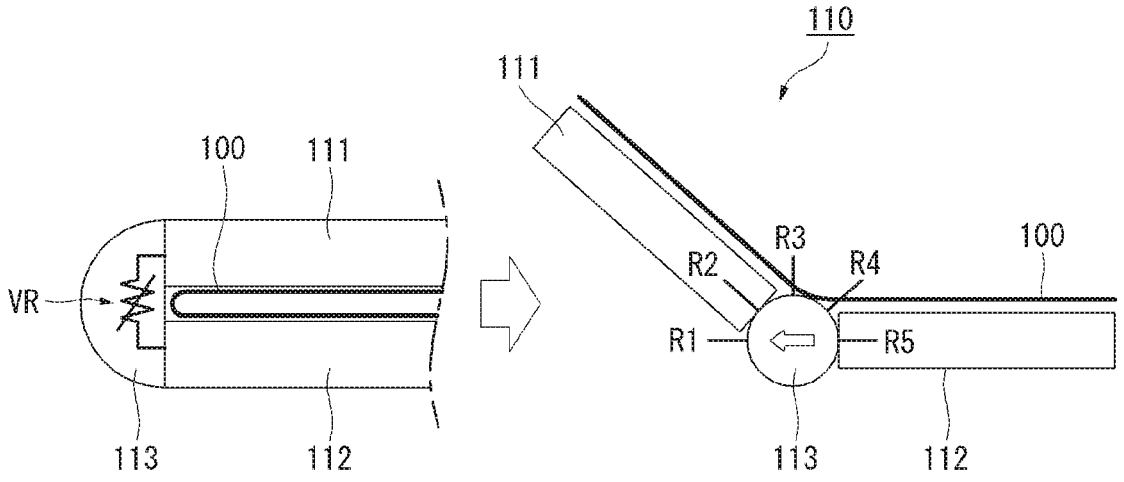

The host system 200 can be connected to various sensors to control the screens L, A, and R in response to sensor signals. The host system 200 can detect a folding angle of the flexible display panel 100. For example, as shown in FIGS. 38 and 39, the host system 200 can sense a folding angle of the flexible display panel 100 in real time using a folding angle sensing device 201.

The host system 200 can detect an attitude variation of the foldable display using a tilt sensor. In response to an output signal of the tilt sensor, the host system 200 can control the drive IC 300 to control each of the first screen L and the second screen R to be turned ON/OFF. The tile sensor can include a gyro sensor or an acceleration sensor. The host system 200 can transmit tilt information of the foldable display panel to the drive IC 300. In response to an output signal of the acceleration sensor, the host system 200 can control the drive IC 300.

When the user folds the foldable display and looks at the first screen L, under the control of the host system 200, the drive IC 300 activates the first screen L to display an image on the first screen L, whereas the drive IC 300 deactivates the second screen R at a side opposite the first screen L to control the second screen R as a deactivated screen displaying a black gray scale. On the other hand, when the user folds the foldable display and looks at the second screen R, under the control of the host system 200, the drive IC 300 activates the second screen R to display an image on the second screen R, whereas the drive IC 300 controls the first screen L as a deactivated screen displaying a black gray scale. When the user unfolds the foldable display and looks at the first screen L and the second screen R, under the control of the host system 200, the drive IC 300 activates the first screen L, the folding boundary A, and the second screen R to display an image on all the screens L, A, and R.

FIG. 7A is a circuit diagram illustrating an example of a pixel circuit. FIG. 7B is a diagram illustrating a method of driving the pixel circuit shown in FIG. 7A.

Referring to FIGS. 7A and 7B, the pixel circuit includes the light emitting element OLED, a drive element DT which supplies a current to the light emitting element OLED, and an internal compensation circuit for sampling a threshold voltage Vth of the drive element DT using a plurality of switching elements M1 to M6 to compensate for a gate voltage of the drive element DT by as much as the threshold voltage Vth of the drive element DT. Each of the drive element DT and the switching elements M1 to M6 can be implemented as a p-channel transistor.

A driving time of each of the pixels using the internal compensation circuit is divided into an initialization time Tini, a sampling time Tsam, a data write time Twr, and a light emission time Tem. During the initialization time Tini, the (N−1)th scan signal is generated as a pulse of the gate-on voltage VGL, and a voltage of each of the Nth scan signal SCAN(N) and the light emission control signal EM(N) is generated as the gate-off voltage VGH. During the sampling time Tsam, the Nth scan signal SCAN(N) is generated as the pulse of the gate-on voltage VGL, and a voltage of each of the (N−1)th scan signal SCAN(N−1) and the light emission control signal EM(N) is generated as the gate-off voltage VGH. During the data write time Twr, a voltage of each of the (N−1)th scan signal SCAN(N−1), the Nth scan signal SCAN(N), and the light emission control signal EM(N) is generated as the gate-off voltage VGH. During at least some time of the light emission time Tem, the light emission control signal EM(N) is generated as the gate-on voltage, and the voltage of each of the (N−1)th scan signal SCAN (N−1) and the Nth scan signal SCAN(N) is generated as the gate-off voltage VGH.

During the initialization time Tini, the fifth and sixth switching elements M5 and M6 are turned on according to a gate-on voltage VGL of an (N−1)th scan signal SCAN (N−1) to initialize the pixel circuit. During the sampling time Tsam, the first and second switching elements M1 and M2 are turned on according to a gate-on voltage VGL of an Nth scan signal SCAN(N) to sample the threshold voltage Vth of the drive element DT and store the sampled threshold voltage Vth in a capacitor Cst. During the data write time Twr, the first to sixth switching elements M1 to M6 are maintained in an OFF state. During the light emission time Tem in which third and fourth switching elements M3 and M4 are turned on such that the light emitting element OLED emits light. In the light emission time Tem, in order to precisely express brightness of a low gradation with a duty ratio of the EM signal EM(N), the EM signal EM(N) may swing between the gate-on voltage VGL and the gate-off voltage VGH at a predetermined duty ratio to repeat turning ON/OFF of the third and fourth switching elements M3 and M4.

The light emitting element OLED can be implemented as an organic light emitting diode or an inorganic light emitting diode. Hereinafter, an example in which the light emitting element OLED is implemented as an organic light emitting diode will be described.

The light emitting element OLED can be implemented as an organic compound layer formed between an anode and a cathode as an OLED. The organic compound layer can include a hole injection layer (HIL), a hole transport layer (HTL), a light emitting layer (EML), an electron transport layer (ETL), and an electron injection layer (EIL), but the present disclosure is not limited thereto. The anode of the light emitting element OLED is connected to a fourth node n4 between the fourth and sixth switching elements M4 and M6. The fourth node n4 is connected to the anode of the light emitting element OLED, a second electrode of the fourth switching element M4, and a second electrode of the sixth switching element M6. The cathode of the light emitting element OLED is connected to a VSS electrode 106 to which the low potential power voltage ELVSS is applied. The light emitting element OLED emits light due to a current Ids flowing according to a gate-source voltage Vgs of the drive element DT. A current path of the light emitting element OLED is switched by the third and fourth switching elements M3 and M4.

The storage capacitor Cst is disposed between and connected to a VDD line 104 and a second node n2. The data voltage Vdata compensated for by as much as the threshold voltage Vth of the drive element DT is charged in the storage capacitor Cst. Since the data voltage Vdata in each sub-pixel is compensated for by as much as the threshold voltage Vth of the drive element DT, a characteristic deviation of the drive element DT in each sub-pixel is compensated for.

The first switching element M1 is turned on in response to the gate-on voltage VGL of the $N^{th}$ scan signal SCAN(N) to connect a second node n2 to a third node n3. The second node n2 is connected to a gate of the drive element DT, a first electrode of the storage capacitor Cst, and a first electrode of the first switching element M1. The third node n3 is connected to a second electrode of the drive element DT, a second electrode of the first switching element M1, and a first electrode of the fourth switch element M4. A gate of the first switching element M1 is connected to a first gate line 31 to receive the $N^{th}$ scan signal SCAN(N). The first electrode of the first switching element M1 is connected to the second node n2, and the second electrode thereof is connected to the third node n3.

The second switching element M2 is turned on in response to the gate-on voltage VGL of the $N^{th}$ scan signal SCAN(N) to supply the data voltage Vdata to the first node n1. A gate of the second switching element M2 is connected to the first gate line 31 to receive the $N^{th}$ scan signal SCAN(N). A first electrode of the second switching element M2 is connected to the first node n1. A second electrode of the second switching element M2 is connected to a data line 102 to which the data voltage Vdata is applied. The first node n1 is connected to the first electrode of the second switching element M2, a second electrode of the third switching element M3, and a first electrode of the drive element DT.

The third switching element M3 is turned on in response to a gate-on voltage VGL of the EM signal EM(N) to connect the VDD line 104 to the first node n1. A gate of the third switching element M3 is connected to a third gate line 33 to receive the EM signal EM(N). A first electrode of the third switching element M3 is connected to the VDD line 104. The second electrode of the third switching element M3 is connected to the first node n1.

The fourth switching element M4 is turned on in response to the gate-on voltage VGL of the EM signal EM(N) to connect the third node n3 to the anode of the light emitting element OLED. A gate of the fourth switching element M4 is connected to the third gate line 33 to receive the EM signal EM(N). The first electrode of the fourth switching element M4 is connected to the third node n3, and the second electrode thereof is connected to the fourth node n4.

The EM signal EM(N) controls the third and fourth switching elements M3 and M4 to be turned ON/OFF to switch the current path of the light emitting element OLED, thereby controlling a turning on/off time of the light emitting element OLED.

The fifth switching element M5 is turned on in response to a gate-on voltage VGL of the $(N-1)^{th}$ scan signal SCAN (N−1) to connect the second node n2 to a Vini line 105. A gate of the fifth switching element M5 is connected to a second-a gate line 32*a* to receive the (N−1)th scan signal SCAN(N−1). A first electrode of the fifth switching element M5 is connected to the second node n2, and a second electrode thereof is connected to the Vini line 105.

The sixth switching element M6 is turned on in response to the gate-on voltage VGL of the (N−1)th scan signal SCAN(N−1) to connect the Vini line 105 to the fourth node n4. A gate of the sixth switching element M6 is connected to a second-b gate line 32*b* to receive the $(N-1)^{th}$ scan signal SCAN(N−1). A first electrode of the sixth switching element M6 is connected to the Vini line 105, and a second electrode thereof is connected to the fourth node n4.

The drive element DT controls the current Ids flowing in the light emitting element OLED according to the gate-source voltage Vgs, thereby driving the light emitting element OLED. The drive element DT includes the gate connected to the second node n2, the first electrode connected to the first node n1, and the second electrode connected to the third node n3.

During the initialization time Tini, the $(N-1)^{th}$ scan signal SCAN(N−1) is generated as the gate-on voltage VGL. During the initialization time Tini, the $N^{th}$ scan signal SCAN(N) and the EM signal EM(N) are maintained as the gate-off voltage VGH. Thus, during the initialization time Tini, the fifth and sixth switching elements M5 and M6 are turned on so that the second and fourth nodes n2 and n4 are initialized at Vini. A hold time Th can be set between the initialization time Tini and the sampling time Tsam. During the hold time Th, a voltage level of the gate signals SCAN (N−1), SCAN(N), and EM(N) are the gate-off voltage VGH.

During the sampling time Tsam, the $N^{th}$ scan signal SCAN(N) is generated as the gate-on voltage VGL. A pulse of the $N^{th}$ scan signal SCAN(N) is synchronized with a data voltage Vdata of an $N^{th}$ pixel line. During the sampling time Tsam, the $(N-1)^{th}$ scan signal SCAN(N−1) and the EM signal EM(N) are maintained as the gate-off voltage VGH. Therefore, during the sampling time Tsam, the first and second switching elements M1 and M2 are turned on.

During the sampling time Tsam, a gate voltage DTG of the drive element DT rises due to a current flowing through the first and second switching elements M1 and M2. Since the drive element DT is turned off when the drive element DT is turned off, the gate node voltage DTG is Vdata−|Vth|. In this case, a voltage of the first node n1 is also Vdata−|Vth|. During the sampling time Tsam, the gate-source voltage Vgs of the drive element DT satisfies |Vgs|=Vdata−(Vdata−|Vth|)=|Vth|.

During the data write time Twr, the $N^{th}$ scan signal SCAN(N) is inverted to the gate-off voltage VGH. During the data write time Twr, the $(N-1)^{th}$ scan signal SCAN(N−1) and the EM signal EM(N) are maintained as the gate-off voltage VGH. Therefore, during the data write time Twr, all the switching elements M1 to M6 remain in an off state.

During the light emission time Tem, the EM signal EM(N) can be generated at the gate-off voltage VGH. During the light emission time Tem, in order to improve a low gradation expression, the EM signal EM(N) can be turned on or off at a predetermined duty ratio to swing between the gate-on voltage VGL and the gate-off voltage VGH. Accordingly, the EM signal EM(N) can be generated at the gate-on voltage VGL for at least a part of the light emission time Tem.

When the EM signal EM(N) is the gate-on voltage VGL, a current flows between an ELVDD and the light emitting element OLED so that the light emitting element OLED can emit light. During the light emission time Tem, the $(N-1)^{th}$ and $N^{th}$ scan signals SCAN(N−1) and SCAN(N) are maintained as the gate-off voltage VGH. During the light emission time Tem, the third and fourth switching elements M3 and M4 are repeatedly turned on and off according to a voltage of the EM signal EM(N). When the EM signal EM(N) is the gate-on voltage VGL, the third and fourth switching elements M3 and M4 are turned on so that a current flows in the light emitting element OLED. In this case, Vgs of the drive element DT satisfies |Vgs|=ELVDD−(Vdata−|Vth|), and the current flowing in the light emitting element OLED is $K(ELVDD-Vdata)^2$. K is a proportional constant determined by charge mobility, parasitic capacitance, and a channel capacity of the drive element DT.

Figure 18:
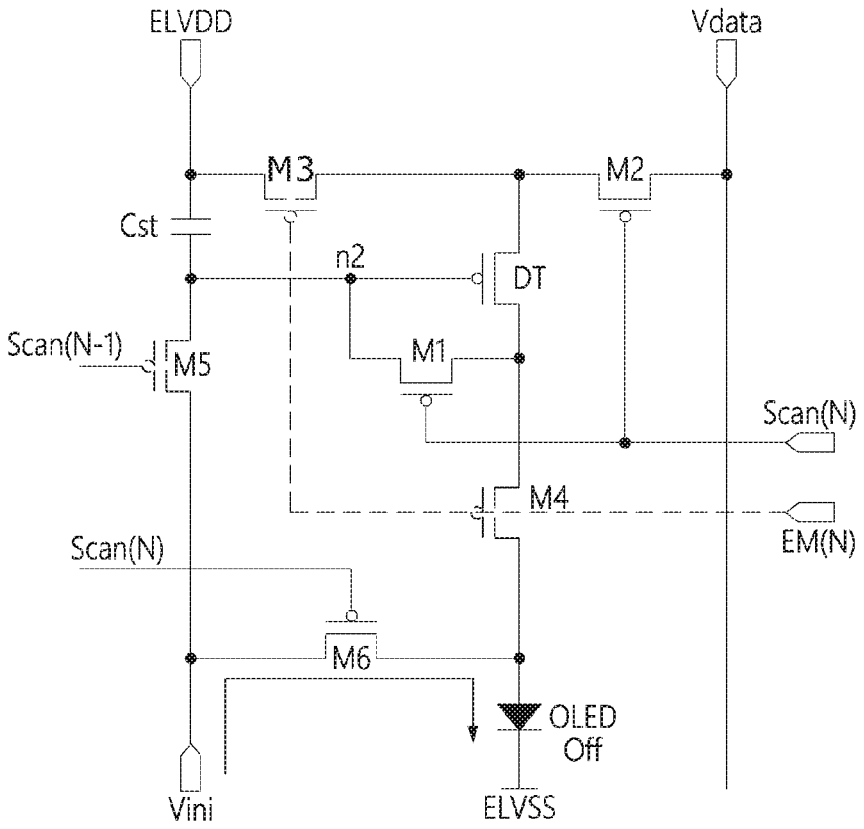
FIG. 18 is a circuit diagram illustrating an operation of a pixel in a deactivated screen according to one or more embodiments of the present disclosure.

The gates of the fifth and sixth switching elements M5 and M6 can be connected to the different gate lines 32*a* and 32*b*. As shown in FIGS. 7A and 18, a control signal of the sixth switch element M6 can be different in the activated screen from the deactivated screen. As shown in FIG. 7A, in the activated screen, the $(N-1)^{th}$ scan signal SCAN(N−1) is applied to the gate of the sixth switching element M6. As shown in FIG. 18, in the deactivated screen, the $N^{th}$ scan signal SCAN(N) is applied to the gate of the sixth switching element M6.

In the pixels of the activated screen, the $(N-1)^{th}$ scan signal SCAN(N−1) is applied to the gates of the fifth and sixth switching elements M5 and M6. On the other hand, as shown in FIG. 18, in the deactivated screen, the $(N-1)^{th}$ scan signal SCAN(N−1) is applied to the gate of the fifth switch element M5 and then the $N^{th}$ scan signal SCAN(N) is applied to the sixth switch element M6.

In the deactivated screen, in response to the $N^{th}$ scan signal SCAN(N), the sixth switching element M6 reduces an anode voltage of the light emitting element OLED to Vini, thereby suppressing light emission of the light emitting element OLED. Consequently, the pixels of the deactivated screen maintain brightness of a black gray scale due to not emitting light. According to the present disclosure, brightness of the deactivated screen can be controlled to the brightness of the black gray scale only by turning the sixth switch element M6 on during the sampling time Tsam and applying Vini to the anode of the light emitting element OLED. In this case, as shown in FIG. 18, in order to block an influence of other nodes connected to the anode of the light emitting element OLED, it is preferable that the third switching element M3 and the fourth switching element M4 are turned off.

Figure 8:
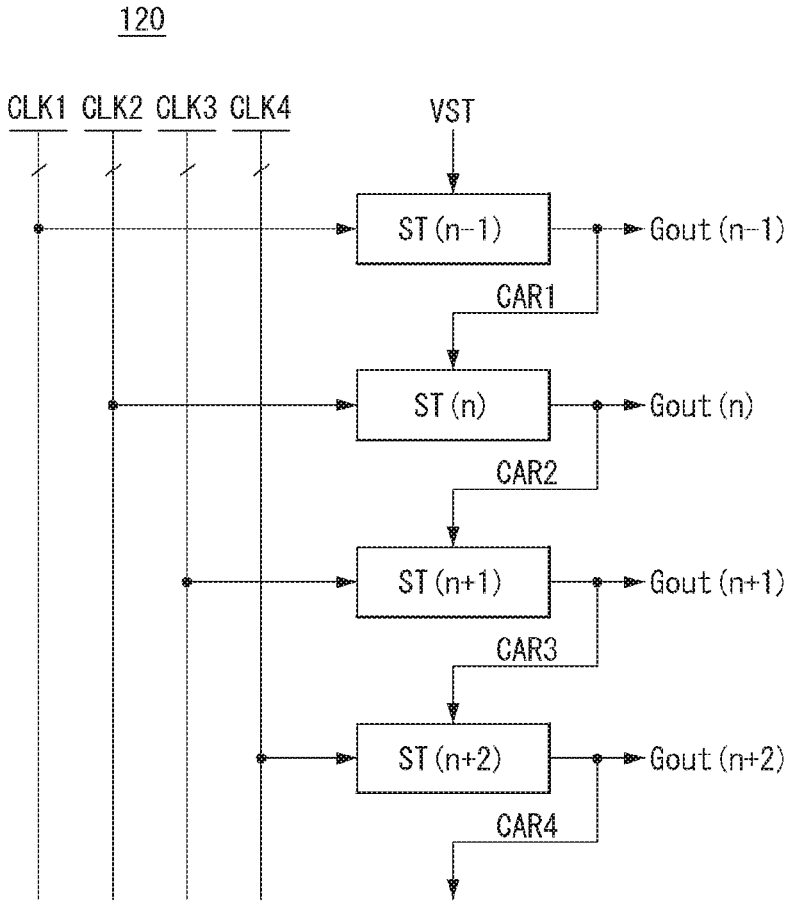
FIG. 8 is a schematic diagram illustrating a circuit configuration of a shift register in a gate driver according to one or more embodiments of the present disclosure.
Figure 9A:
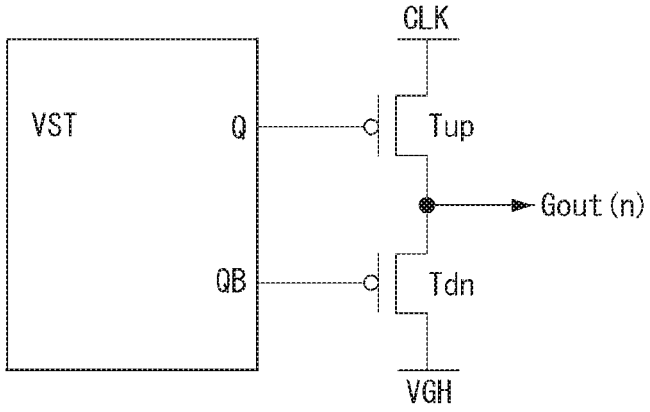
FIGS. 9A and 9B are schematic diagrams illustrating a pass gate circuit and an edge trigger circuit according to one or more embodiments of the present disclosure.
Figure 9B:
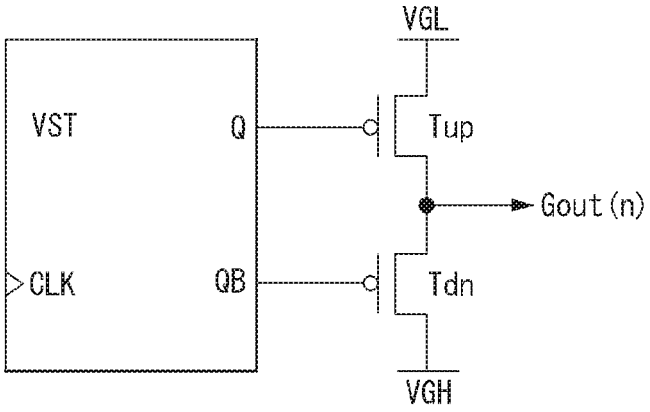

FIG. 8 is a schematic diagram illustrating a circuit configuration of a shift register in the gate driver 120. FIGS. 9A and 9B are schematic diagrams illustrating a pass-gate circuit and an edge trigger circuit.

Referring to FIG. 8, the shift register of the gate driver 120 includes stages ST(n−1) to ST(n+2) which are connected in cascade. The shift register receives the gate start pulse VST or carry signals CAR1 to CAR4 received from previous stages as the gate start pulse VST and generates output signals Gout(n−1) to Gout(n+2) in synchronization with rising edges of gate shift clocks CLK1 to CLK4. The output signals of the shift register include the gate signals SCAN(N−1), SCAN(N), and EM(N).

Each of the stages ST(n−1) to ST(n+2) of the shift register can be implemented as a pass-gate circuit as shown in FIG. 9A or an edge trigger circuit as shown in FIG. 9B.

Figure 10:
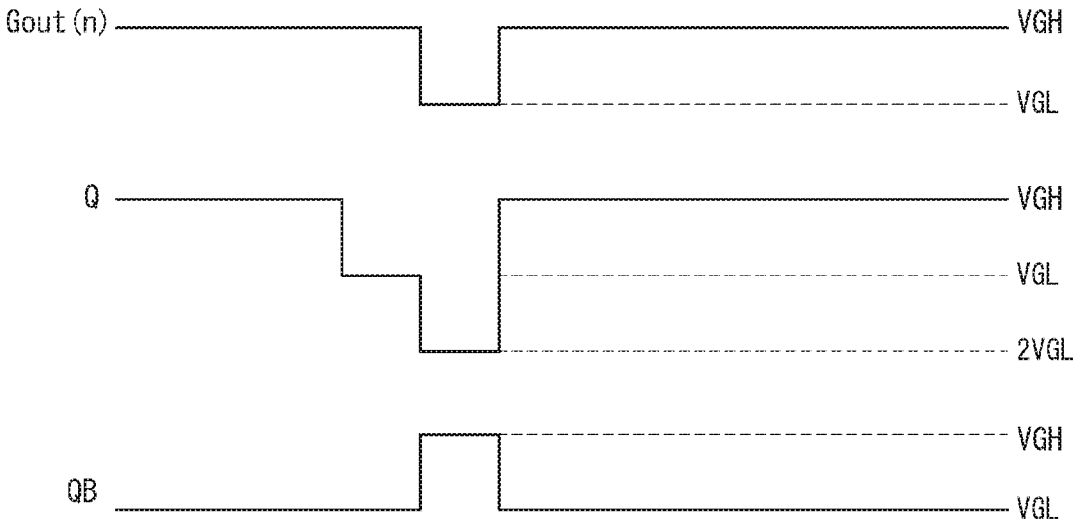
FIG. 10 is a waveform diagram showing a Q node voltage, a QB node voltage, and an output voltage of an nth stage shown in FIG. 8.

In the pass gate circuit, a clock CLK is input to a pull-up transistor Tup which is turned on or off according to a voltage of a node Q. Meanwhile, the gate-on voltage VGL is supplied to a pull-up transistor Tup of the edge trigger circuit, and the gate start pulse VST and the gate shift clocks CLK1 to CLK4 are input to the edge trigger circuit. A pull-down transistor Tdn is turned on or off according to a voltage of a node QB. In the pass-gate circuit, the node Q is floated according to a start signal in a pre-charged state. When the clock CLK is applied to the pull-up transistor Tup in a state in which the node Q is floated, the voltage of the node Q is changed to a voltage 2VGL that is higher than the gate-on voltage VGL shown in FIG. 10 due to bootstrapping so that a voltage of the output signal Gout(n) rises as a pulse of the gate-on voltage VGL.

Since the voltage of the output signal Gout(n) is changed to a voltage of the start signal in synchronization with the edge of the clock CLK, the edge trigger circuit generates the output signal Gout(n) in the same waveform as a phase of the start signal. When a waveform of the start signal is changed, the waveform of the output signal is changed accordingly. In the edge trigger circuit, an input signal can overlap the output signal.

Figure 11:
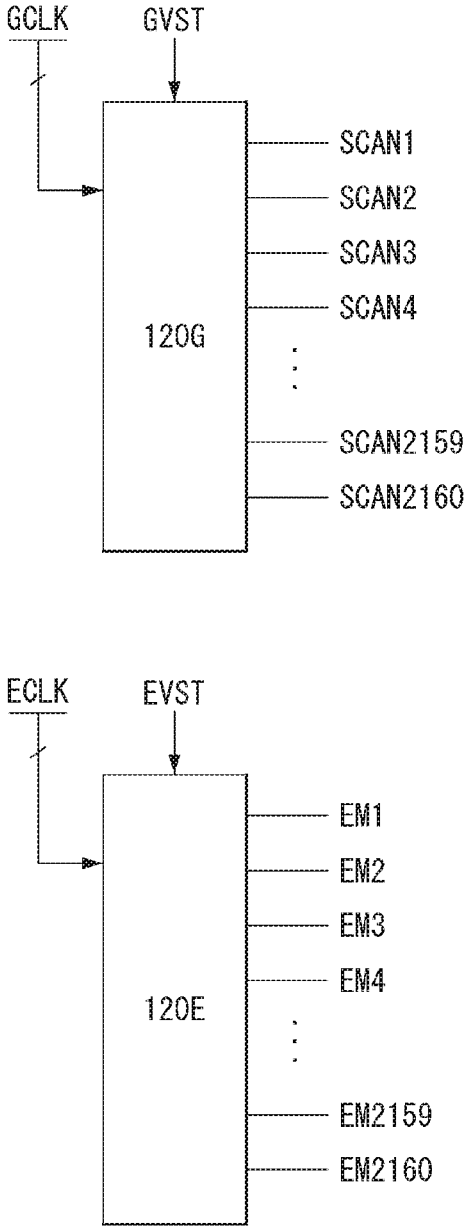
FIG. 11 is a diagram illustrating first and second shift registers of the gate driver according to one or more embodiments of the present disclosure.

FIG. 11 is a diagram illustrating a first shift register and a second shift register of the gate driver 120.

Referring to FIG. 11, the gate driver 120 can include a first shift register 120G and a second shift register 120E. The first shift register 120G can receive a gate start pulse GVST and a gate shift clock GCLK and sequentially output scan signals SCAN1 to SCAN2160. The second shift register 120E can receive a gate start pulse EVST and a gate shift clocks ECLK and sequentially output EM signals EM1 to EM2160.

Figure 12:
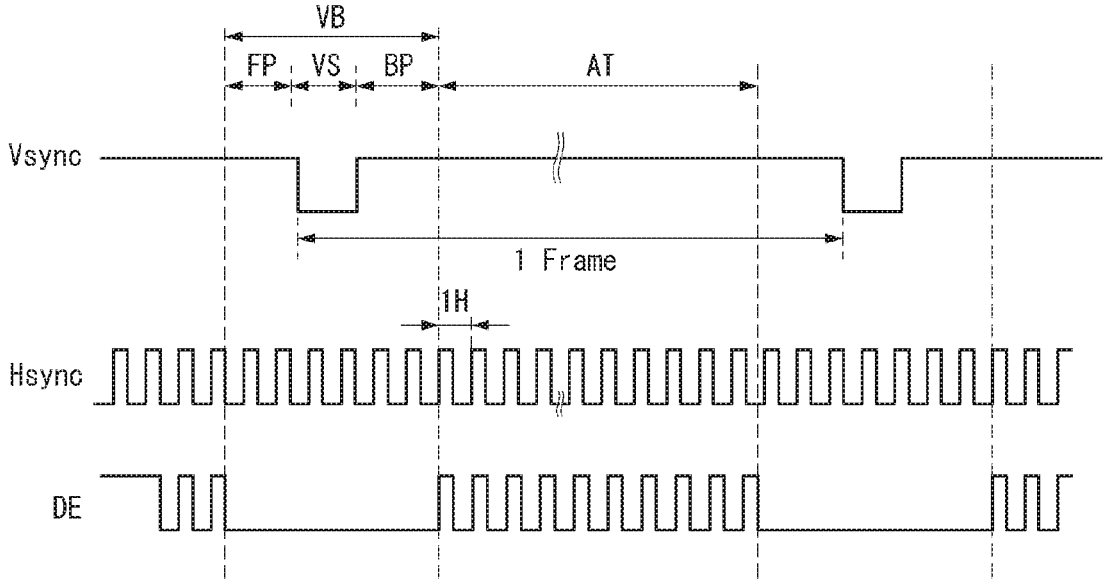
FIG. 12 is a detailed diagram illustrating an active interval and a vertical blank interval of one frame interval according to one or more embodiments of the present disclosure.

FIG. 12 is a detailed diagram illustrating an active interval and a vertical blank interval of one frame interval.

Referring to FIG. 12, one frame interval (one frame) is divided into an active interval AT for which pixel data is input, and a vertical blank interval VB for which pixel data is not present.

During the active interval AT, pixel data of one frame, which will be written in all the pixels P on the screens L, A, and R of the display panel 100, is received by the drive IC 300 and written in the pixels P.

The vertical blank interval VB is a blank interval for which pixel data is not received by a timing controller between an active interval AT of a $(N-1)^{th}$ frame interval (N is a natural number) and an active interval AT of an $N^{th}$ frame interval. The vertical blank interval VB includes a vertical sync time VS, a vertical front porch FP, and a vertical back porch BP.

The vertical blank interval VB is a time from a falling edge of a last pulse in a data enable signal DE received at the $(N-1)^{th}$ frame interval to a rising edge of a first pulse in the data enable signal DE received at the $N^{th}$ frame interval. A start time of the $N^{th}$ frame interval is a rising timing of the first pulse in the data enable signal DE.

A vertical synchronization signal Vsync defines one frame interval. A horizontal synchronization signal Hsync defines one horizontal time. The data enable signal DE defines a valid data interval including pixel data which will be displayed on the screen.

A pulse of the data enable signal DE is synchronized with the pixel data which will be written in the pixels of the display panel 100. One pulse period of the data enable signal DE is one horizontal time 1H.

Figure 13:
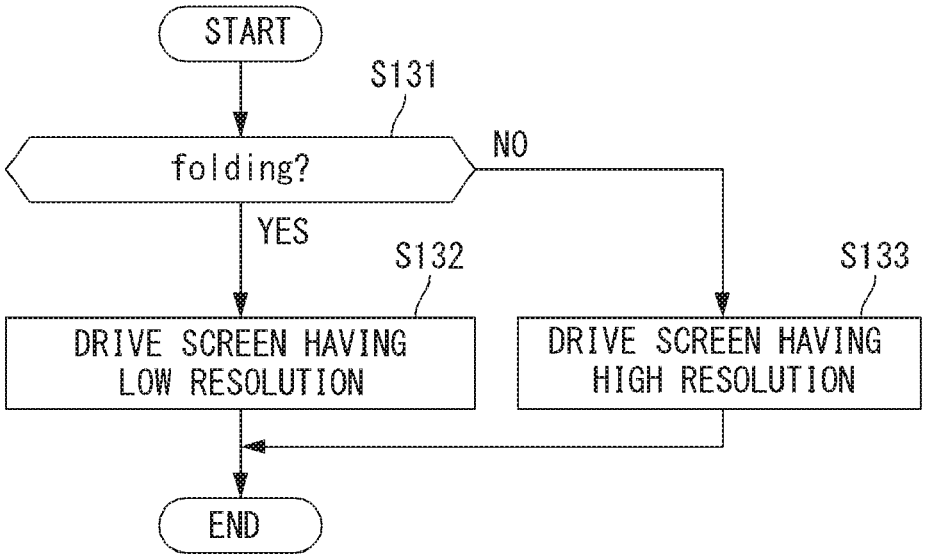
FIGS. 13 to 15 are diagrams illustrating a screen driving method when a foldable display is folded and unfolded according to one or more embodiments of the present disclosure.
Figure 14:
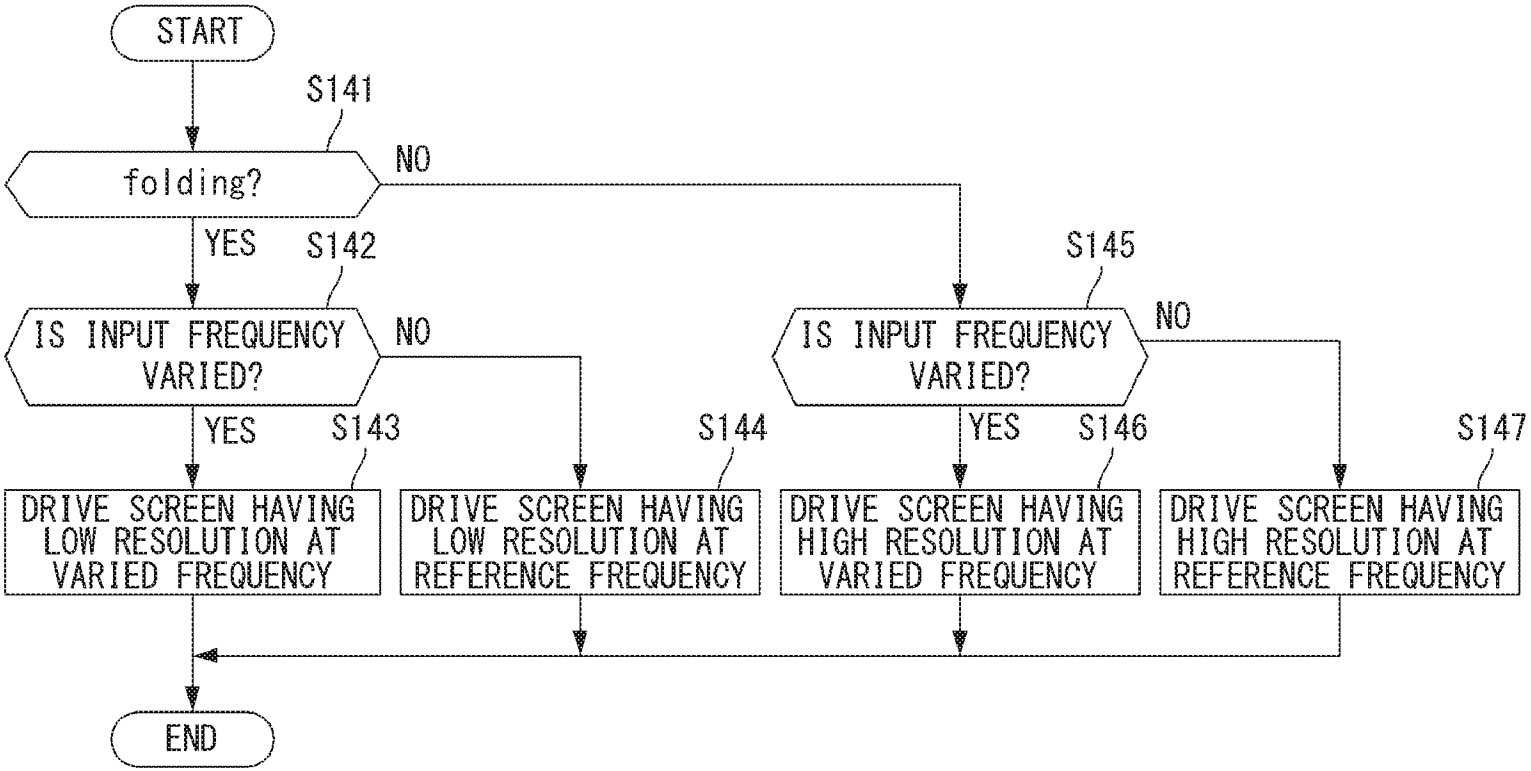
Figure 15:
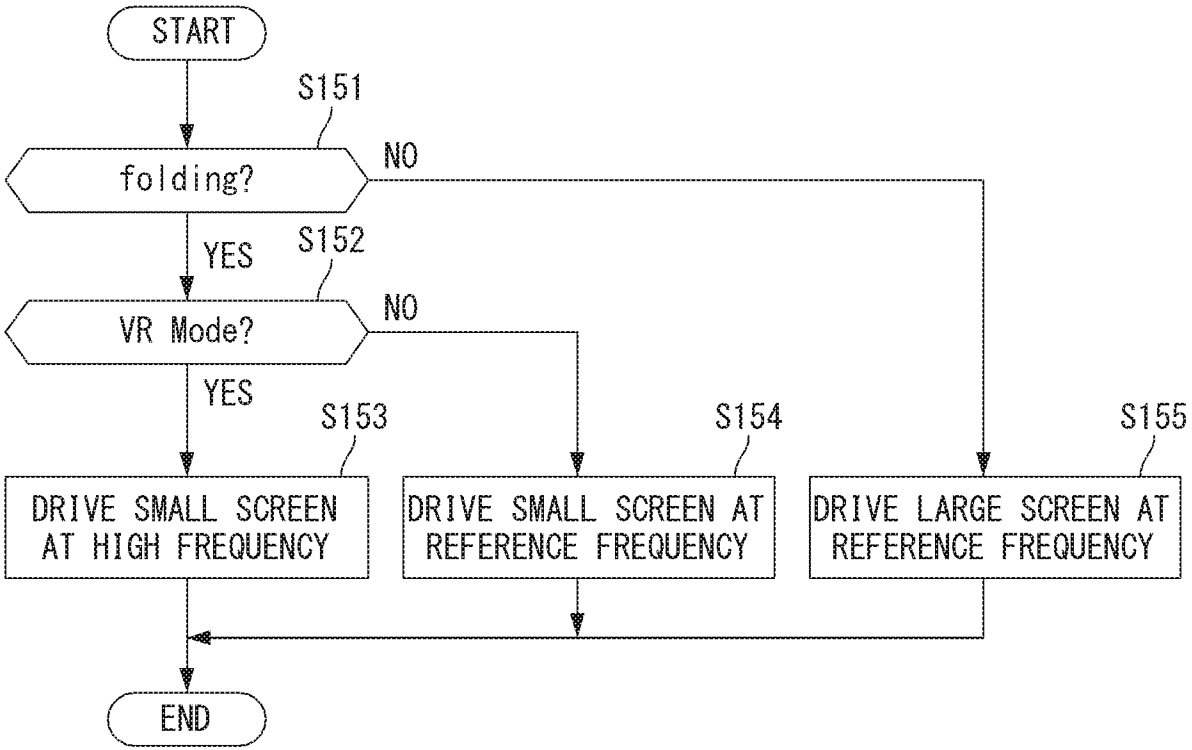

FIGS. 13 to 15 are diagrams illustrating a screen driving method when a foldable display is folded and unfolded.

Figure 16A:
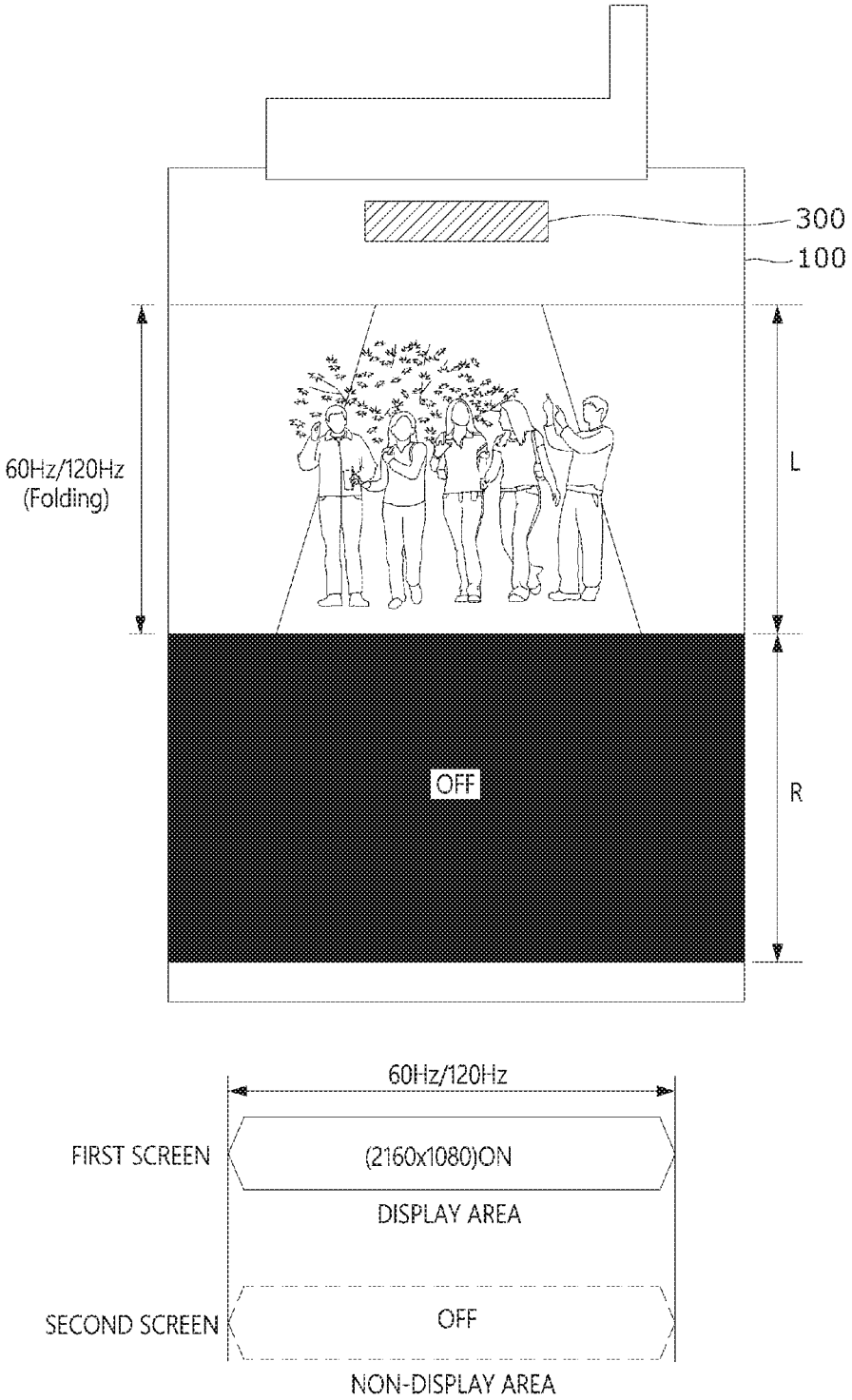
FIGS. 16A and 16B are diagrams illustrating screens in a folded state on the foldable display of the present disclosure.
Figure 16B:
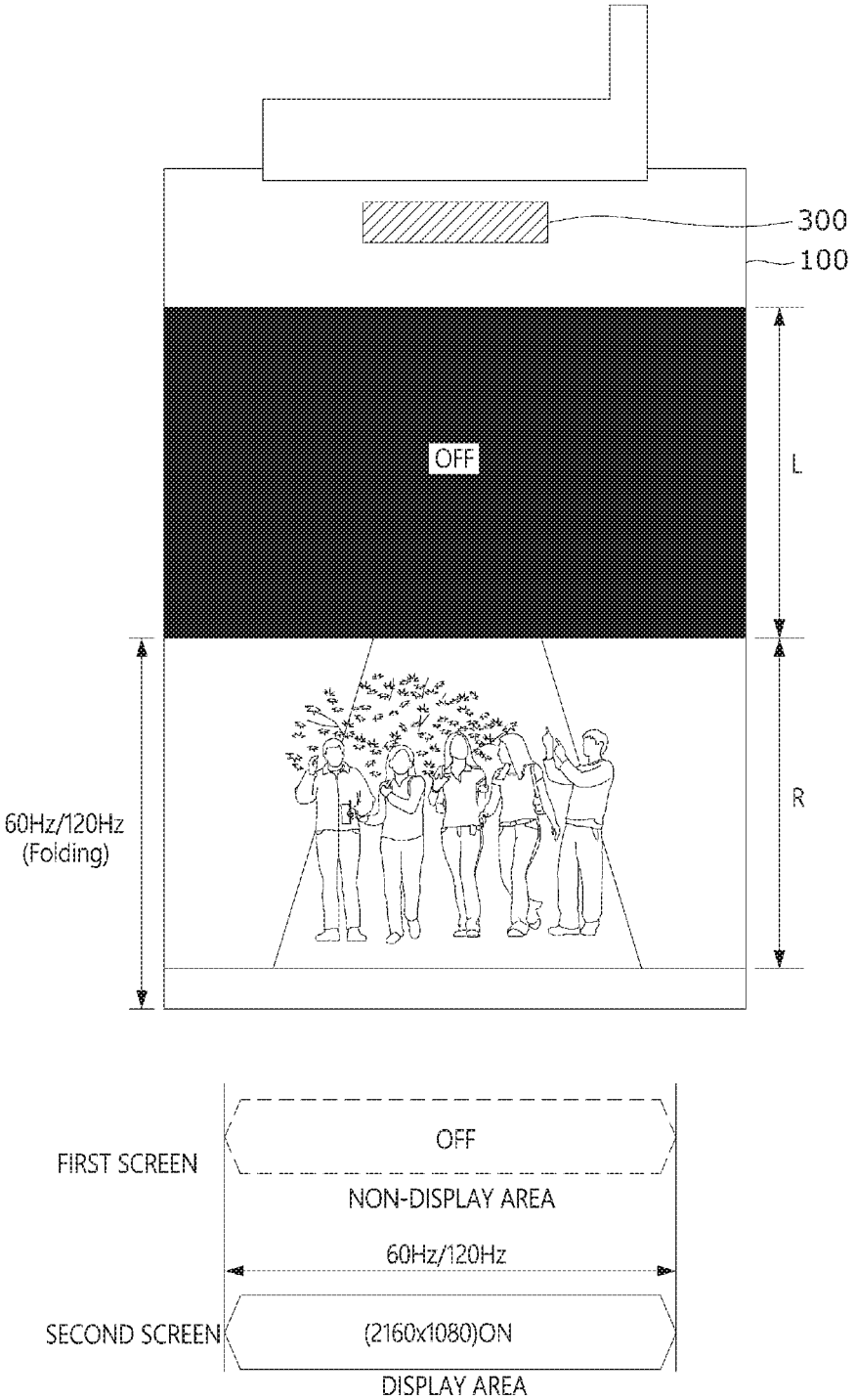

Referring to FIG. 13, when the flexible display panel 100 is folded, the drive IC 300 drives a screen having a low resolution (S131 and S132). As shown in FIGS. 16A and 16B, the screen having the low resolution can be an activated screen having a 2160*1080 resolution. The screen having the low resolution can be an activated screen, at which the user looks, among the first screen L and the second screen R. The screen having a low resolution can be driven at a predetermined reference frequency or at a frequency different from the reference frequency. The reference frequency can be a frame frequency of 60 Hz. The frequency different from the reference frequency can be a frequency that is higher or lower than the reference frequency.

Figure 17:
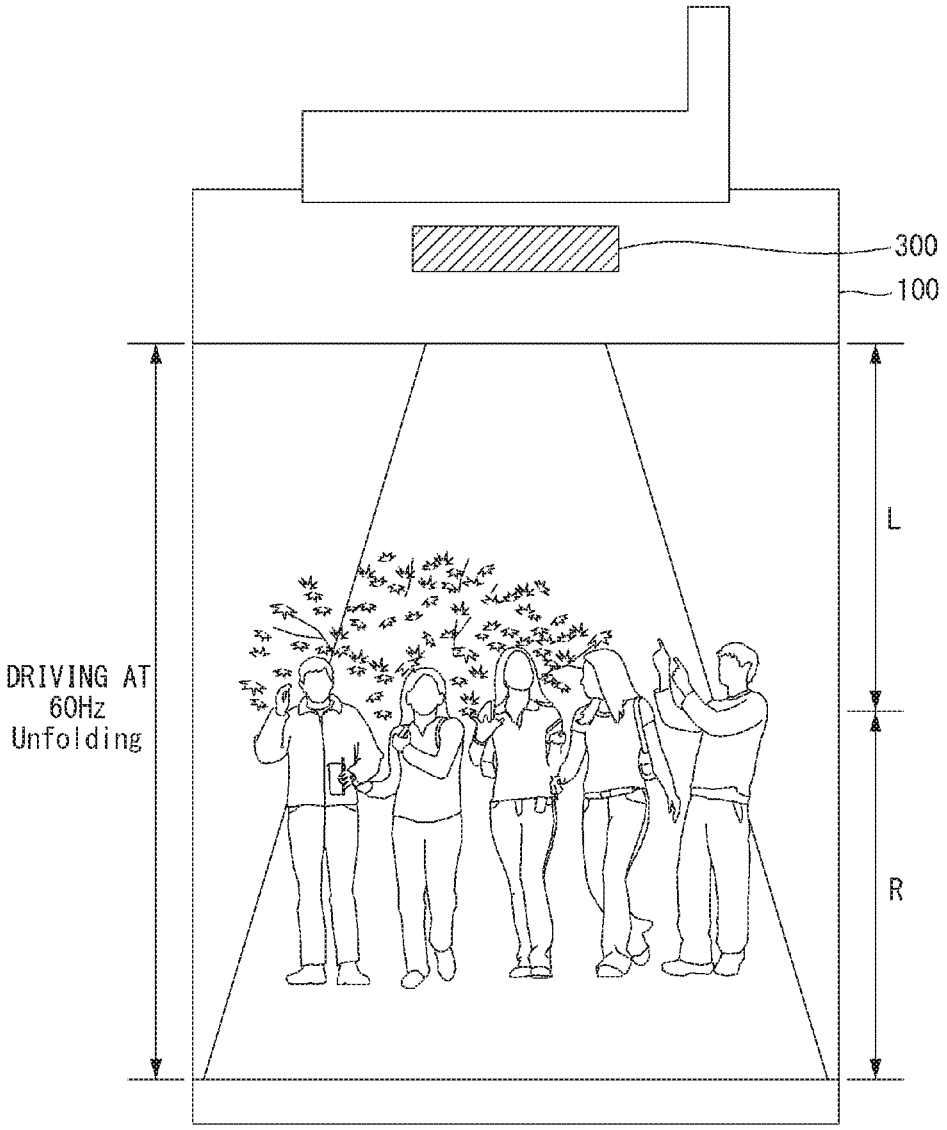
FIG. 17 is a diagram illustrating a screen in an unfolded state on the foldable display of the present disclosure.
Figure 17:
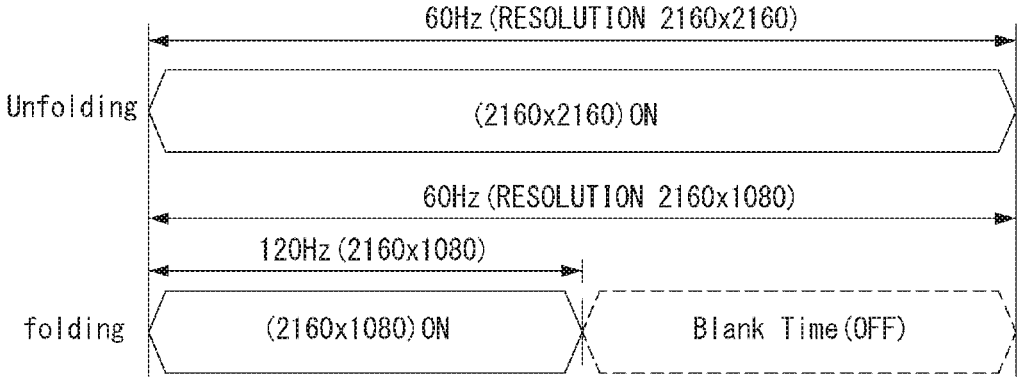

In an unfolded state in which the flexible display panel 100 is unfolded, the drive IC 300 drives a screen having a high resolution (S131 and S133). The screen having the high resolution can be an activated screen of a maximum screen combining the first screen L, the folding boundary A, and the second screen R. As shown in FIG. 17, the screen having a high resolution can be driven at the reference frequency or the frequency different from the reference frequency.

Referring to FIG. 14, when the flexible display panel 100 is folded, the drive IC 300 drives the screen having a low resolution (S141 to S144). In the folded state, a frame frequency of an image signal input to the drive IC 300 can be varied. In this case, the drive IC 300 detects the frame frequency of the input image signal and drives the screen having a low resolution at the varied frequency (S142 and S143). The varied frequency means the frame frequency different from the reference frequency. When the input frequency of the drive IC 300 is not varied in the folded state, the drive IC 300 drives the screen having a low resolution at the reference frequency (S142 and S144).

When the flexible display panel 100 is in the unfolded state in which the flexible display panel 100 is not folded, the drive IC 300 drives the screen having a high resolution (S145 and S147). In the unfolded state, a frame frequency of an image signal input to the drive IC 300 can be varied. In this case, the drive IC 300 detects the frame frequency of the input image signal and drives the screen having a high resolution at the varied frequency (S145 and S146). When the input frequency of the drive IC 300 is not varied in the unfolded state, the drive IC 300 drives the screen having a high resolution at the reference frequency (S145 and S147).

The foldable display of the present disclosure can drive any one screen in a virtual reality (VR) mode in the folded state. As shown in FIG. 15, in the VR mode, in order to prevent a user from feeling motion sickness and fatigue when he or she moves, it is necessary to move an image by reflecting movement of the user in real time at a high frame frequency.

Referring to FIG. 15, when the flexible display panel 100 is folded, the drive IC 300 drives the screen having low resolution (S151 to S154).

In the folded state, the user can select the VR mode in a state in which the foldable display is folded. In this case, the host system 200 transmits an image signal of a VR content selected by the user to the drive IC 300. In response to an output signal of the tilt sensor, the host system 200 can generate and transmit an image signal of a high frame frequency to the drive IC 300 by rendering pixel data to which movement of the user is reflected. In the VR mode, the drive IC 300 receives an input image signal having a frequency that is higher than the reference frequency and drives the screen having a low resolution at a high frequency. The high frequency can be a frame frequency of 120 Hz (S152 and S153). When the VR mode is not selected in the folded state, the drive IC 300 drives the screen having a low resolution at the reference frequency (S152 and S153).

When the flexible display panel 100 is in the unfolded state in which the flexible display panel 100 is not folded, the drive IC 300 drives the screen having a high resolution at the reference frequency (S151 to S155).

FIG. 18 is a circuit diagram illustrating an operation of a pixel formed in a deactivated screen. The deactivated screen is the second screen R in the example of FIG. 16A and is the first screen L in the example of FIG. 16B.

Referring to FIG. 18, pixels of the deactivated screen do not emit light and are maintained in a black display state. The deactivated screen can be a screen at which the user does not look when the flexible display panel 100 is folded.

In order to allow the deactivated screen to be maintained in a black display, a pixel circuit of the deactivated screen suppresses light emission of the light emitting element OLED. To this end, the sixth switching elements M6 of the deactivated screen are turned on in response to the gate-on voltage VGL of the $N^{th}$ scan signal SCAN(N) and apply Vini to the anodes of the light emitting elements OLED. When Vini is applied to the anode, since a voltage between the anode and the cathode is lower than the threshold voltage Vth, the light emitting element OLED is maintained in an OFF state to not emit light.

Figure 20:
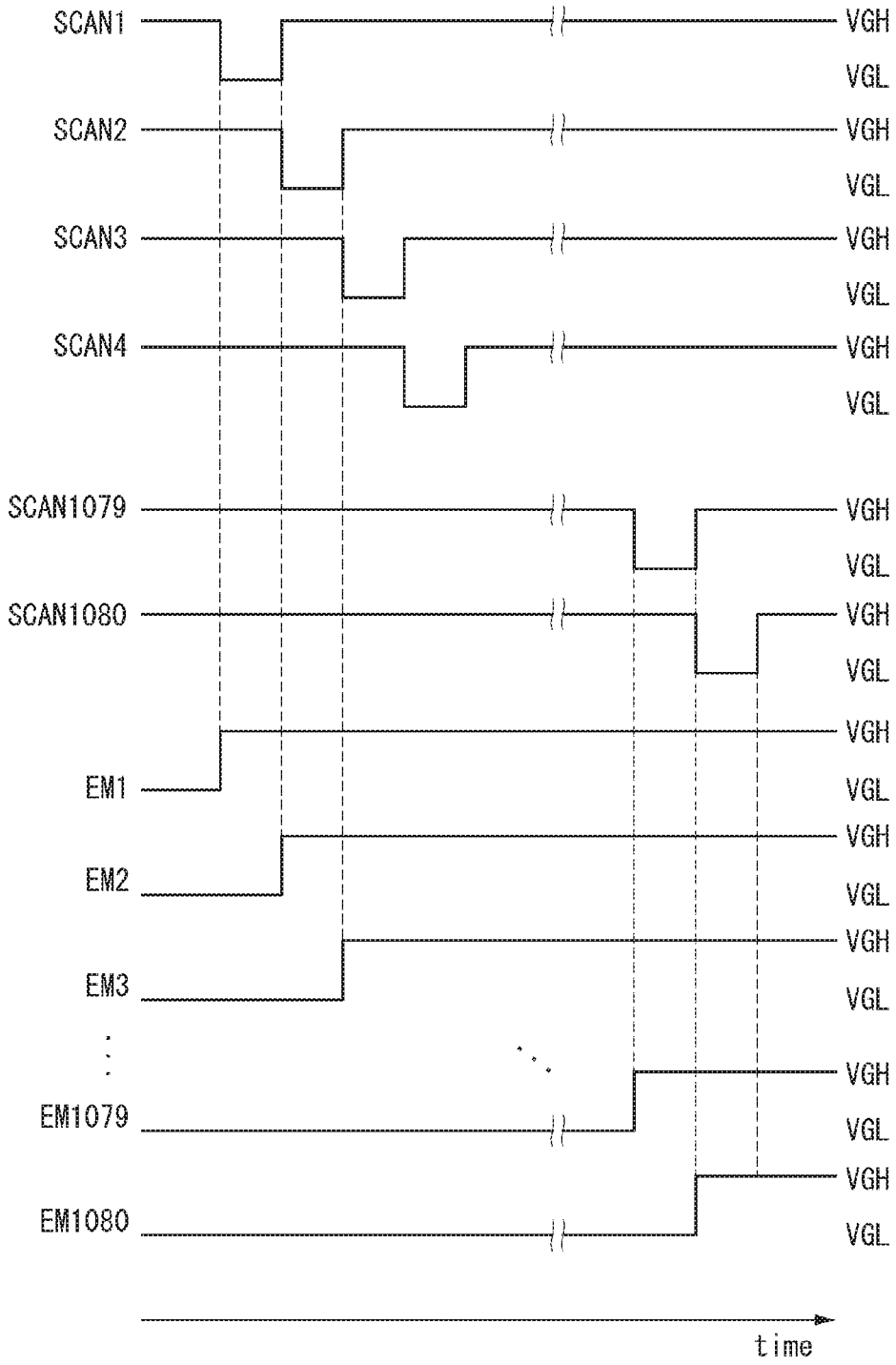
FIG. 20 is a diagram illustrating an example of the gate signal when the first screen is deactivated according to one or more embodiments of the present disclosure.

As shown in FIG. 20, the EM signal EM(N) applied to the pixels of the deactivated screen is applied as the gate-off voltage VGH during one frame interval or more. This is due to a residual charge of the drive element DT, which is accumulated due to a previous data signal, being prevented from influencing on an anode potential of the light emitting element OLED by blocking a current path between ELVDD and the drive element DT and a current path between the drive element DT and the light emitting element OLED. When the EM signal EM(N) of the gate-off voltage VGH is applied to the gates of the third and fourth switching elements M3 and M4, the third and fourth switching elements M3 and M4 are turned off.

The driver IC 300 supplies the data voltage Vdata only for a time for which the activated screen is scanned. Only for a scanning time of a screen activated in synchronization with the data voltage (Vdata) does the gate driver 120 sequentially supply output signals, that is, pulses of the scan signals SCAN(N−1) and SCAN(N) and the light emission control signals EM(N), to the gate lines of the activated screen. Only the activated screen is scanned in a progressive scan manner, and thus the data voltages Vdata are sequentially applied to the pixels one pixel line at a time.

For the remaining time in one frame interval except for the scanning time of the activated screen, an output buffer of the data driver 306 is turned off to not output the data voltage Vdata, and the data output channel of the data driver 306 becomes a high impedance state Hi-Z. When the data output channel is in the high impedance state Hi-Z, the data output channel is electrically separated from the data line so that power consumption does not occur in the data output channel.

In each pixel of the deactivated screen, the first, second, and sixth switching elements M1, M2, and M6 can be turned on according to the gate-on voltage VGL of the Nth scan signal SCAN(N). In each pixel of the deactivated screen, the third, fourth, and fifth switching elements M3, M4, and M5 can be turned off according to the gate-off voltage VGH of the $(N-1)^{th}$ scan signal SCAN(N−1). Whenever the scan signal SCAN(N) is applied, since the anode voltages of the light emitting elements OLED formed on the deactivated screen are initialized to Vini, the light emitting elements OLED are turned off to not emit light. Therefore, the pixels of the deactivated screen maintain the brightness of the black gray scale at Vini applied to the anodes of the light emitting elements OLED without receiving the data voltage.

Figure 19:
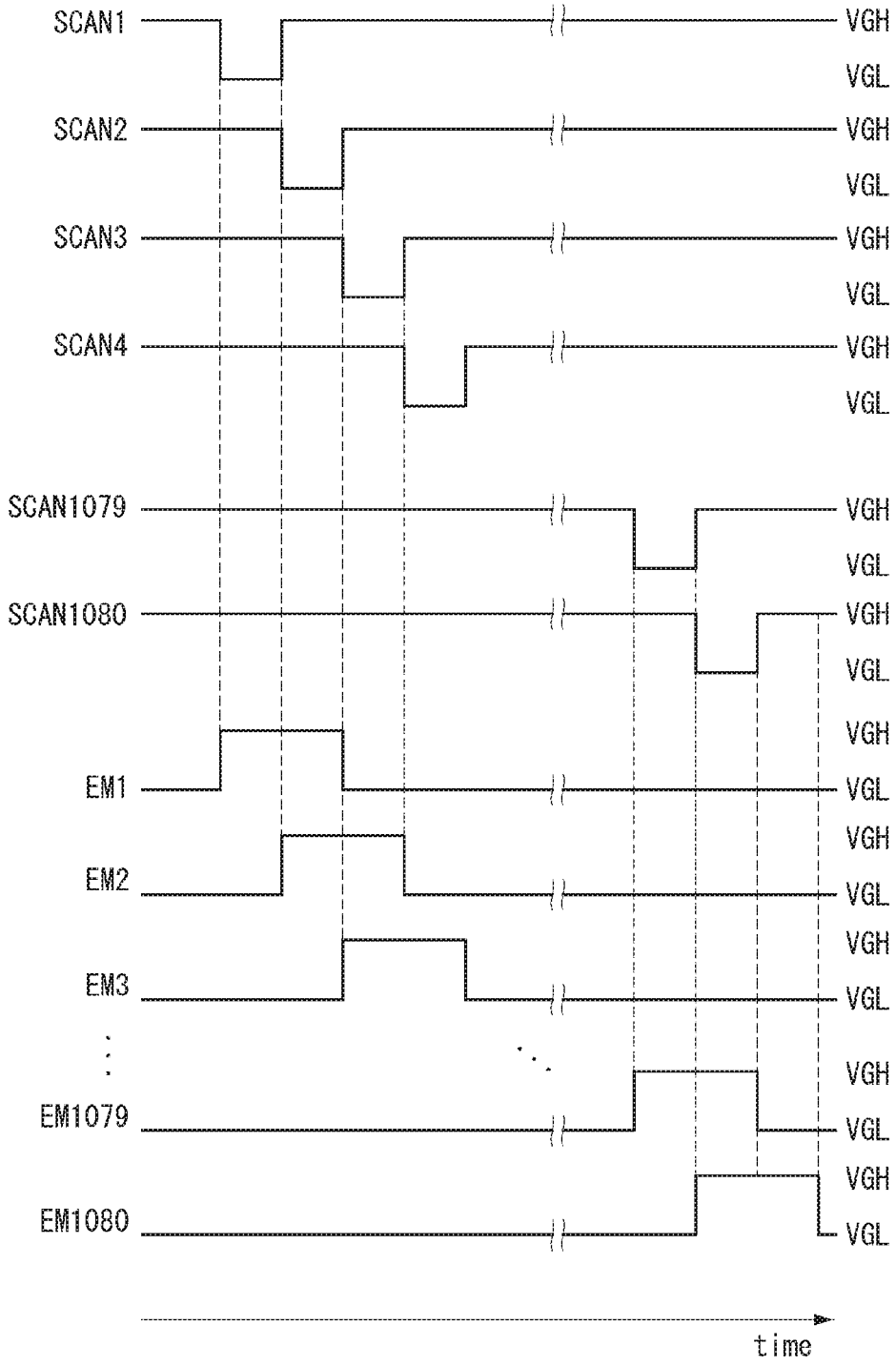
FIG. 19 is a diagram illustrating an example of a gate signal when a first screen is activated according to one or more embodiments of the present disclosure.

FIG. 19 is a diagram illustrating an example of a gate signal when a first screen is activated.

Referring to FIG. 19, the first screen L is activated so that an image can be displayed on the first screen L. The data output channels of the drive IC 300 output the data voltage Vdata of the input image at a scanning time of the activated first screen L. The scan signals SCAN1 to SCAN1080 can be pulses of the gate-on voltage VGL synchronized with the data voltage Vdata and can be sequentially supplied to the pixel lines of the first screen L. The EM signals EM1 to EM1080 can be generated as pulses of the gate-off voltage VGH synchronized with the $(N-1)^{th}$ and $N^{th}$ scan signals SCAN(N−1) and SCAN(N). The EM signals EM1 to EM1080 can be inverted into the gate-on voltage VGL during at least a portion of the light emission time Tem to form the current path between ELVDD and the light emitting element OLED.

In the case of a deactivated screen, as illustrated in FIG. 20, the scan signal is sequentially applied to the deactivated screen to set the anode voltage of the OLED to Vini to control the pixels in a black color state for one frame period or more.

FIG. 20 is a diagram illustrating an example of the gate signal when the first screen is deactivated.

Referring to FIG. 20, when the first screen L is deactivated, the first screen L displays black. In this case, the data output channels of the drive IC 300 become a high impedance state at the scanning time of the first screen L and do not output the data voltage Vdata. The scan signals SCAN1 to SCAN1080 are sequentially supplied to the pixel lines of the first screen L. The sixth switching elements M6 of the first screen L are turned on in response to the scan signals SCAN1 to SCAN1080 to apply Vini to the anodes of the light emitting elements OLED. The EM signals EM1 to EM1080 can be generated as pulses of the gate-off voltage VGH during one frame interval or more. Consequently, since Vini is applied to the anodes of the light emitting elements OLED in all pixels, the deactivated first screen L displays a black gray scale.

Figure 27:
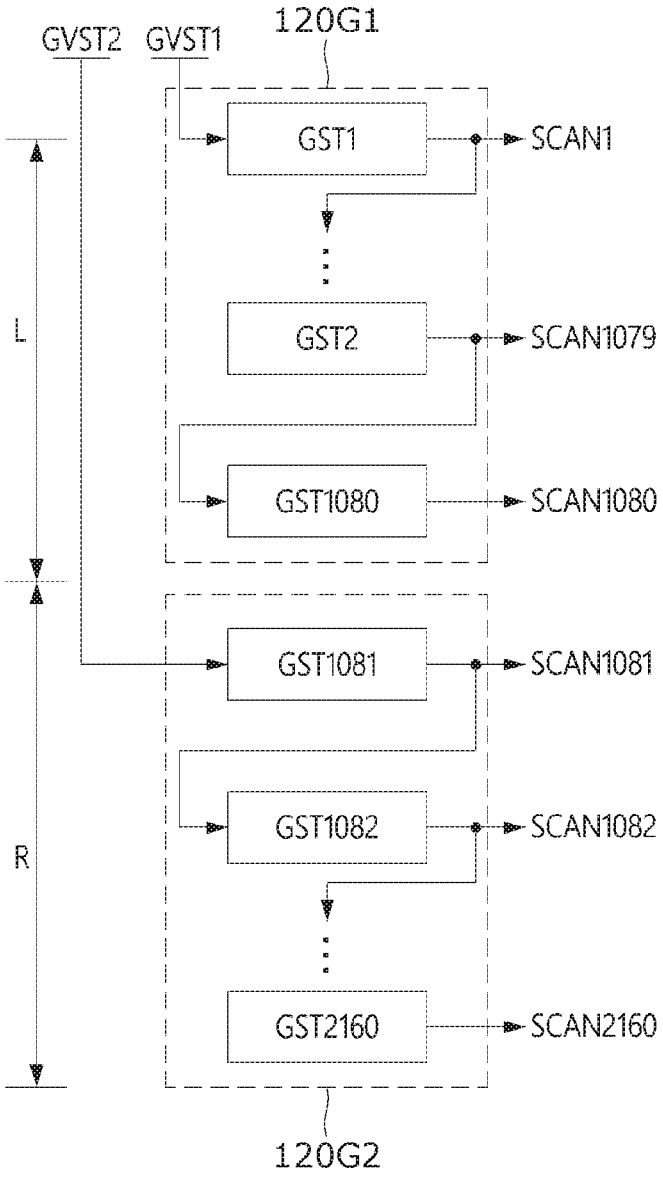
FIGS. 27 and 28 are diagrams illustrating a first gate driver and a second gate driver according to an embodiment of the present disclosure.
Figure 28:
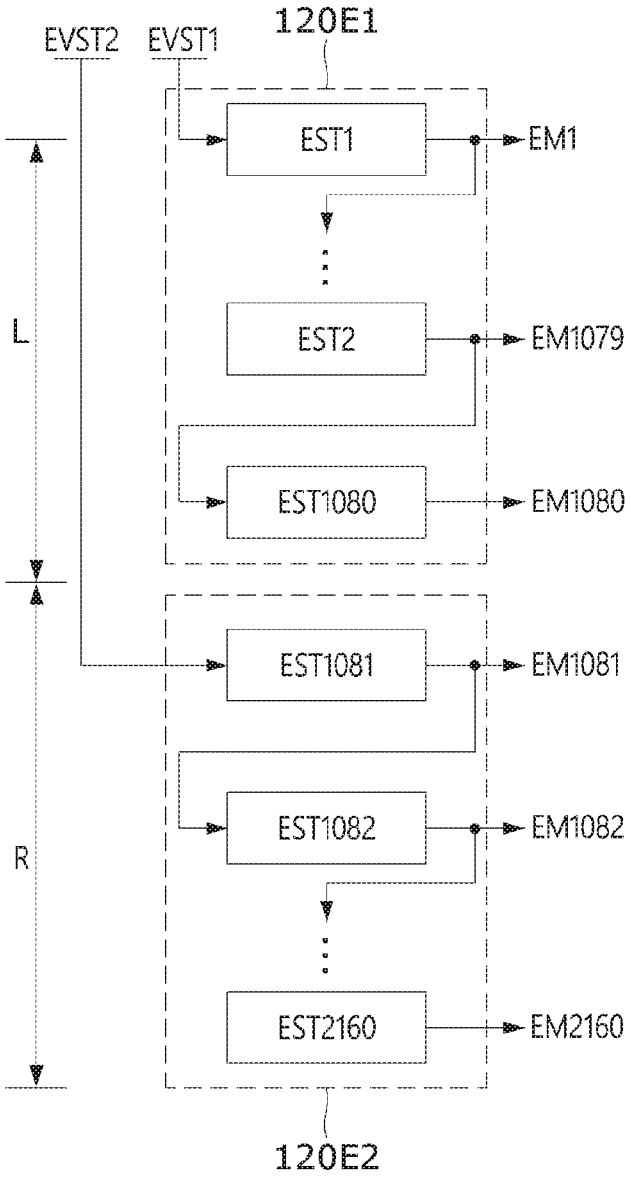

As in examples of FIGS. 27 and 28, the gate driver can include a first gate driver and a second gate driver. Each of the first gate driver and the second gate driver can sequentially generate outputs using a shift register to which a gate start pulse and a gate shift clock are input.

Figure 21:
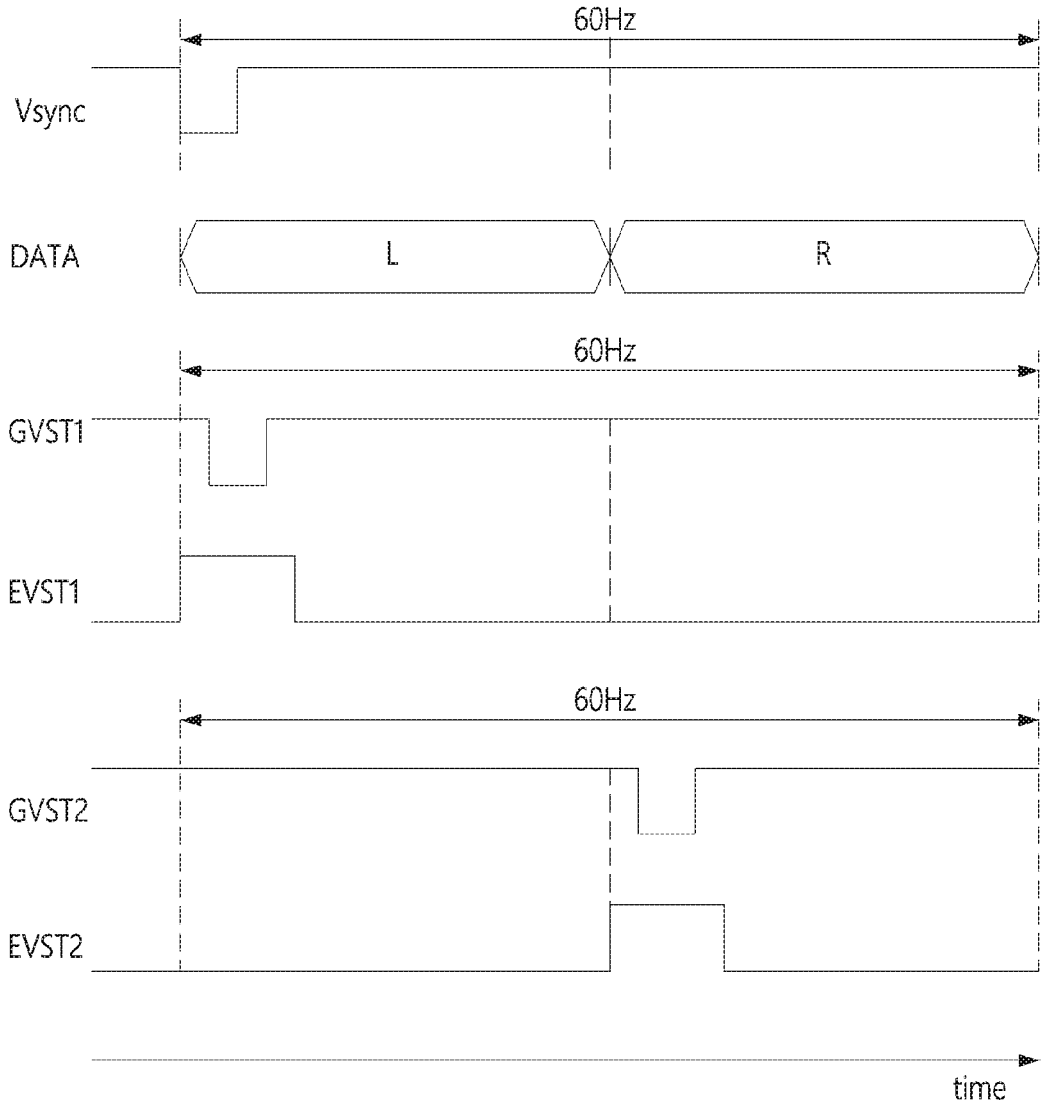
FIG. 21 is a waveform diagram illustrating a gate start pulse when all screens are activated according to one or more embodiments of the present disclosure.

The first gate driver is connected to the gate lines of the first screen L, starts to output a gate signal when a first gate start pulse is input, and shifts the gate signal at each gate shift clock to sequentially apply the gate signal to the gate lines of the first screen L. As shown in FIG. 21, the first gate start pulse can include a first-first start pulse GVST1 for generating a scan signal and a second-first start pulse EVST1 for generating an EM signal.

The second gate driver is connected to the gate lines of the second screen R, starts to output a gate signal when a second gate start pulse is input, and shifts the gate signal at each gate shift clock to sequentially apply the gate signal to the gate lines of the second screen R. As shown in FIG. 21, the second gate start pulse can include a first-second start pulse GVST2 for generating a scan signal and a second-second start pulse EVST2 for generating an EM signal.

Figure 24:
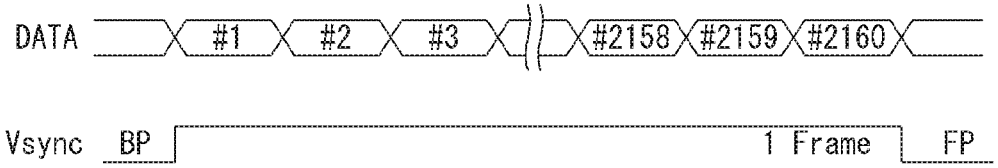
FIG. 24 is a waveform diagram illustrating a data signal and a vertical synchronization signal when the entire screen is activated according to one or more embodiments of the present disclosure.

FIG. 21 is a waveform diagram illustrating a gate start pulse when all the screens L, A, and R are activated. In a state in which the flexible display panel 100 is unfolded, an input image can be displayed on all the screens L, A, and R. FIG. 24 is a waveform diagram illustrating a data signal and a vertical synchronization signal when the entire screen is activated. In FIG. 24, #1, #2, . . . , and #2160 are pixel line numbers indicating data signals for the pixel lines.

Referring to FIGS. 21 and 24, the first-first start pulse GVST1 is generated as a pulse of the gate-on voltage VGL at the beginning of one frame interval. The second-first start pulse EVST1 is generated as a pulse of the gate-off voltage VGH at the beginning of one frame interval.

The first-second start pulse GVST2 is generated as a pulse of the gate-on voltage VGL at about half time of the one frame interval. The second-second start pulse EVST2 is generated as a pulse of the gate-off voltage VGH at about half time of one frame interval.

While all the screens L, A, and R are activated, each of the first gate start pulses GVST1 and EVST1 and each of the second gate start pulses GVST2 and EVST2 can be generated at a frequency of 60 Hz.

FIGS. 22, 23, 25, and 26 are diagrams illustrating a method of driving only half of all the screens as an activated screen.

Figure 22:
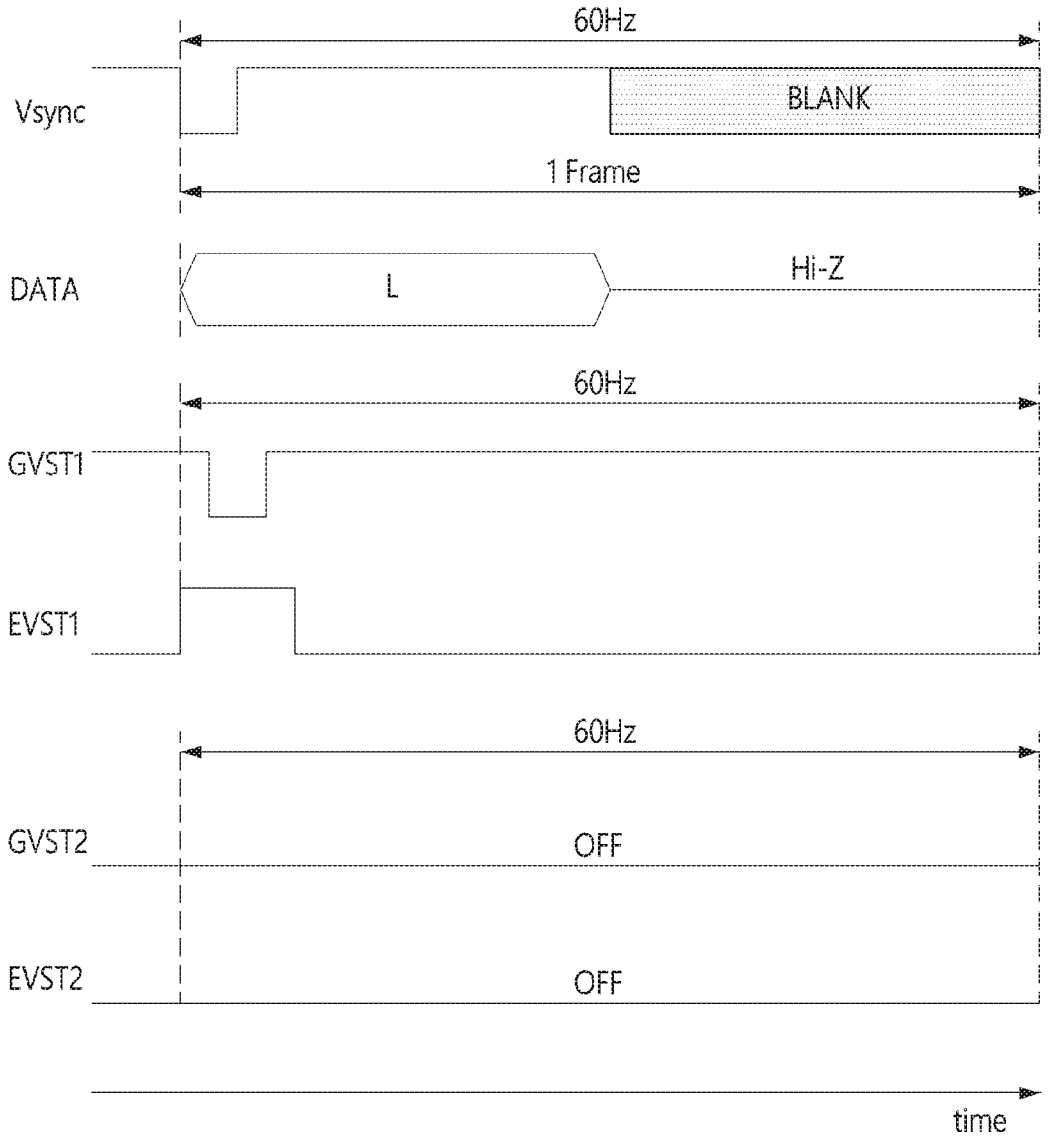
FIG. 22 is a waveform diagram illustrating a gate start pulse when the first screen is driven at a frame frequency of 60 Hz according to one or more embodiments of the present disclosure.
Figure 25:
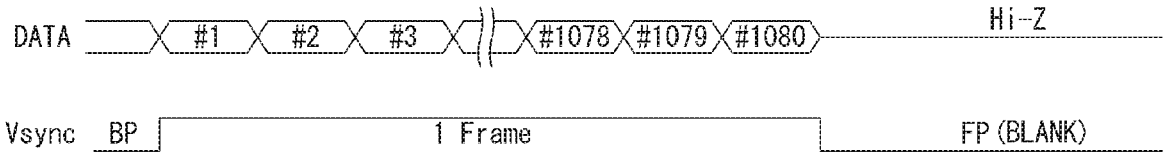
FIG. 25 is a waveform diagram illustrating a data signal and a vertical synchronization signal when the first screen is driven at the frame frequency of 60 Hz according to one or more embodiments of the present disclosure.

FIG. 22 is a waveform diagram illustrating a gate start pulse when the first screen L is driven at a frame frequency of 60 Hz. FIG. 25 is a waveform diagram illustrating a data signal and a vertical synchronization signal when the first screen L is driven at the frame frequency of 60 Hz.

In examples of FIGS. 22 and 25, the first screen L is activated and driven at the frequency of 60 Hz to display pixel data of an input image. The second screen R is deactivated to display black.

Referring to FIGS. 22 and 25, when only the first screen L is activated, the first gate start pulses GVST1 and EVST1 can be generated at a frequency of 60 Hz. In this case, the second gate start pulses GVST2 and EVST2 are not generated.

The first screen L displays the input image, whereas the second screen R displays black with minimum brightness. The folding boundary A can be an activated screen or a deactivated screen. For example, when the flexible display panel is folded, an image different from the image displayed on the activated screen or a preset information may be displayed on the folding boundary area A. When the flexible display panel is folded, the folding boundary area A may be controlled with the same black pixels as the deactivated screen.

During one or two frame intervals (8.3 ms) at the frame frequency of 60 Hz, the drive IC 300 outputs a data voltage Vdata supplied to the pixels of the first screen L through the data output channels. Subsequently, during the one or two frame intervals, the drive IC 300 turns output buffers of the data output channels off to maintain the data output channels at the high impedance Hi-Z.

After the first screen L is scanned, since the data voltage Vdata of the pixel data is not output from the drive IC 300, the pixel data of the input image is not written to the pixels of the second screen R. The gate driver 120 sequentially supplies the scan pulses SCAN(N) to the gate lines of the second screen R to which the data voltage Vdata is not applied and thus, as shown in FIG. 18, applies Vini to the anode of the light emitting element OLED, thereby suppressing light emission of the pixels. Consequently, the second screen R displays a black gray scale.

In one frame interval (16.67 ms) at the frame frequency of 60 Hz, a second half time is a vertical blank time BLANK in which the data voltage Vdata is not supplied to the pixels so that the vertical blank time (VB=BLANK) is extended by as much as the second half time. Accordingly, this driving method can obtain an impulsive or black data inversion (BDI) effect.

Figure 23:
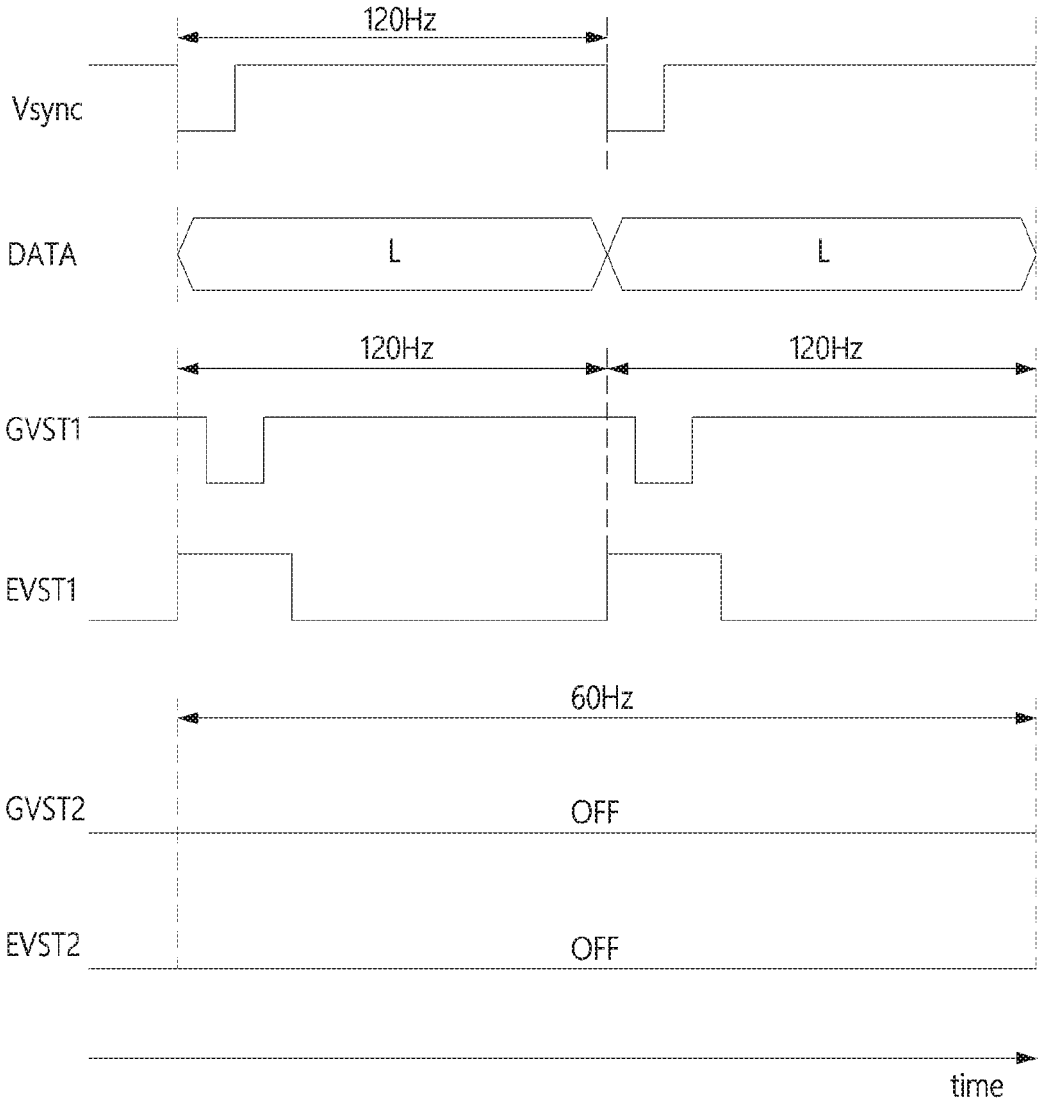
FIG. 23 is a waveform diagram illustrating a gate start pulse when the first screen is driven at a frame frequency of 120 Hz according to one or more embodiments of the present disclosure.
Figure 26:
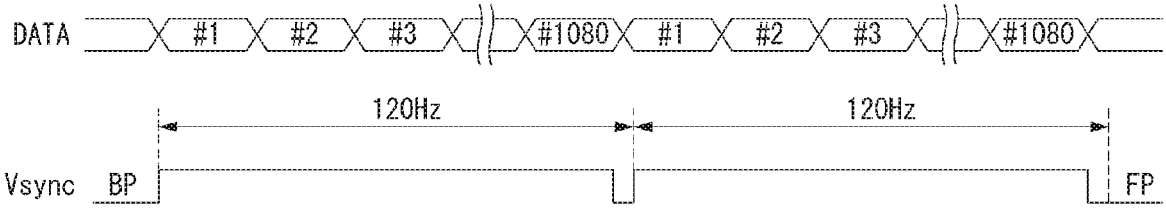
FIG. 26 is a waveform diagram illustrating a data signal and a vertical synchronization signal when the first screen is driven at the frame frequency of 120 Hz according to one or more embodiments of the present disclosure.

FIG. 23 is a waveform diagram illustrating a gate start pulse when the first screen L is driven at a frame frequency of 120 Hz. FIG. 26 is a waveform diagram illustrating a data signal and a vertical synchronization signal when the first screen L is driven at the frame frequency of 120 Hz.

Referring to FIGS. 23 and 26, when only the first screen L is activated, the first gate start pulses GVST1 and EVST1 can be generated at a frequency of 120 Hz. In this case, the second gate start pulses GVST2 and EVST2 are not generated.

The first screen L displays the input image, whereas the second screen R displays black with minimum brightness. The folding boundary A can be an activated screen or a deactivated screen.

The drive IC 300 is driven at the frame frequency of 120 Hz, and, during the one or two frame intervals (8.3 ms), the drive IC 300 outputs a data voltage Vdata supplied to the pixels of the first screen L through the data output channels.

FIGS. 27 and 28 are diagrams illustrating a first gate driver and a second gate driver according to an embodiment of the present disclosure.

Referring to FIGS. 27 and 28, the gate driver can include a first gate driver for driving gate lines of the first screen L and a second gate driver for driving gate lines of the second screen R.

The gate lines of the folding boundary A can be separately driven by first gate drivers 120G1 and 120E1 and second gate drivers 120G2 and 120E2. For example, gate lines formed in a half area of the folding boundary A close to the first screen L can be driven by the first gate drivers 120G1 and 120E1. Gate lines formed in the remaining half area of the folding boundary A close to the second screen R can be driven by the second gate drivers 120G2 and 120E2.

The first gate drivers 120G1 and 120E1 include a first-first shift register 120G1 for sequentially supplying the scan signals SCAN(N−1) and SCAN(N) to the gate lines 31, 32*a*, 32*b* of the first screen L, and a second-first shift register 120E1 for sequentially supplying the EM signal EM(N) to the gate lines 33 of the first screen L.

The first-first shift register 120G1 includes a plurality of stages GST1 to GST1080 which are connected in cascade to sequentially generate outputs. The first-first shift register 120G1 receives the first-first start pulse GVST1 and the gate shift clock and sequentially outputs and supplies the first to $1080^{th}$ scan signals SCAN1 to SCAN1080 to the gate lines 31, 32*a*, and 32*b* of the first screen L. The second-first shift register 120E1 includes a plurality of stages EST1 to EST1080 which are connected in cascade to sequentially generate outputs. The second-first shift register 120E1 receives the second-first start pulse EVST1 and the gate shift clock and sequentially outputs and supplies the first to $1080^{th}$ scan signals EM1 to EM1080 to the gate lines 33 of the first screen L.

The second gate drivers 120G2 and 120E2 include a first-second shift register 120G2 for sequentially supplying the scan signals SCAN(N−1) and SCAN(N) to the gate lines 31, 32*a*, 32*b* of the second screen L, and a second-second shift register 120E2 for sequentially supplying the EM signal EM(N) to the gate lines 33 of the second screen R.

The first-second shift register 120G2 includes a plurality of stages GST1081 to GST2160 which are connected in cascade to sequentially generate outputs. The first-second shift register 120G2 receives the first-second start pulse GVST1 and the gate shift clock and sequentially outputs and supplies the $1081^{th}$ to $2160^{th}$ scan signals SCAN1081 to SCAN2160 to the gate lines 31, 32*a*, and 32*b* of the second screen R. The second-second shift register 120E2 includes a plurality of stages EST1081 to EST2160 which are connected in cascade to sequentially generate outputs. The second-second shift register 120E2 receives the second-second start pulse EVST2 and the gate shift clock and sequentially outputs and supplies the $1081^{th}$ to $2160^{th}$ scan signals EM1081 to EM2160 to the gate lines 33 of the second screen R.

Figure 29A:
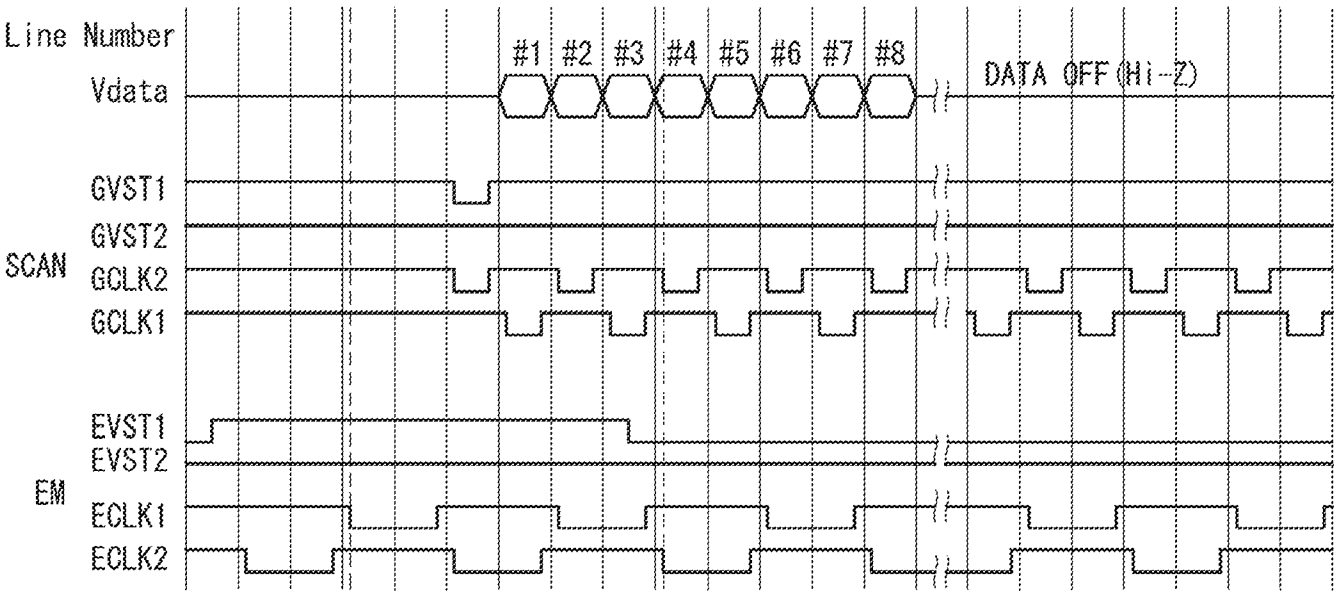
FIGS. 29A and 29B are waveform diagrams illustrating a data signal and a gate start pulse when only some of the screens are activated according to one or more embodiments of the present disclosure.
Figure 29B:
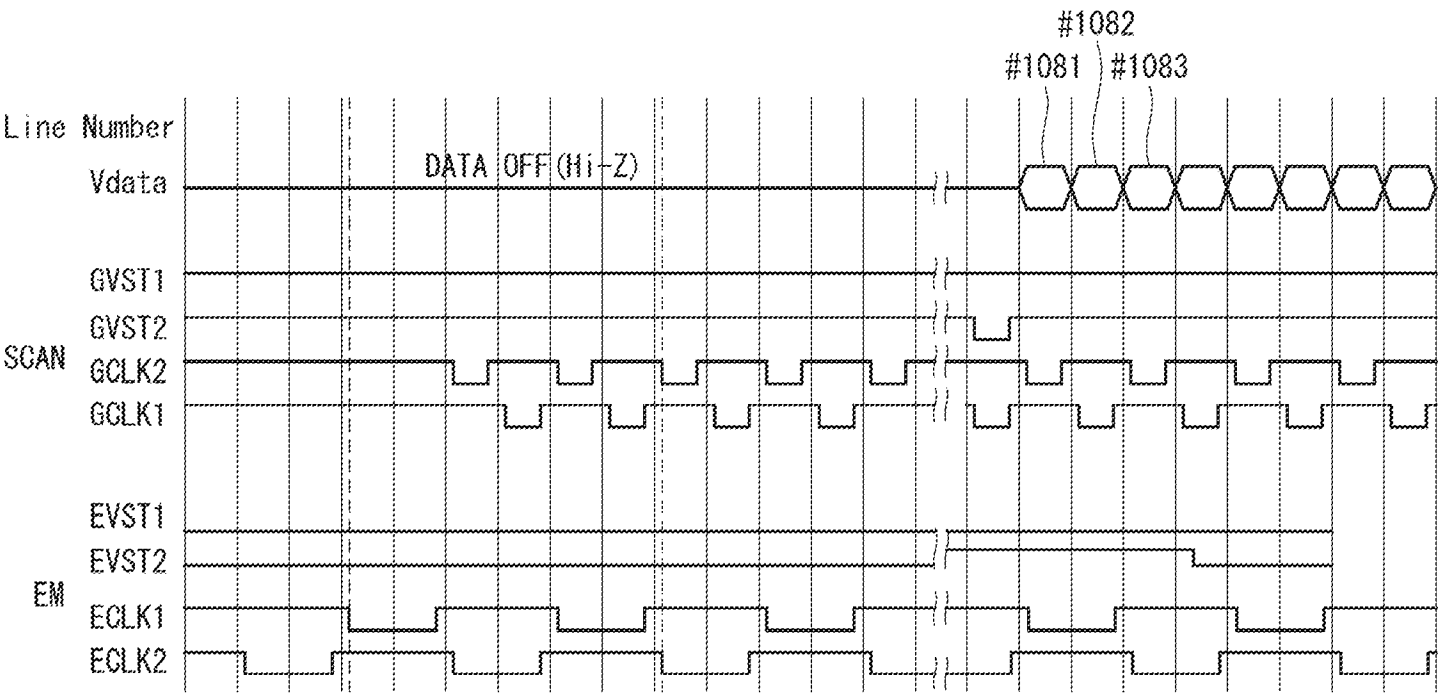

FIGS. 29A and 29B are waveform diagrams illustrating a data signal and a gate start pulse when only some of the screens are activated. In FIGS. 29A and 29B, GCLK1 and GCLK2 represent the gate shift clocks input to the first-first shift register 120G1 and the first-second shift register 120G2. ECLK1 and ECLK2 represent the gate shift clocks input to the second-first shift register 120E1 and the second-second shift register 120E2.

In the present disclosure, in the folded state of the foldable display, that is, when the screen is partially driven, the gate driving frequency of the deactivated screen is decreased to half or less compared to the gate driving frequency of the activated screen. Here, the gate driving frequency means the frequency of the gate start pulse or the frame frequency.

For example, when an image is displayed only on the first screen L among the first and second screens L and R, the gate driving frequency of the second screen R is decreased to half or less compared to the gate driving frequency of the first screen L. When an image is displayed only on the second screen R among the first and second screens L and R, the gate driving frequency of the first screen L is decreased to half or less compared to the gate driving frequency of the second screen R. Therefore, according to the present disclosure, when the screen of the foldable display is partially driven, power consumption of the gate driver 120 can be significantly reduced.

FIGS. 30A, 30B, 31A and 31B are waveform diagrams illustrating a control method of a gate driving frequency in a folded state of the foldable display according to an embodiment of the present disclosure. In the present embodiment, the first screen L displays an image, and the second screen R displays black. In FIGS. 30A to 32B, GVST1 and EVST1 are start pulses applied to the gate driver that drives the gate lines of the activated screen. GVST2 and EVST2 are start pulses applied to the gate driver that drives the gate lines of the deactivated screen. SCAN1 to SCAN1080 are scan pulses of the activated screen that are shifted in response to GVST1. SCAN1081 to SCAN2160 are scan pulses of the deactivated screen that are shifted in response to GVST2.

Figure 30A:
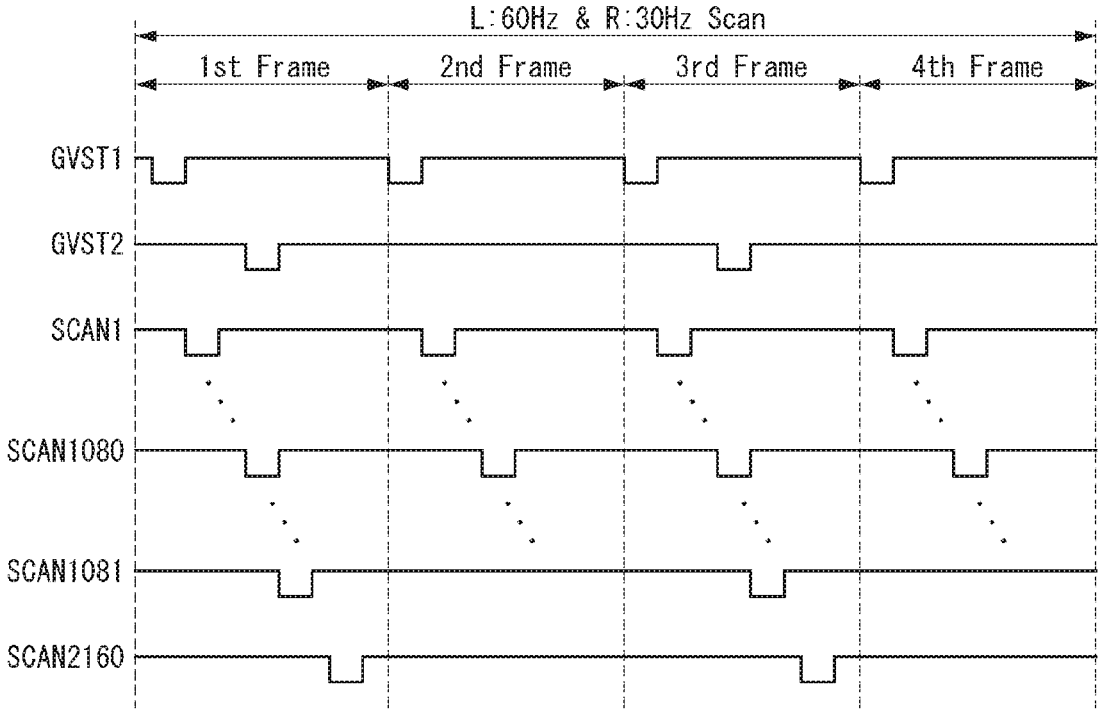
FIGS. 30A to 31B are waveform diagrams illustrating a control method of a gate driving frequency in a folded state of the foldable display according to an embodiment of the present disclosure.
Figure 30B:
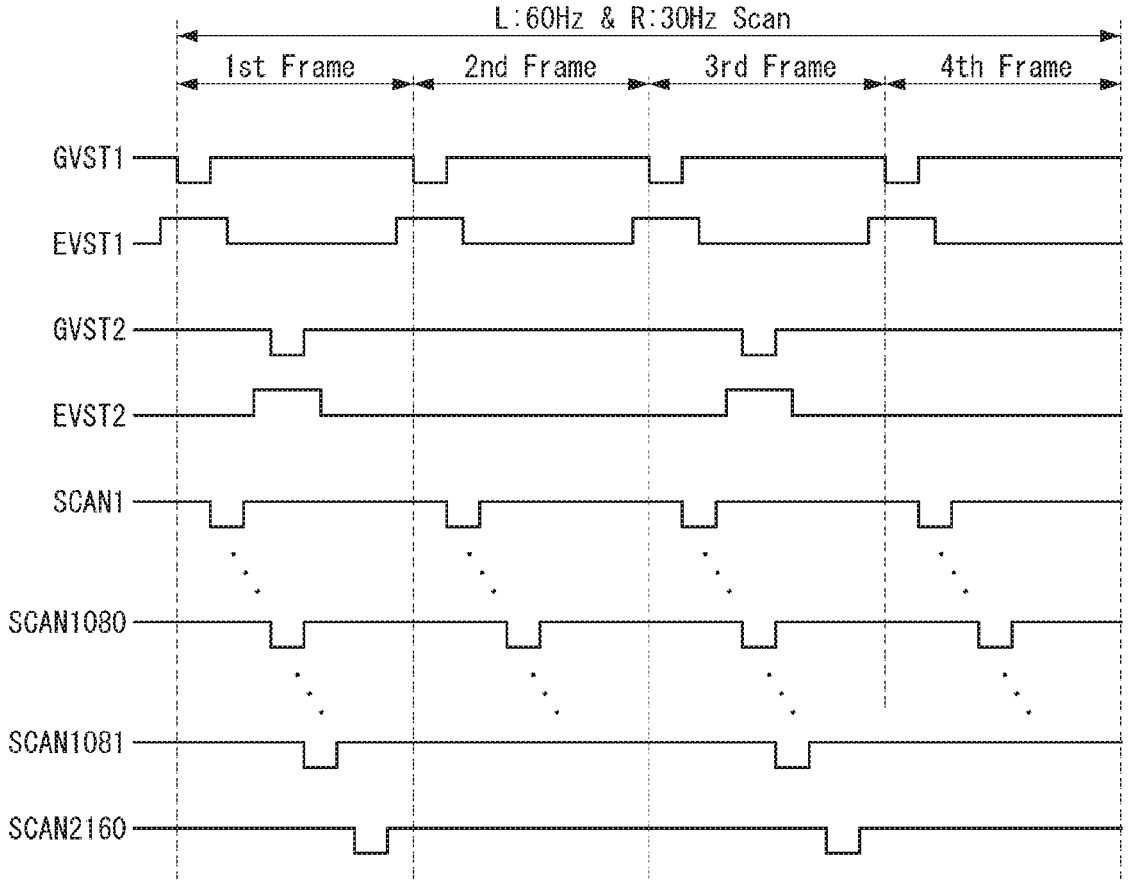

Referring to FIGS. 30A and 30B, the first gate drivers 120G1 and 120E1 sequentially output the scan signals SCAN1 to SCAN1080 by receiving the first gate start pulses GVST1 and EVST1, which are generated at a frame frequency of 60 Hz, and the gate shift clocks.

The second gate drivers 120G2 and 120E2 sequentially output the scan signals SCAN1081 to SCAN2160 by receiving the second gate start pulses GVST2 and EVST2, which are generated at a frame frequency of 30 Hz, and the gate shift clocks.

As shown in FIG. 30A, during a time of odd-numbered frames (a first frame and a third frame), the first and second gate drivers 120G1 and 120G2 sequentially output the scan pulses SCAN1 to SCAN2160 in response to the gate start pulses GVST1 and GVST2. In this case, the scan pulses SCAN1 to SCAN1080 applied to the gate lines of the first screen L are synchronized with the data voltage Vdata of the pixel data. Since the data voltage Vdata is not generated during the scanning time of the second screen R, the scan pulses SCAN1 to SCAN1080 applied to the gate lines of the second screen R are not synchronized with the data voltage Vdata and turn the switch element M6 on as shown in FIG. 18.

During the time of the odd-numbered frames (the first frame and the frame), an input image of odd frames is displayed on the pixels of the first screen L. On the other hand, during the time of the odd-numbered frames (the first frame and the third frame), Vini is applied to the anodes of the light emitting elements OLED so that the pixels of the second screen R display a black gray scale.

In order to hold a voltage of the anode of the light emitting element OLED to Vini in the second screen R which is deactivated, the EM signal EM(N) can be maintained as the gate-off voltage VGH. To this end, as shown in FIG. 30A, during the time of the odd-numbered frames (the first frame and the third frame), the gate start pulses GVST1, GVST2, EVST1, and EVST2 can be input to the first and second gate drivers 120G1 and 120G2. During the time of odd-numbered frames (the first frame and the third frame), the scan pulses SCAN1 to SCAN2160 and the pulses of the EM signals can be sequentially output to the first and second screens L and R.

During a time of even-numbered frames (a second frame and a fourth frame), the first gate driver 120G1 sequentially outputs the scan pulses SCAN1 to SCAN1080 in response to the gate start pulse GVST1. In this case, the scan pulses SCAN1 to SCAN1080 applied to the gate lines of the first screen L are synchronized with the data voltage Vdata of the pixel data.

During the time of the even-numbered frames (a second frame and a fourth frame), since the first-second start pulse GVST2 is not input to the second gate driver 120G2, the second gate driver 120G2 does not output the scan pulse. In this case, since the second gate driver 120G2 is not driven, power consumption does not occur.

During the time of the even-numbered frames (the second frame and the fourth frame), the pixel data is written to the pixels of the first screen L again so that an input image of the even-numbered frames is displayed. On the other hand, during the time of the even-numbered frames (the second frame and the fourth frame), since the scan pulses and the data voltages are not applied and the fourth node n4 is floated so that the voltage of the anode of the light emitting element OLED is maintained as Vini, the pixels of the second screen R hold the black gray scale.

As shown in FIG. 30B, during the time of the even-numbered frames (the second frame and the fourth frame), the first-second start pulse GVST2 and the second-second start pulse EVST2 may not be input to the second gate driver 120G.

Figure 31A:
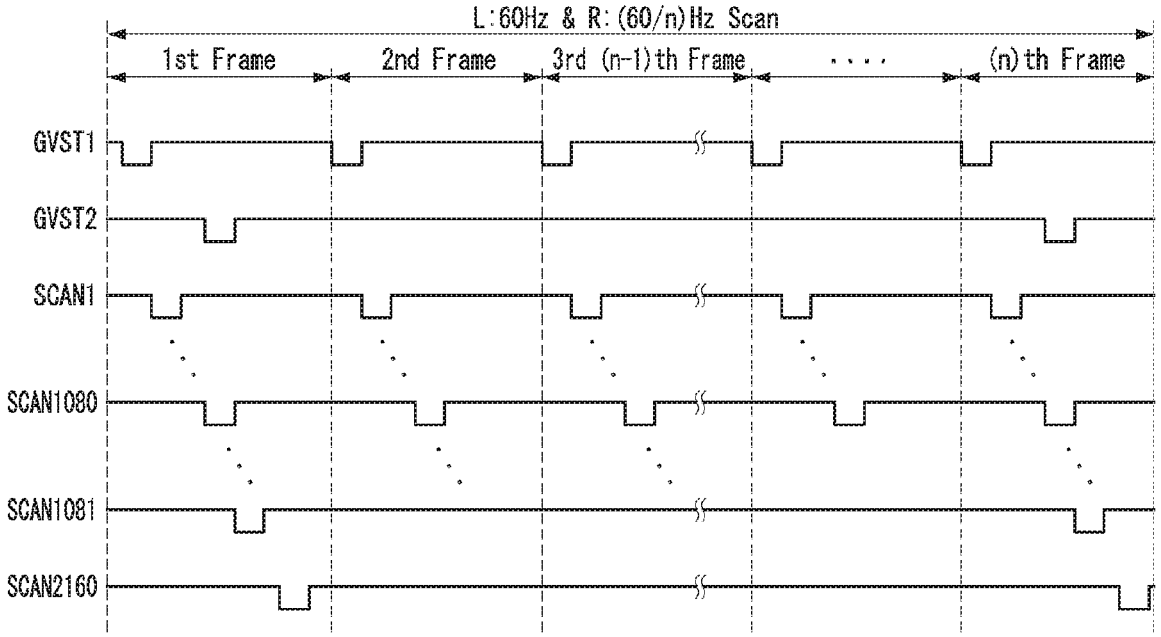
Figure 31B:
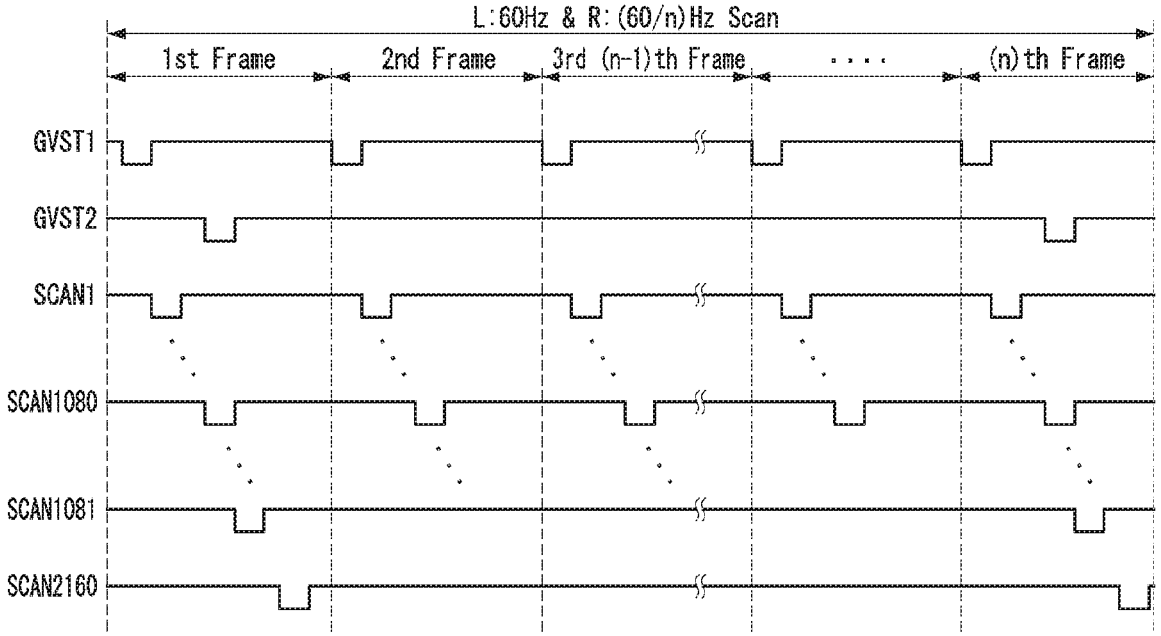

Referring to FIGS. 31A and 31B, the first gate drivers 120G1 and 120E1 sequentially output the scan signals SCAN1 to SCAN1080 by receiving the first gate start pulses GVST1 and EVST1, which are generated at a frame frequency of 60 Hz, and the gate shift clocks.

The second gate drivers 120G2 and 120E2 sequentially output the scan signals SCAN1081 to SCAN2160 by receiving the second gate start pulses GVST2 and EVST2, which are generated at a frame frequency of 60/n Hz (n is a positive integer ranging from 2 and 60), and the gate shift clocks. When n=60, the second gate drivers 120G2 and 120E2 receive the second gate start pulses GVST2 and EVST2 generated at a frame frequency of 1 Hz.

As shown in FIG. 31A, during a first frame interval (the first frame), the first and second gate drivers 120G1 and 120G2 sequentially output the scan pulses SCAN1 to SCAN2160 in response to the gate start pulses GVST1 and GVST2. In this case, the scan pulses SCAN1 to SCAN1080 applied to the gate lines of the first screen L are synchronized with the data voltage Vdata of the pixel data. Since the data voltage Vdata is not generated during the scanning time of the second screen R, the scan pulses SCAN1 to SCAN1080 applied to the gate lines of the second screen R are not synchronized with the data voltage Vdata and turn the switch element M6 on as shown in FIG. 18.

During the first frame interval (the first frame), the input image of the odd-numbered frames is displayed on the pixels of the first screen L. On the other hand, during the first frame interval (the first frame), Vini is applied to the anodes of the light emitting elements OLED so that the pixels of the second screen R display the black gray scale.

In order to hold a voltage of the anode of the light emitting element OLED to Vini in the second screen R which is deactivated, the EM signal EM(N) can be maintained as the gate-off voltage VGH. To this end, as shown in FIG. 31B, during the first frame interval (the first frame), the gate start pulses GVST1, GVST2, EVST1, and EVST2 can be input to the first and second gate drivers 120G1 and 120G2. During the first frame interval (the first frame), the scan pulses SCAN1 to SCAN2160 and the pulses of the EM signals can be sequentially output to the first and second screens L and R.

During a second frame interval to an $n^{th}$ frame interval (a second frame to an $n^{th}$ frame), the first gate driver 120G1 sequentially outputs the scan pulses SCAN1 to SCAN1080 in response to the gate start pulse GVST1. In this case, the scan pulses SCAN1 to SCAN1080 applied to the gate lines of the first screen L are synchronized with the data voltage Vdata of the pixel data.

During the second frame interval to the $n^{th}$ frame interval (the second frame to the $n^{th}$ frame), since the first-second start pulse GVST2 is not input to the second gate driver 120G2, the second gate driver 120G2 does not output the scan pulse. In this case, since the second gate driver 120G2 is not driven, power consumption does not occur.

During the second frame interval to the $n^{th}$ frame interval (the second frame to the $n^{th}$ frame), the pixel data is written to the pixels of the first screen L again so that the input image of the even-numbered frames is displayed. On the other hand, during the second frame interval to the $n^{th}$ frame interval (the second frame to the $n^{th}$ frame), since the scan pulses and the data voltages are not applied, and the fourth node n4 is floated so that the voltage of the anode of the light emitting element OLED is maintained as Vini, the pixels of the second screen R hold the black gray scale.

As a folding time of the foldable display continues, the gate driving frequency can be gradually decreased under the control of the timing controller 303. For example, after the gate driving frequency is varied from 60 Hz to 30 Hz when the flexible display panel 100 is folded, when the folding time continues for more than 1 minute, the gate driving frequency can be further decreased to 5 Hz.

When the gate driving frequency of the deactivated screen is decreased as shown in FIGS. 30*a* to 32*b*, since the capacitor Cst maintaining the gate-source voltage Vgs of the drive element DT in each pixel is discharged, as holding times of the pixels are increased, a voltage of capacitor Cst, that is, Vgs of the drive element DT, is decreased. Here, the holding time of the pixel means a time for maintaining the voltage of the capacitor Cst without newly charging the capacitor Cst with the data voltage Vdata. Therefore, as the gate driving frequency is decreased, brightness of the pixels is decreased. Consequently, when the gate driving frequency is decreased, the user can recognize a brightness variation of the screen. To solve the above problem, according to the present disclosure, a voltage of the anode or cathode of the light emitting element OLED can be varied for each gate driving frequency.

Figure 32:
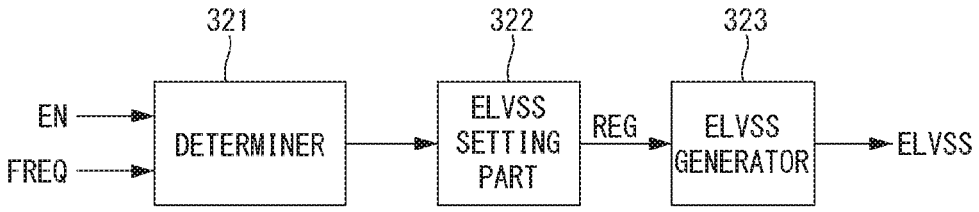
FIGS. 32 and 33 are diagrams illustrating an ELVSS variable device according to an embodiment of the present disclosure.
Figure 33:
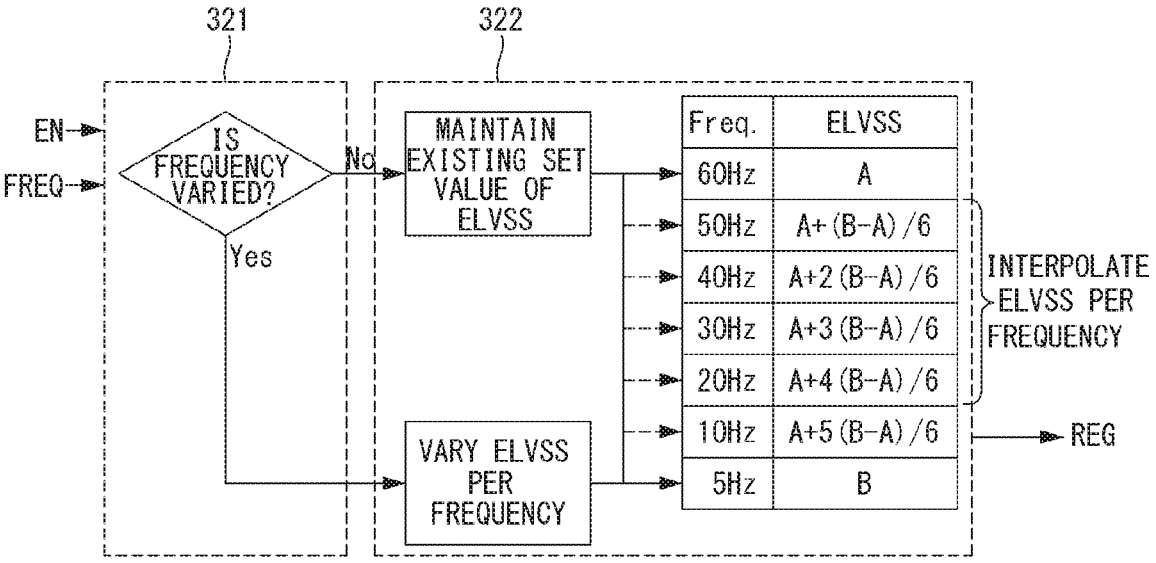

FIGS. 32 and 33 are diagrams illustrating an ELVSS variable device according to one embodiment of the present disclosure.

Referring to FIGS. 32 and 33, the power supply 304 of the drive IC 300 can include an ELVSS variable device.

The ELVSS variable device includes a determiner 321, an ELVSS setting part 322, and an ELVSS generator 323.

The determiner 321 can determine the gate driving frequency or the frame frequency in response to the frequency detection signal FREQ.

The ELVSS setting part 322 receives a frequency determination signal from the determiner 321. The ELVSS setting part 322 outputs a register setting value REG in response to the frequency determination signal. When the gate driving frequency is not varied, the ELVSS setting part 322 maintains the register setting value REG as a previous register setting value REG. For example, when the gate driving frequency is maintained at 60 Hz, the ELVSS setting part 322 outputs a register setting value A corresponding to the gate driving frequency of 60 Hz.

When the gate driving frequency is varied, the ELVSS setting part 322 changes the register setting value to a register setting value corresponding to the varied frequency. For example, the ELVSS setting part 322 outputs a register setting value REG corresponding to a low gate driving frequency of the deactivated screen of the foldable display.

The register setting value REG can include a first setting value corresponding to a first frequency and a second setting value corresponding to a second frequency. As shown in FIG. 33, when a variable range of the gate driving frequency ranges from 5 Hz to 60 Hz, the first setting value can have a setting value corresponding to 60 Hz=A, and the second setting value can have a setting value corresponding to 5 Hz=B. When the variable range of the gate driving frequency ranges from 1 Hz to 60 Hz, B can be a setting value corresponding to 1 Hz.

The ELVSS setting part 322 can select a voltage level of ELVSS, which is gradually varied for each frequency, as a register setting value using an interpolation method. For example, when the gate driving frequency is 10 Hz, the register setting value REG can be calculated as REG=A+5 (B−A)/6. When the gate driving frequency is 20 Hz, the register setting value REG can be calculated as REG=A+4 (B−A)/6. When the gate driving frequency is 50 Hz, the register setting value REG can be calculated as REG=A+ (B−A)/6.

The ELVSS variable device selects the register setting value REG in response to the enable signal EN or the frequency detection signal FREQ. For example, the ELVSS variable device reduces the voltage of the ELVSS to decrease a rate of change in brightness of the pixels when the gate driving frequency is reduced. The ELVSS variable device can output ELVSS having a different voltage for each frequency according to the register setting value REG.

According to the present disclosure, a decrease in brightness of the pixels caused when the gate driving frequency is decreased is compensated for by a method of varying the voltage of ELVSS. The voltage of ELVSS applied to the VSS electrode 106 is supplied to the cathode of the light emitting element OLED. Since the brightness of the light emitting element OLED is increased when a voltage of the cathode of the light emitting element OLED is decreased, the decrease in brightness of the pixel according to the holding time of the pixel can be compensated for.

The DC-DC converter of the power supply 304 can vary an output voltage level according to the resistor setting value REG. The register setting value REG is differently set for each frequency. For example, as in an example of FIG. 33, 5 Hz can be set to B and 60 Hz to A. B can be set to a value that is greater than A (B>A).

The ELVSS generator 323 can determine a duty ratio of a pulse width modulation (PWM) signal to vary the voltage level of ELVSS in response to the register setting value REG from the ELVSS setting part 322. The duty ratio of the PWM signal can be determined according to the register setting value REG. For example, when REG=A, the duty ratio of PWM can be 50%, and, when REG=B, the duty ratio of PWM can be 25%. The voltage of ELVSS output from the ELVSS generator 323 can be decreased as the duty ratio of the PWM signal is decreased. Thus, according to the present disclosure, when the foldable display is folded, the decrease in brightness of the pixels caused when the gate driving frequency of the deactivated screen is decreased can be compensated for by decreasing the voltage level of the ELVSS.

Figure 34:
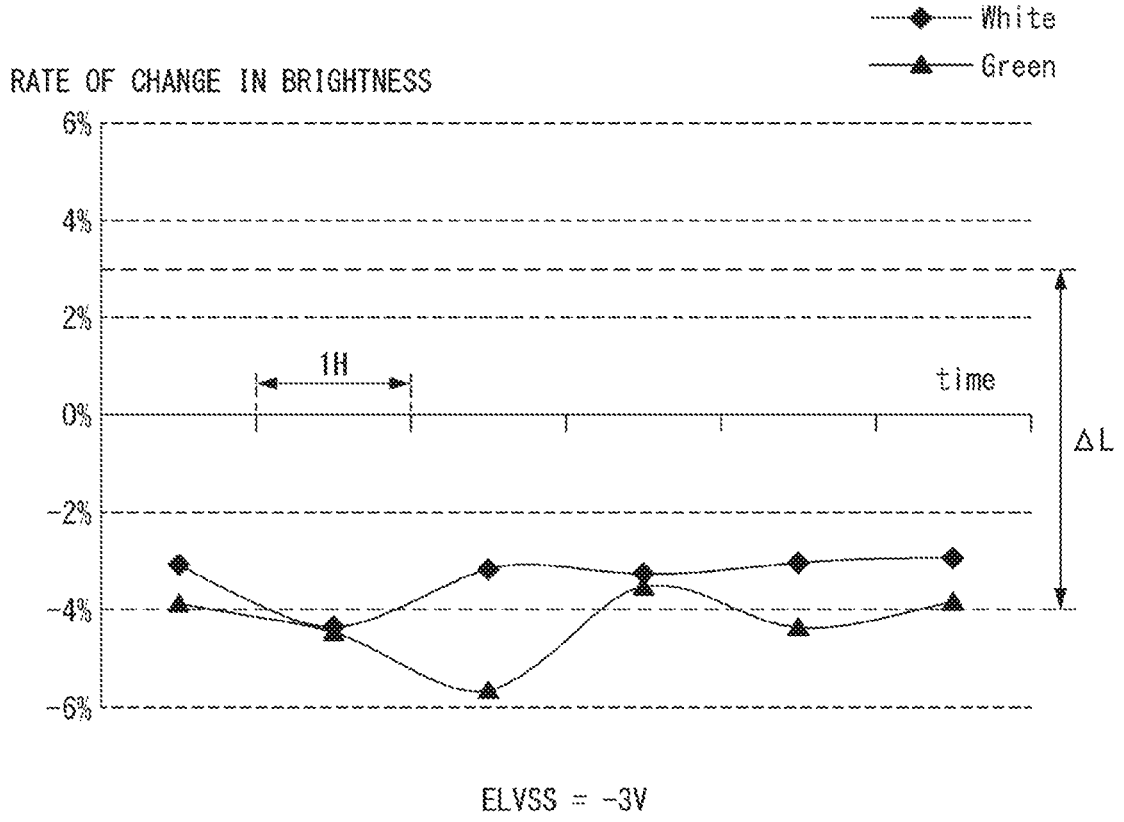
FIG. 34 is a diagram illustrating a rate of change in brightness of a white color and a green color when the gate driver is driven at a gate driving frequency of 5 Hz and the ELVSS is −3 V according to one or more embodiments of the present disclosure.
Figure 35:
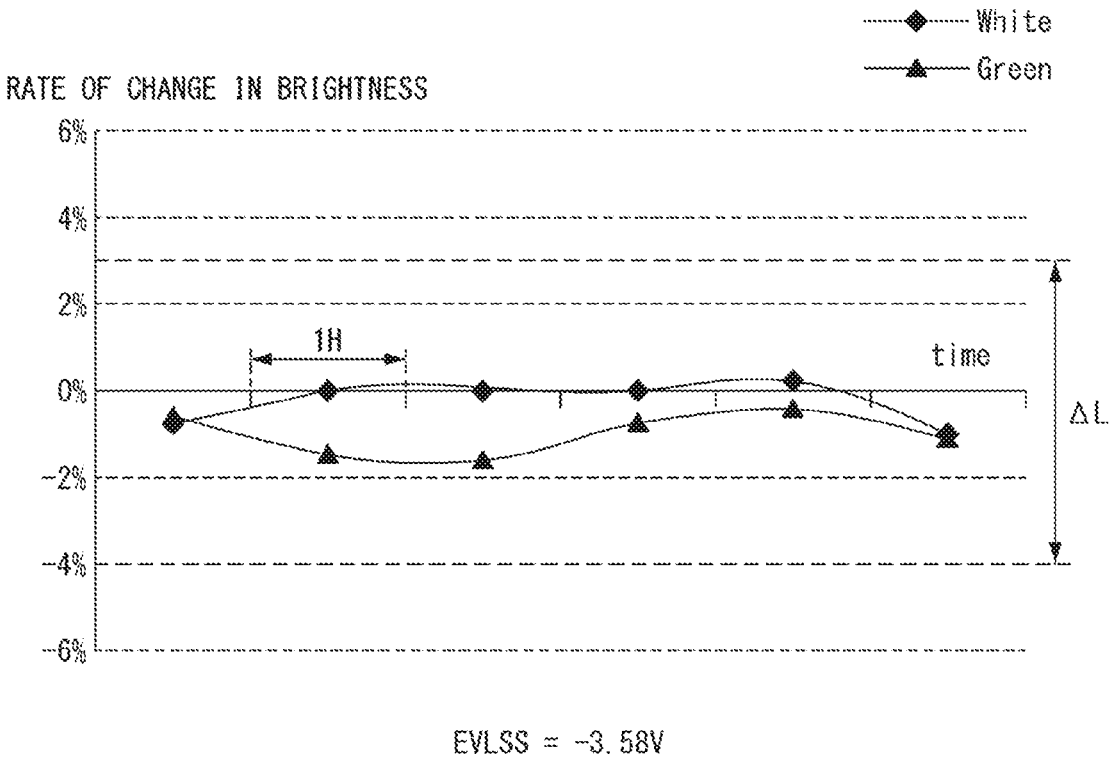
FIG. 35 is a diagram illustrating a rate of change in brightness of a white color and a green color when the gate driver is driven at a gate driving frequency of 5 Hz and the ELVSS is −3.58 V; according to one or more embodiments of the present disclosure

FIG. 34 is a diagram illustrating rates of change in brightness of a white color and a green color when the gate driver is driven at the gate driving frequency of 5 Hz when ELVSS is −3 V. FIG. 35 is a diagram illustrating the rates of change in brightness of the white color and the green color when the gate driver is driven at a gate driving frequency of 5 Hz when the ELVSS is −3.58 V. The results of measuring the rates of change in brightness in FIGS. 34 and 35 are brightness of the white color and the green color measured in a unit of one horizontal time.

Referring to FIGS. 34 and 35, when the gate driving frequency is 60 Hz, it can be set to ELVSS=−3 V. In this case, a rate of change in brightness of the pixels has a value within a brightness change recognition range ΔL in which a viewer recognizes a brightness change. Meanwhile, as shown in FIG. 34, when the gate driving frequency is 5 Hz and ELVSS=−3 V, the rate of change in brightness per unit time is increased, and the brightness of the pixels is changed out of the brightness change recognition range ΔL. The rate of change in brightness (%) represents a variance in brightness per unit time. According to the present disclosure, in order to reduce the rate of change in brightness when the gate driving frequency is varied, ELVSS is decreased. Consequently, as can be seen from the brightness measurement result of FIG. 35, the rate of change in brightness per unit time is reduced within the brightness change recognition range ΔL. In this case, when the gate driving frequency is reduced, the user does not sense the brightness change of the screen.

Figure 36:
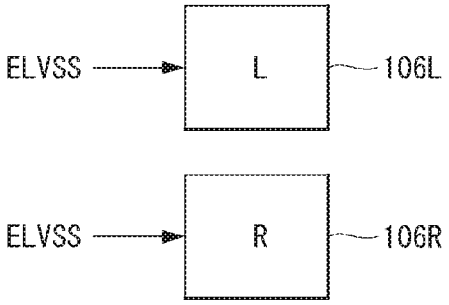
FIG. 36 is a diagram illustrating an example in which a VSS electrode to which the ELVSS is applied is divided into a VSS electrode for the first screen and a VSS electrode for a second screen according to one or more embodiments of the present disclosure.

It is preferable that a variable range of ELVSS is set to a range in which brightness is not varied by the user. However, when a variable range of the gate driving frequency is increased, the variable range of ELVSS can also be increased. When the variable range of ELVSS is increased and the frequency is varied, the brightness of the pixels can be changed out of the brightness change recognition range ΔL of the user. In this case, as shown in FIG. 36, the VSS electrode 106 can be divided into a VSS electrode 106L for the first screen L and a VSS electrode 106R for the second screen R. When the VSS electrodes 106L and 106R are divided between the first screen L and the second screen R and the ELVSS voltage of the deactivated screen is decreased due to a variation in gate driving frequency, ELVSS of the activated screen can be maintained as the existing voltage.

Figure 37:
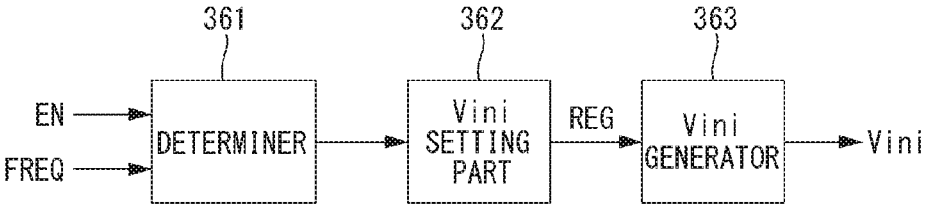
FIGS. 37 and 38 are diagrams illustrating a Vini variable device according to an embodiment of the present disclosure.

FIGS. 37 and 38 are diagrams illustrating a Vini variable device according to an embodiment of the present disclosure.

Referring to FIGS. 37 and 38, the power supply 304 of the drive IC 300 can include a Vini variable device.

The Vini variable device includes a determiner 361, a Vini setting part 362, and a Vini generator 363.

The determiner 361 determines whether the foldable display is folded and determines the gate driving frequency or the frame frequency in response to the enable signal EN or the frequency detection signal FREQ. The determiner 361 can determine a folded state or an unfolded state of the foldable display according to the enable signal EN. The determiner 361 can determine the gate driving frequency or the frame frequency according to the frequency detection signal FREQ.

The Vini setting part 362 receives a folding and frequency determination signal from the determiner 321. The Vini setting part 362 outputs a register setting value REG in response to the folding and frequency determination signal.

When the foldable display is in an unfolded state, since the pixels of all the screens L, A, and R are driven, an IR drop amount of ELVDD is maximized. Meanwhile, when the foldable display is in a folded state, since some of all the screens L, A, and R are activated, the IR drop amount of ELVDD is relatively small. In this case, in the folded state, brightness of pixels in a small-sized screen of the activated screens L, A, and R is increased. According to the present disclosure, in the folded state and the unfolded state, in order to allow the pixels to have the same brightness, Vini is decreased in the folded state in which the IR drop amount is small, and the brightness of the pixels is decreased so that the decreased brightness of the pixels is made to be equal to the brightness in the unfolded state. When the voltage level of Vini is decreased, a voltage of the capacitor Cst does not reach a target level of the data voltage Vdata within a fixed sampling time Tsam, and thus a charging rate of the capacitor Cst is decreased.

Thus, according to the foldable display of the present disclosure, a difference in IR drop amount between the folded state and the unfolded is compensated for with Vini so that a change in brightness of the screen can be minimized regardless of whether the foldable display is folded.

The Vini setting part 362 selects a register setting value REG to compensate for the difference in IR drop amount in the unfolded state and the folded state in response to the folding and frequency determination signal. The Vini setting part 362 selects the register setting value REG as A in the unfolded state of the foldable display. Meanwhile, in order to decrease the voltage level of Vini to decrease the brightness of the pixels in the unfolded state of the foldable display, the Vini setting part 362 selects the register setting value REG as B. A can be set to a value that is greater than B (A>B).

The Vini variable device compensates for a decrease in brightness of pixels, which is caused when the gate driving frequency or the frame frequency of the deactivated screen in the folded state is decreased, by varying the voltage of Vini. In order to compensate for the decrease in brightness of the deactivated screen, Vini supplied to the pixels of the deactivated screen can be set to a voltage that is higher than Vini supplied to the pixels of the activated screen.

Vini applied to the anode of the light emitting element OLED decreases brightness of a black gray scale of the pixels in the deactivated screen. When the gate driving frequency of the deactivated screen is decreased, the voltage of the capacitor Cst in the pixels is decreased so that the rate of change in brightness of the pixels is increased. According to the present disclosure, in order to solve the above problem, Vini applied to the anode of the light emitting element OLED in the deactivated screen is varied according to the gate driving frequency. For example, according to the present disclosure, the decrease in brightness of pixels, which is decreased as the frequency is decreased when the foldable display is folded, is compensated for by increasing the voltage level of Vini. When the voltage of Vini is increased, a voltage of the anode of the light emitting element OLED is increased so that the brightness of the pixel is increased.

The Vini setting part 362 varies the register setting value REG for each frequency so as to adaptively vary the voltage level of Vini according to the gate driving frequency in the folded state of the foldable display in response to the folding and frequency determination signal.

The register setting value REG selected in the folded state of the foldable display can be selected as a different value for each frequency. The register setting value REG can include a first setting value corresponding to a first frequency and a second setting value corresponding to a second frequency. As shown in FIG. 38, when a variable range of the gate driving frequency ranges from 5 Hz to 60 Hz, the first setting value can be a setting value corresponding to 60 Hz=B, and the second setting value can be a setting value corresponding to 5 Hz=C. C can be set to a value that is greater than B (C>B). When the variable range of the gate driving frequency ranges from 1 Hz to 60 Hz, C can be a setting value corresponding to 1 Hz.

The Vini setting part 362 can select a voltage level of Vini, which is gradually varied, as a register setting value using an interpolation method. For example, when the gate driving frequency is 10 Hz, the register setting value REG can be calculated as REG=B+5(C−B)/6. When the gate driving frequency is 20 Hz, the register setting value REG can be calculated as B+4(C−B)/6. When the gate driving frequency is 50 Hz, the register setting value REG can be calculated as REG=B+(C−B)/6.

The DC-DC converter of the power supply 304 can vary an output voltage level according to the resistor setting value REG. The register setting value REG is differently set for each frequency. For example, as in an example of FIG. 38, 5 Hz of the deactivated screen can be set to C, and 60 Hz of the deactivated screen can be set to A. When the foldable display is unfolded, 60 Hz can be set to A.

The Vini generator 363 can determine a duty ratio of a PWM signal to vary the voltage level of Vini in response to the register setting value REG from the Vini setting part 362. The duty ratio of the PWM signal can be determined according to the register setting value REG. For example, when REG=A, the duty ratio of PWM can be 50%, and, when REG=B, the duty ratio of PWM can be 40%. Consequently, according to the present disclosure, an increase in brightness of the pixels due to a decrease in IR drop amount when the foldable display is folded can be compensated for by decreasing the voltage level of Vini.

When REG=B, the duty ratio of PWM can be 40%, and, when REG=C, the duty ratio of PWM can be 60%. Thus, according to the present disclosure, when the foldable display is folded, the decrease in brightness of the pixels, which is caused when the gate driving frequency of the deactivated screen is decreased, can be compensated for by increasing the voltage level of Vini.

Figure 40:
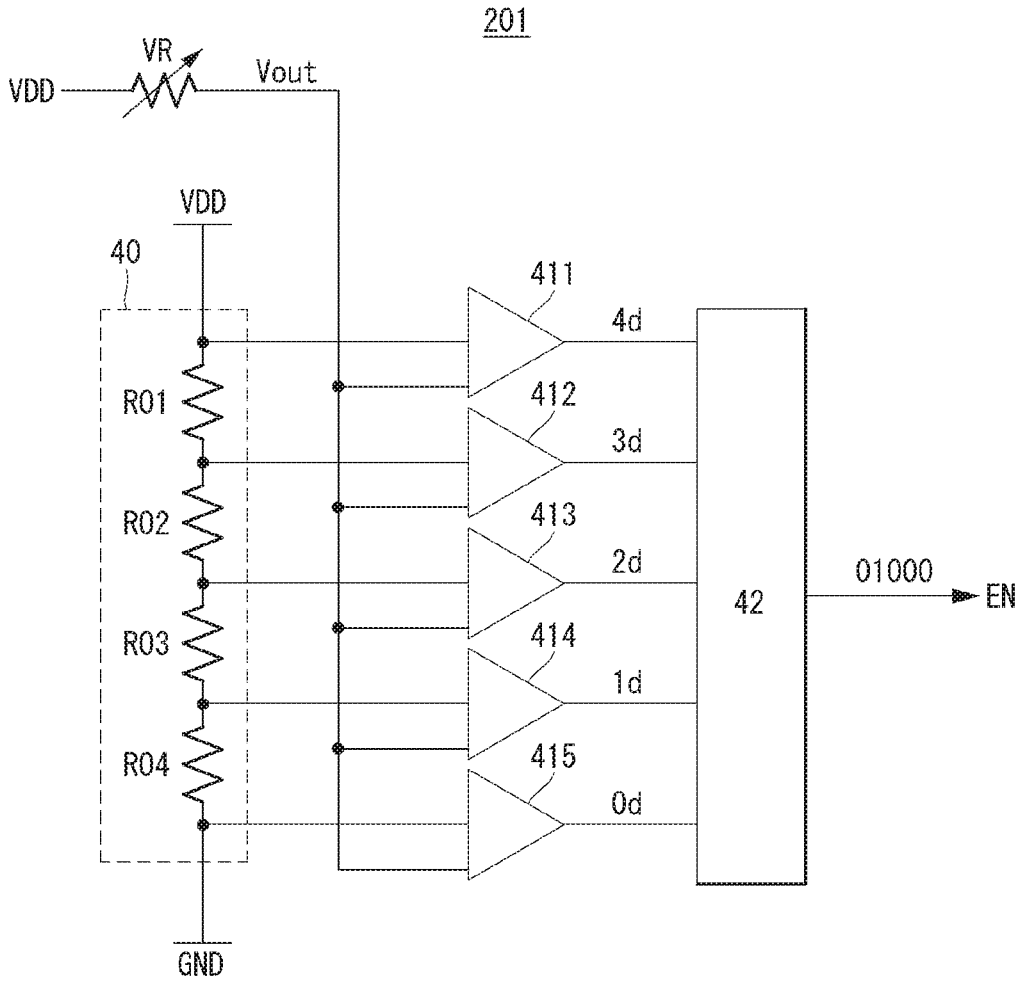

FIGS. 39 and 40 are diagrams illustrating a sensing device for sensing whether a foldable display is folded and sensing a folding angle. Here, (a) of FIG. 39 illustrates an out-folding type foldable display, and (b) of FIG. 39 illustrates an in-folding type foldable display.

Referring to FIGS. 39 and 40, the foldable display of the present disclosure includes a sensing device 201.

The sensing device 201 includes a variable resistor VR of which resistance value is varied according to deformation of the flexible display panel 100, a reference voltage generator 40, a plurality of comparators 411 to 415, and an encoder 42.

The flexible display panel 100 can be adhered to a base plate 110. The base plate 110 includes a first support layer 111, a second support layer 112, and a hinge 113 for connecting the first support layer 111 to the second support layer 112.

The first screen L of the flexible display panel 100 is adhered onto the first support layer 111, and the second screen R thereof is adhered onto the second support layer 112. The folding boundary A is located in a portion of the hinge 113 of the base plate 110.

The user can fold the flexible display panel 100 together with the base plate 110. The variable resistor VR includes a plurality of resistors R1 to R5 connected through the hinge 113 according to a folding angle. At the folding angle as shown in FIG. 39, the variable resistor VR is R2+R5. A resistance of the variable resistor VR can be varied to R1+R5, R2+R5, R3+R5, or R4+R5 according to the folding angle of the flexible display panel 100. A folding voltage Vout, which is a voltage dropped by as much as a resistance value of the variable resistor VR, is applied to the comparators 411 to 415.

The reference voltage generator 40 divides a high potential reference voltage VDD and a ground voltage source GND using a voltage divider circuit including resistors R01~R04 connected in series and outputs a plurality of reference voltages having different voltage levels through voltage dividing nodes. Each of the comparators 411 to 415 compares a reference voltage from the reference voltage generator 40 with the folding voltage Vout, outputs a high voltage when the folding voltage Vout is higher than the reference voltage, and outputs a low voltage when the folding voltage Vout is lower than or equal to the reference voltage.

The first comparator 411 compares a highest level reference voltage with a folding voltage Vout and outputs a highest voltage when the folding voltage Vout is higher than the highest level reference voltage, otherwise, the first comparator 411 outputs a low voltage. The fifth comparator 415 compares a lowest level reference voltage with the folding voltage Vout and outputs the high voltage when the folding voltage Vout is higher than the lowest level reference voltage, otherwise, the fifth comparator 415 outputs the low voltage.

The encoder 42 can convert voltages output from the comparators 411 to 415 into a digital code to output the enable signal EN. For example, when a first voltage 4d output from the first comparator 411 is a low voltage, the encoder 42 can output a most significant bit as 0, and, when a second voltage 3d output from the second comparator 412 is a low voltage, the encoder 42 can output a next most significant bit as 1. When a fifth voltage 0d output from the fifth comparator 415 is a low voltage, the encoder 42 can output a least significant bit as 0.

The display of the present disclosure and a driving method thereof according to one or more embodiments of the present disclosure can be described below.

The display can include a flexible display panel including a screen in which pixels are disposed and in which data lines to which data voltages are applied cross gate lines to which gate signals are applied; and a display panel driver configured to activate the entire screen of the flexible display panel to display an image on a maximum screen in an unfolded state of the flexible display panel, and activate a part of the screen in a folded state of the flexible display panel to display an image on the activated screen that is smaller than the maximum screen and display a black gray scale on an deactivated screen.

The display panel driver can include a gate driver configured to sequentially supply the gate signals to the gate lines of the screen.

The gate driver receives a first gate start pulse to supply the gate signals to the gate lines of the activated screen and receives a second gate start pulse to supply the gate signals to the gate lines of the deactivated screen. A frequency of the second gate start pulse is lower than that of the first gate start pulse.

Each of the pixels can include a light emitting element; a drive element disposed between a pixel driving voltage terminal and the light emitting element to supply a current to the light emitting element; and a capacitor connected between a first power line to which a pixel driving voltage from the pixel driving voltage terminal is applied, and a first node to which an initialization voltage is applied.

The gate signal can include a scan signal synchronized with a data voltage of an input image in the activated screen and controlling a switching element connected to an anode of the light emitting element in the deactivated screen to supply an initialization signal, which suppresses light emission of the light emitting element, to the anode of the light emitting element; and a light emission control signal switching a current path of the light emitting element.

The drive element can include a first electrode connected to the first node, a gate connected to a second node, and a second electrode connected to a third node.

Each of the pixels can include a first switching element turned on in response to a gate-on voltage pulse of an $N^{th}$ scan signal (N is a natural number, e.g., positive integer) to connect the second node to the third node; a second switching element turned on in response to the gate-on voltage pulse of the $N^{th}$ scan signal to connect the data line to the first node; a third switching element turned on in response to a gate-on voltage of the light emission control signal to connect the first power line to the first node; a fourth switching element turned on in response to the gate-on voltage of the light emission control signal to connect the drive element to the anode of the light emitting element; a fifth switch element turned on in response to a gate-on voltage of a $(N-1)^{th}$ scan signal to connect the second node to a second power line to which the initialization voltage is supplied; and a sixth switching element turned on in response to the gate-on voltage of the $(N-1)^{th}$ scan signal in the activated screen to connect the second power line to the anode of the light emitting element and turned on in response to the gate-on voltage of the $N^{th}$ scan signal in the deactivated screen to connect the second power line to the anode of the light emitting element. The gate-on voltage pulse of the $N^{th}$ scan signal is generated subsequent to the gate-on voltage pulse of the $(N-1)^{th}$ scan signal. The $N^{th}$ scan signal is synchronized with the data voltage of the input image in the activated screen and turns the sixth switching element on in the deactivated screen to supply the initialization signal to the anode of the light emitting element. The first to sixth switching elements are turned on in response to the gate-on voltage and turned off in response to a gate-off voltage.

A driving time of each of the pixels can be divided into an initialization time, a sampling time, a data write time, and a light emission time; during the initialization time, the (N−1) th scan signal is generated as a pulse of the gate-on voltage, and a voltage of each of the Nth scan signal and the light emission control signal is generated as the gate-off voltage; during the sampling time, the $N^{th}$ scan signal is generated as the pulse of the gate-on voltage, and a voltage of each of the $(N-1)^{th}$ scan signal and the light emission control signal is generated as the gate-off voltage; during the data write time, a voltage of each of the $(N-1)^{th}$ scan signal, the $N^{th}$ scan signal, and the light emission control signal is generated as the gate-off voltage; and during at least some time of the light emission time, the light emission control signal is generated as the gate-off voltage, and the voltage of each of the $(N-1)^{th}$ scan signal and the $N^{th}$ scan signal is generated as the gate-off voltage.

The gate driver can include a first gate driver configured to receive a first gate start pulse and supply the gate signal to gate lines formed on a part of the screen; and a second gate driver configured to receive a second gate start pulse and supply the gate signal to gate lines formed on the remaining part of the screen. In the folded state, one of the part of the screen and the remaining part of the screen is activated and the other is deactivated.

The frequency of the second gate start pulse can be gradually decreased as a duration time of the folded state increases.

During the sampling time of the deactivated screen, the initialization voltage is supplied to the anode of the light emitting element in the deactivated screen; and a low potential power voltage is supplied to a cathode of the light emitting element in each of the activated screen and the deactivated screen.

The low potential power voltage supplied to the pixels of the deactivated screen is lower than the low potential power voltage supplied to the pixels of the activated screen.

The low potential power voltage supplied to the pixels of the deactivated screen is decreased as the frequency of the gate start pulse, which is input to the gate driver connected to the gate lines of the deactivated screen among the first gate driver and the second gate driver, is decreased.

The initialization voltage supplied to the pixels of the deactivated screen is lower than the initialization voltage supplied to the pixels of the activated screen.

The initialization voltage supplied to the pixels of the deactivated screen is increased as the frequency of the gate start pulse, which is input to the gate driver connected to the gate lines of the deactivated screen among the first gate driver and the second gate driver, is decreased.

The initialization voltage applied to the pixels when the flexible display panel is folded in the folded state is lower than the initialization voltage applied to the pixels when the flexible display panel is unfolded in the unfolded state.

The display further can include a DC-DC (direct current to direct current) converter configured to output the pixel driving voltage, the low potential power voltage, and the initialization voltage. A voltage level of at least one of the low potential power voltage and the initialization voltage is varied according to a register setting value which is varied according to at least one of whether the flexible display panel is folded and the frequency of the gate start pulse.

A first VSS electrode to which the low potential power voltage is applied in the activated screen is separated from a second VSS electrode to which the low potential power voltage is supplied in the deactivated screen. The low potential power voltage applied to the first VSS electrode is different from the low potential power voltage applied to the second VSS electrode in the folded state.

A method of driving the display can include activating the entire screen of the flexible display panel to display an image on a maximum screen in an unfolded state of the flexible display panel; activating a part of the screen and displaying an image on a activated screen that is smaller than the maximum screen in a folded state of the flexible display panel; and displaying a black gray scale on a deactivated screen which is set as the remaining screen except for the activated screen in the folded state. The displaying of the image on the activated screen includes supplying the gate signals to the gate lines of the activated screen using a first gate driver configured to receive a first gate start pulse and supply the gate signals to the gate lines of the activated screen. The displaying of the black gray scale on the deactivated screen includes supplying the gate signals to the gate lines of the deactivated screen using a second gate driver configured to receive a second gate start pulse and supply the gate signals to the gate lines of the deactivated screen. A frequency of the second gate start pulse is lower than that of the first gate start pulse.

The method further can include gradually decreasing the frequency of the second gate start pulse as a duration time of the folded state in which the flexible display panel is folded increases.

The method further can include controlling a low potential power voltage, which is supplied to a cathode of a light emitting element formed in each of the pixels of the deactivated screen, to be lower than a low potential power voltage supplied to a cathode of a light emitting element formed in each of the pixels of the activated screen.

The method further can include controlling an initialization voltage, which is supplied to a capacitor and an anode of a light emitting element which are formed in each of the pixels of the deactivated screen, to be lower than an initialization voltage supplied to a capacitor and an anode of a light emitting element which are formed in each of the pixels of the activated screen.

The method further can include controlling an initialization voltage, which is applied to the pixels when the flexible display panel is folded in the folded state, to be lower than an initialization voltage applied to the pixels when the flexible display panel is unfolded in the unfolded state.

In accordance with one or more embodiments of the present disclosure, a part of a screen not driven in a foldable display, for example, a screen at which a user does not look, is deactivated in a folded state, and a voltage which suppresses light emission of a light emitting element in the deactivated screen is applied so that it is possible to reduce power consumption, increase a battery lifetime, and allow the deactivated screen to fully display black.

In accordance with one or more embodiments of the present disclosure, a gate driver is divided into two or more gate drivers to drive a screen without applying data voltages to pixels of the deactivated screen in the folded state of the foldable display so that it is possible to sufficiently secure a blank interval for which the pixels are not driven.

In accordance with one or more embodiments of the present disclosure, the activated screen at which a user looks can be driven on the foldable display at a high speed. In a VR mode, the screen is driven at a high speed so that it is possible to reduce motion sickness and fatigue of the user.

In accordance with one or more embodiments of the present disclosure, in the foldable display, an activated screen displaying an image is progressively scanned at a high gate driving frequency every frame time, whereas a deactivated screen is scanned at a low gate driving frequency. In this case, power consumption of a gate driver driving gate lines of the deactivated screen can be minimized.

In accordance with one or more embodiments of the present disclosure, a variation in brightness of pixels, which is caused when a gate driving frequency of a part of the screen of the foldable display is decreased, can be compensated for by varying at least one of a low potential power supply voltage ELVSS and an initialization voltage Vini.

In accordance with one or more embodiments of the present disclosure, a phenomenon in which brightness of the activated screen is increased due to a difference in IR drop amount can be prevented by varying the initialization voltage Vini when the foldable display is folded.

While the embodiments of the present disclosure have been described in detail above with reference to the accompanying drawings, the present disclosure is not limited to the embodiments, and various changes and modifications can be made without departing from the technical spirit of the present disclosure. Accordingly, the embodiments disclosed herein are to be considered descriptive and not restrictive of the technical spirit of the present disclosure, and the scope of the technical spirit of the present disclosure is not limited by the embodiments. Therefore, it should be understood that the above embodiments are illustrative rather than restrictive in all respects. The scope of the disclosure should be construed by the appended claims, and all technical spirits within the scopes of their equivalents should be construed as being included in the scope of the disclosure.

What is claimed is:

1. A display device comprising:

a flexible display panel including a screen in which pixels are disposed and in which data lines cross gate lines, wherein data voltages are applied to the data lines and gate signals are applied to the gate lines; and a display panel driver configured to activate the entire screen of the flexible display panel to display an image on a maximum screen in an unfolded state of the flexible display panel, and activate a part of the screen in a folded state of the flexible display panel to display an image on the activated screen that is smaller than the maximum screen and display a black gray scale on a deactivated screen, wherein the display panel driver includes a gate driver configured to sequentially supply the gate signals to the gate lines of the screen, wherein the gate driver receives a first gate start pulse to supply the gate signals to the gate lines of the activated screen on which the image is displayed and receives a second gate start pulse to supply the gate signals to the gate lines of the deactivated screen on which the black gray scale is displayed, and wherein a frequency of the second gate start pulse is lower than a frequency of the first gate start pulse.

2. The display device of claim 1, wherein each of the pixels includes:

a light emitting element;

a drive element disposed between a pixel driving voltage terminal and the light emitting element to supply a current to the light emitting element; and a capacitor connected between a first power line to which a pixel driving voltage from the pixel driving voltage terminal is applied, and a gate of the drive element, and wherein the gate signal includes:

a scan signal synchronized with a data voltage of an input image in the activated screen and controlling a switching element connected to an anode of the light emitting element in the deactivated screen to supply an initialization signal, which suppresses light emission of the light emitting element, to the anode of the light emitting element; and a light emission control signal switching a current path of the light emitting element.

3. The display device of claim 2, wherein the drive element includes a first electrode connected to a first node, the gate connected to a second node, and a second electrode connected to a third node, wherein each of the pixels includes:

a first switching element turned on in response to a gate-on voltage pulse of an $N^{th}$ scan signal to connect the second node to the third node, where N is a natural number;

a second switching element turned on in response to the gate-on voltage pulse of the $N^{th}$ scan signal to connect the data line to the first node;

a third switching element turned on in response to a gate-on voltage of the light emission control signal to connect the first power line to the first node;

a fourth switching element turned on in response to the gate-on voltage of the light emission control signal to connect the drive element to the anode of the light emitting element;

a fifth switch element turned on in response to a gate-on voltage of a $(N-1)^{th}$ scan signal to connect the second node to a second power line to which the initialization voltage is supplied; and a sixth switching element turned on in response to the gate-on voltage of the $(N-1)^{th}$ scan signal or $N^{th}$ scan signal to connect the second power line to the anode of the light emitting element, wherein the gate-on voltage pulse of the $N^{th}$ scan signal is generated subsequent to the gate-on voltage pulse of the $(N-1)^{th}$ scan signal, the $N^{th}$ scan signal is synchronized with the data voltage of the input image in the activated screen, and the first to sixth switching elements are turned ire response to the gate-on voltage and turned off in response to a gate-off voltage.

4. The display device of claim 3, wherein:

a driving time of each of the pixels is divided into an initialization time, a sampling time, a data write time, and a light emission time;

during the initialization time, the (N−1)th scan signal is generated as a pulse of the gate-on voltage, and a voltage of each of the Nth scan signal and the light emission control signal is generated as the gate-off voltage;

during the sampling time, the $N^{th}$ scan signal is generated as the pulse of the gate-on voltage, and a voltage of each of the $(N-1)^{th}$ scan signal and the light emission control signal is generated as the gate-off voltage;

during the data write time, a voltage of each of the $(N-1)^{th}$ scan signal, the $N^{th}$ scan signal, and the light emission control signal is generated as the gate-off voltage; and during at least some time of the light emission time, the light emission control signal is generated as the gate-on voltage, and the voltage of each of the $(N-1)^{th}$ scan signal and the $N^{th}$ scan signal is generated as the gate-off voltage.

5. The display device of claim 4, wherein the gate driver includes:

a first gate driver configured to receive a first gate start pulse and supply the gate signal to gate lines formed on a part of the screen; and a second gate driver configured to receive a second gate start pulse and supply the gate signal to gate lines formed on the remaining part of the screen, and wherein, in the folded state, one of the part of the screen and the remaining part of the screen is activated and the other is deactivated.

6. The display device of claim 5, wherein the frequency of the second gate start pulse is gradually decreased as a duration time of the folded state increases.

7. The display device of claim 5, wherein:

during the sampling time of the deactivated screen, the initialization voltage is supplied to the anode of the light emitting element in the deactivated screen; and a low potential power voltage is supplied to a cathode of the light emitting element in each of the activated screen and the deactivated screen.

8. The display device of claim 7, wherein the low potential power voltage supplied to the pixels of the deactivated screen is lower than the low potential power voltage supplied to the pixels of the activated screen.

9. The display device of claim 8, wherein the low potential power voltage supplied to the pixels of the deactivated screen is decreased as the frequency of the first gate start pulse and the second gate start pulse, which is input to the gate driver connected to the gate lines of the deactivated screen among the first gate driver and the second gate driver, is decreased.

10. The display device of claim 7, wherein the initialization voltage supplied to the pixels of the deactivated screen is lower than the initialization voltage supplied to the pixels of the activated screen.

11. The display device of claim 10, wherein the initialization voltage supplied to the pixels of the deactivated screen is increased as the frequency of the first gate start pulse and the second gate start pulse, which is input to the gate driver connected to the gate lines of the deactivated screen among the first gate driver and the second gate driver, is decreased.

12. The display device of claim 7, wherein the initialization voltage applied to the pixels when the flexible display panel is folded in the folded state is lower than the initialization voltage applied to the pixels when the flexible display panel is unfolded in the unfolded state.

13. The display device of claim 7, further comprising a DC-DC (direct current to direct current) converter configured to output the pixel driving voltage, the low potential power voltage, and the initialization voltage, wherein a voltage level of at least one of the low potential power voltage and the initialization voltage is varied according to a register setting value which is varied according to at least one of whether the flexible display panel is folded and the frequency of the first gate start pulse and the second gate start pulse.

14. The display device of claim 7, wherein:

a first VSS electrode to which the low potential power voltage is applied in the activated screen is separated from a second VSS electrode to which the low potential power voltage is supplied in the deactivated screen; and wherein the low potential power voltage applied to the first VSS electrode is different from the low potential power voltage applied to the second VSS electrode in the folded state.

* * * * *